United States Patent [19]

Tamaki et al.

[11] Patent Number: 4,952,470

[45] Date of Patent: Aug. 28, 1990

[54] ELECTROPHOTOGRAPHIC PHOTOSENSITIVE MEMBER

[75] Inventors: Kiyoshi Tamaki; Koichi Kudoh; Yoshihiko Etoh; Yoshiaki Takei, all of Hachioji, Japan

[73] Assignee: Konica Corporation, Tokyo, Japan

[21] Appl. No.: 180,816

[22] PCT Filed: Jul. 9, 1987

[86] PCT No.: PCT/JP87/00489

§ 371 Date: Apr. 21, 1988

§ 102(e) Date: Apr. 21, 1988

[87] PCT Pub. No.: WO88/00725

PCT Pub. Date: Jan. 28, 1988

[30] Foreign Application Priority Data

| | | | |
|---|---|---|---|
| Jul. 10, 1986 | [JP] | Japan | 61-162866 |
| Jul. 10, 1986 | [JP] | Japan | 61-162867 |
| Sep. 13, 1986 | [JP] | Japan | 61-217492 |
| Sep. 13, 1986 | [JP] | Japan | 61-217493 |
| Sep. 19, 1986 | [JP] | Japan | 61-221541 |

[51] Int. Cl.[5] ..... G03G 5/04

[52] U.S. Cl. ..... 430/56; 430/58; 430/59

[58] Field of Search ..... 430/56, 58, 59

[56] References Cited

U.S. PATENT DOCUMENTS

| | | | |
|---|---|---|---|
| 4,423,130 | 12/1983 | Horle et al. | 430/59 |
| 4,526,864 | 7/1985 | Takada et al. | 430/505 X |
| 4,563,408 | 1/1986 | Lin et al. | 430/59 |

FOREIGN PATENT DOCUMENTS

| | | | |
|---|---|---|---|
| 50-44835 | of 1975 | Japan . | |
| 57-122444 | 7/1982 | Japan | 430/58 |
| 61-156131 | 7/1986 | Japan . | |

*Primary Examiner*—Paul R. Michl
*Assistant Examiner*—Jeffrey A. Lindeman
*Attorney, Agent, or Firm*—Jordan B. Bierman

[57] ABSTRACT

An electrophotographic photosensitive member having improved anti-oxidation properties by ozone, comprising a conductive substrate, disposed thereon, a photosensitive layer which includes, as principal constituents, a charge generating material and a charge transporting material, wherein the photosensitive layer contains at least one type of compound selected from a group of those represented by any of the following [A] through [D]:

[A] Compounds represented by the following general formula [I];

General formula

[I]

[B] Bisspiroindene compounds represented by the following general formula [II];

[II]

[C] Bisspiroindene compounds represented by the following general formula [III];

(Abstract continued on next page.)

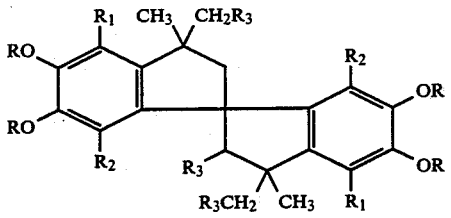
[III]
[D] Compounds having in the molecular structure thereof at least one structure selected from the following groups;
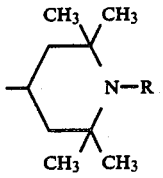
Structural formula (a)
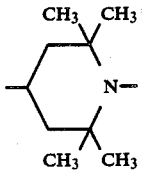
Structural formula (b)
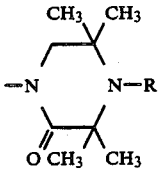
Structural formula (c)
1 Claim, 1 Drawing Sheet

ELECTROPHOTOGRAPHIC PHOTOSENSITIVE MEMBER

TECHNICAL FIELD

The present invention relates to an electrophotographic photosensitive member, in particular, to an improve organic electrophotographic photosensitive member.

BACKGROUND ART

With an electrophotographic copying apparatus according to the Carlson process, once the surface of a photosensitive member is electrified, an electrostatic latent image is formed by exposing, thereby the formed electrostatic latent image is developed by a toner, and then, the resultant positive image is transferred and fixed onto a paper sheet or the like. Additionally, the photosensitive member is subjected to removal of remaining toner, electrical neutralizing, and cleaning of the member surface, in order to allow repeatedly used during the course of long service life.

Accordingly, the requirements of an electrophotographic photosensitive member include not only an electrification property, and electrophotographic properties such as smaller dark attenuation, but physical properties in relation to repeated operations, such as a press life, wear-resistance, and moisture-resistance, as well as satisfactory resistance to ozone generated when corona charge is applied, or to ultraviolet ray emitted during exposing (environmental resistance).

A conventional electrophotographic photosensitive member commonly used in the art is an inorganic photosensitive member having a photosensitive layer principally comprising an inorganic photoconductive material such as selenium, zinc oxide, and cadmium sulfide.

Recently, the research and development of various organic photoconductive materials as materials for forming photosensitive layer in an electrophotographic photosensitive member is actively undertaken in the art.

For example, Japanese Patent Examined Publication No. 10496/1975 describes an organic photosensitive member having a photosensitive layer containing poly-N-vinylcarbazole and 2,4,7-trinitro-9-fluorenone. This photosensitive member, however, does not necessarily satisfy the requirements of sensitivity and press life. To solve such a disadvantage, a development effort has focused on an organic photosensitive member with high-sensitivity and longer press life, wherein a photosensitive layer comprises a specific material being capable of generating an electrical charge and another specific material being capable of transporting the generated charge. In forming such a "separated function" type electrophotographic photosensitive member, a specific material intended for one of the two specific functions is arbitrarily selected from a wide range of materials. Accordingly, an electrophotographic photosensitive material having arbitrary properties may be rather readily available.

Diverse types of materials effectively serving as a charge generating material of such a separated function type electrophotographic photosensitive member have been proposed. One example of an inorganic material serving this purpose is an amorphous selenium described in Japanese Patent Examined Publication No. 16198/1968. This material is used together with an organic charge transporting material.

Additionally, may types of electrophotographic photosensitive members comprising an organic dye or organic pigment as a carrier generating material have been proposed. For example, those having a photosensitive material containing a bisazo compound are known in the art by Japanese Patent Open to Public Inspection (hereinafter referred to as Japanese Patent O.P.I. Publication) Nos. 37543/1972, 22834/1980, 79632/1979, and 116040/1981.

Incidentally, known photosensitive members incorporating an organic photoconductive material are usually used for a negative-charging application. This is because a negative-charge application allows a larger hole transporting capacity relative to an electrical potential and is advantageous in terms of photo-sensitivity or the like.

Such a negative-charge application, however, has been found to have the following disadvantages. The first problem is that ozone is readily produced in an environment during negative-electrification by an electrifier, thus deteriorating the environmental condition. The second problem is that development with a negative-charge type photosensitive member requires a positive-polarity toner; and manufacturing a positive-polarity toner is difficult in view of a triboelectrical electrifying array for ferromagnetic charged particles.

Correspondingly, the use of a photosensitive member comprising an organic photoconductive material electrified in positive polarity has been proposed. In the case of a positive-charge type photosensitive member comprising a charge transporting layer disposed on a charge generating layer wherein the charge transporting layer is formed using a material) having a great transporting capability, the charge transporting layer is contains, for example, trinitrofluorenone. This substance, however, is inappropriate as it has carcinogenic activity. Another possibility is a positive-charge type photosensitive member comprising a charge transporting layer of greater hole transporting capacity, disposed thereon, a charge generating layer. This arrangement means an extremely thin charge generating layer disposed to the surface side, and resulting in poor press life. In short, this arrangement does not provide a practical layer constitution.

U.S. Pat. No. 3,615,414 discloses a positive charge type photosensitive member which contains eutectic complex formed by thiapyrylium salt (charge generating material) and polycarbonate (binder resin). Such a known photosensitive member, however, has a disadvantage; greater memory development, and a readily occurring ghost. U.S. Pat. No. 3,357,989 discloses a photosensitive member which contains phthalocyanine. Phthalocyanine, however, is inappropriate in that its property varies depending on a type of crystal configuration, and thus the crystal configuration requires strict control, and that the sensitivity in shortwave region is insufficient and memory development is great. In short, this type of photosensitive material is inappropriate for a copying apparatus which used a light source of visible wavelength region.

Because of these facts, using a photosensitive member comprising an organic photoconductive material allows little possibility of commercial use. Accordingly, this type of photosensitive member has been almost exclusively used for a negative charge application.

The object of the present invention is to provide an organic photoconductive electrophotographic photosensitive material readily used for a positive charge application and having satisfactory sensitivity, while excelling in wear-resistance, ozone-resistance, and press life.

DISCLOSURE OF THE INVENTION

The present invention is an electrophotographic photosensitive member comprising a conductive substrate, disposed thereon, a photosensitive layer which includes, as principal constituents, a charge generating material and a charge transporting material, wherein the photosensitive layer contains at least one type of compound selected from a group of those represented by any of the following [A] through [D]:

[A] Compounds represented by the following general formula [I];

General formula

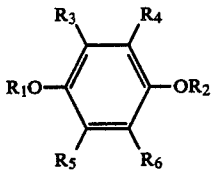

[I]

[wherein $R_1$ and $R_2$ independently represent an alkyl group, alkenyl group, cycloalkyl group, aryl group or heterocyclic group; $R_3$, $R_4$, $R_5$ and $R_6$ independently represent a hydrogen atom, halogen atom, alkyl group, alkenyl group, cycloalkyl group, aryl group, alkoxy group, alkylthio group, acyl group, acylamino group, alkylamino group, alkoxycarbonyl group, or sulfonamide group];

[B] Spirobichroman compounds represented by the following general formula [II];

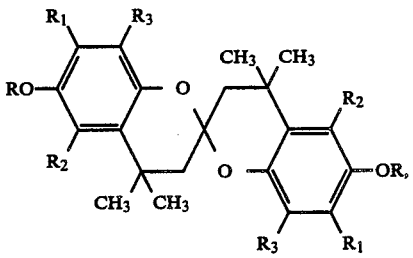

[II]

[wherein $R_1$ represents an alkyl group, alkenyl group, cycloalkyl group, aryl group, alkoxy group, alkenoxy group, or aryloxy group; $R_2$ and $R_3$ independently represent a hydrogen atom, halogen atom, alkyl group, alkenyl group, or alkoxy group;

R represents an alkyl group, alkenyl group, cycloalkyl group, aryl group, heterocyclic group, $R_4CO$— group, $R_5SO_2$— group, or $R_6NHCO$— group; R represents a hydrogen atom, or an alkyl group, alkenyl group, $R_4CO$—group, $R_5SO_2$—group or $R_6NHCO$— group; $R_4$, $R_5$ and $R_6$ independently represent an alkyl group, alkenyl group, cycloalkyl group, aryl group, or heterocyclic group;

When R is $R_4CO$—group, $R_5SO_2$—group or $R_6NHCO$—group, R and R′ may be either a same type of groups, or may be different groups];

[C] Spirobiindane compounds represented by the following general formula [III];

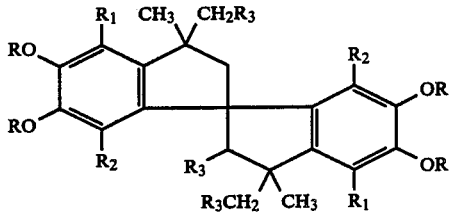

[III]

[wherein R represents an alkyl group, alkenyl group, aryl group, heterocyclic group, $R_4CO$—group, $R_5SO_2$— group, or $R_6NHCO$—group; $R_1$ and $R_2$ independently represent a hydrogen atom, halogen atom, alkyl group, alkenyl group, alkoxy group, or alkenoxy group; $R_3$ represents a hydrogen atom, alkyl group, alkenyl group, or aryl group; $R_4$, $R_5$ and $R_6$ independently represent a alkyl group, alkenyl group, aryl group, or heterocyclic group; and

[D] Compounds having a molecular structure at least one structure selected from the following groups;

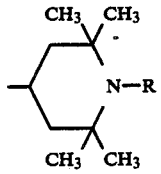

Structural formula (a)

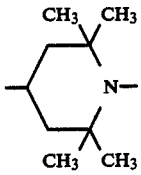

Structural formula (b)

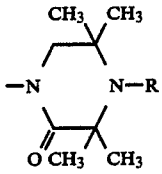

Structural formula (c)

[wherein R represents a hydrogen atom, or organic substituent group.]

Figure 1:
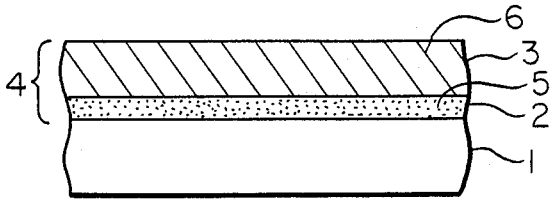
FIGS. 1 through 4 are respectively a cross-section of a photosensitive member of the invention, wherein numeral 1 represents a substrate.

numeral 2 represents a charge generating layer (CGL);

numeral 3 represents a charge transporting layer (CTL);

numeral 4 represents a photosensitive layer;

numeral 5 represents a charge generating material (CGM);

numeral 6 represents a charge transporting material (CTM);

numeral 7 represents an intermediate layer; and numeral 8 represents a protective layer (OCL).

Ozone-induced deterioration of a photosensitive member results from repeatedly applied corona charge, and, also, attributable to singlet oxygen which is produced by exposing. Additionally, degree of ozone-induced oxidation varies depending, for example, on the constitution of a photosensitive layer on a photosensitive member, types of charge generating material and charge transporting material. More specifically, a charge transporting material is more susceptible to oxidation, and the adverse effect of oxidation is greater when an organic photoconductive material is used.

The inventors have devotedly studied the improvement in ozone-induced deterioration (in particular, loss in potential) of a photosensitive member and learned that the previously specified compounds are not only capable of significantly inhibiting ozone-induced oxidation of a photosensitive member but also contributing to improved electrophotographic properties and physical properties, hence the present invention.

The present invention is hereunder described in detail.

In the previously mentioned general formula [I] representing compounds useful in embodying the invention, various components are as follows. The halogen atom may be a fluorine, chlorine, bromine or iodine atom. The alkyl group may be of a straight-chained or branched group, and, preferably, one having 1 to 32 carbon atoms such as a methyl, ethyl, butyl, t-butyl, 2-ethyl-hexyl, 3,5,5-trimethylhexyl, 2,2-dimethylpentyl, octyl, t-octyl, dodecyl, sec-dodecyl, hexadecyl, octadecyl or eicosyl group. The alkenyl group may be either a straight-chained or branched group, and, preferably, one having 2 to 32 carbon atoms such as an allyl, butenyl, octenyl or oleyl group. The preferred cycloalkyl group is a five- to seven-membered group such as a cyclopentyl, cyclohexyl, or cycloheptyl group. The examples of the aryl group include phenyl and naphthyl group. The preferred heterocyclic group is a five- to six-membered heterocyclic group containing a nitrogen atom and oxygen atom and/or a sulfur atom; the examples of such a heterocyclic group include furil, pyranyl, tetrahydropyranyl, imidazolyl, pyrrolyl, pyrimidyl, pyrazinyl, triazinyl, thienyl, quinolyl, oxazolyl, thiazolyl and pyridyl groups.

The examples of the alkoxy group include methoxy, ethoxy, propoxy, t-butoxy, hexyloxy, dodecyloxy, octadecyloxy, and docosyl groups; the examples of the alkylthio group include methylthio, butylthio, octylthio, dodecylthio, and docosylthio groups; the examples of the aryloxy group include phenoxy, and naphthoxy groups; the examples of the arylthio group include a phenylthio group; the examples of the acyl group include acetyl, butanoyl, octanoyl, dodecanoyl, benzoyl, cinnamoyl, and naphthoyl groups; the examples of the acylamino group include mono- or dialkylamino groups such as acetylamino, octanoylamino, and benzoylamino groups; the examples of the alkylamino group include methylamino, ethylamino, diethylamino, isopropylamino, dioctylamino and didecylamino groups; the examples of the alkoxycarbonyl group include methoxycarbonyl, ethoxycarbonyl, nonyloxycarbonyl, hexadecyloxycarbonyl, and docosyloxycarbonyl groups; and the examples of the sulfonamide group include methylsulfonamide, octylsulfonamide, and phenylsulfonamide groups.

Furthermore, each of these groups may have a substituent group. The examples of such a substituent group include a halogen atom, and hydroxy, carboxy, sulfo, cyano, alkyl (in particular, a group having 1 to 32 carbon atoms), alkenyl (in particular, a group having 2 to 32 carbon atoms), alkoxy, alkylthio, alkenyloxy, alkenylthio, aryl, aryloxy, arylthio, arylamino, alkylamino, alkenylamino, acyl, acyloxy, acylamino, carbamoyl, sulfonamide, sulfamoyl, alkoxycarbonyl, aryloxycarbonyl, and heterocyclic (in particular, a five- or six-membered group having a nitrogen atom, oxygen atom and/or sulfur atom) groups. Each of these substituent groups may further have any of the substituent groups listed above.

In this general formula, each of $R_1$ and $R_2$, preferably, should be an alkyl or alkenyl group which is straight-chained or branched and having 1 to 32 carbon atoms. The preferred substituent group such an alkyl or alkenyl group may have is a hydroxy, cyano, or carboxy group, or a halogen atom, or an aryl group; or an alkoxy or arylkoxy group having 1 to 32 carbon atoms; or an alkoxycarbonyl group having 1 to 32 carbon atoms. Each of $R_3$, $R_4$, $R_5$ and $R_6$, preferably, should be a hydrogen atom, or an alkyl or alkenyl group which is straight-chained or branched and having 1 to 32 carbon atoms. The preferred substituent group such an alkyl or alkenyl group may have is a substituent group $R_1$ and $R_2$ may have; the particularly preferred case is that at least two of $R_3$, $R_4$, $R_5$ and $R_6$ represent either an alkyl or alkenyl group, and the remaining two are hydrogen atoms.

The typical examples of compound [A] according to the invention are listed below. However, the scope of compounds useful in embodying the invention is not limited only to these examples.

Each compound is specified not by a structural formula, but by a substituent it has.

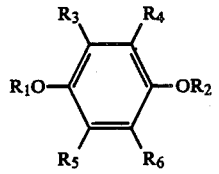

| Compound | $R_1$ | $R_2$ | $R_3$~$R_6$ |
|---|---|---|---|
| A-1 | $C_7H_{15}$ | $C_7H_{15}$ | $R_3$: $C_{12}H_{25}$(sec) $R_6$: $CH_3$ |
| A-2 | $C_{10}H_{21}$ | $C_{10}H_{21}$ | $R_3$: $C_8H_{17}$(t) $R_6$: $CH_3$ |
| A-3 | $C_{20}H_{41}$ | $C_{20}H_{41}$ | $R_3$: $C_4H_9$(t) $R_6$: $CH_3$ |
| A-4 | $C_4H_9$ | $C_4H_9$ | $R_3$: $C_{12}H_{25}$(sec) $R_6$: $CH_3$ |
| A-5 | $C_4H_9$ | $C_4H_9$ | $R_3$: $C_8H_{17}$(t) $R_6$: $CH_3$ |
| A-6 | $C_4H_9$ | $C_4H_9$ | $R_3$: $C_4H_9$(t) $R_6$: $CH_3$ |
| A-7 | $C_8H_{17}$ | $C_8H_{17}$ | $R_3$: $C_{18}H_{37}$(sec) $R_6$: $CH_3$ |
| A-8 | $C_8H_{17}$ | $C_8H_{17}$ | $R_3$: $C_{18}H_{37}$(sec) $R_5$: $CH_3$ |
| A-9 | $C_8H_{17}$ | $C_8H_{17}$ | $R_3$: $C_8H_{17}$(t) $R_6$: $CH_3$ |
| A-10 | $C_8H_{17}$ | $C_8H_{17}$ | $R_3$: $C_4H_9$(t) $R_6$: $CH_3$ |
| A-11 | $C_{12}H_{25}$ | $C_{12}H_{25}$ | $R_3$: $C_4H_9$(t) $R_6$: $CH_3$ |

-continued

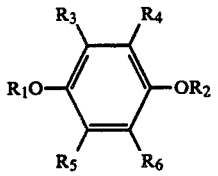

| Compound | $R_1$ | $R_2$ | $R_3 \sim R_6$ |
|---|---|---|---|
| A-12 | $C_{12}H_{25}$ | $C_{12}H_{25}$ | $R_3$: $C_8H_{17}$(t) $R_6$: $CH_3$ |
| A-13 | $C_{12}H_{25}$ | $C_{12}H_{25}$ | $R_3$: $C_{12}H_{25}$(sec) $R_6$: $CH_3$ |
| A-14 | $C_{16}H_{33}$ | $C_{16}H_{33}$ | $R_3$: $C_4H_9$(sec) $R_6$: $CH_3$ |
| A-15 | $C_{16}H_{33}$ | $C_{16}H_{33}$ | $R_3$: $C_4H_9$(t) $R_6$: $CH_3$ |
| A-16 | $C_{16}H_{33}$ | $C_{16}H_{33}$ | $R_3$: $C_{12}H_{25}$(sec) $R_6$: $CH_3$ |
| A-17 | $C_8H_{17}$ | $C_8H_{17}$ | $R_3$: $CH_3$ $R_5$: $CH_3$ $R_6$: $CH_3$ |
| A-18 | $C_{12}H_{25}$ | $C_{12}H_{25}$ | $R_3$: $CH_3$ $R_5$: $CH_3$ $R_6$: $CH_3$ |
| A-19 | $C_{16}H_{33}$ | $C_{16}H_{33}$ | $R_3$: $CH_3$ $R_5$: $CH_3$ $R_6$: $CH_3$ |
| A-20 | $CH_2CH{=}CH_2$ | $CH_2CH{=}CH_2$ | $R_3$: $C_8H_{17}$(t) $R_6$: $C_8H_{17}$(t) |
| A-21 | $C_8H_{17}$ | $C_8H_{17}$ | $R_3$: $C_4H_9$(t) $R_5$: $C_4H_9$(t) |
| A-22 | $C_8H_{17}$ | $C_8H_{17}$ | $R_3$: 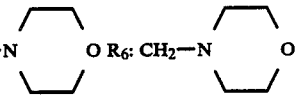 |
| A-23 | $C_{18}H_{33}$ | $C_{18}H_{33}$ | $R_3$: 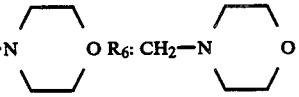 |
| A-24 | $C_{18}H_{37}$ | $C_{18}H_{37}$ | $R_3$: $C_{12}H_{25}$ $R_5$: $CH_3$ |
| A-25 | $C_{16}H_{33}$ | $C_{16}H_{33}$ | $R_3$: $C_{12}H_{25}$ $R_6$: $C_{12}H_{25}$ |
| A-26 | $C_{12}H_{25}$ | $C_{12}H_{25}$ | $R_3$: $C_{16}H_{33}$(sec) $R_6$: $C_{16}H_{33}$(sec) |
| A-27 | $C_2H_5$ | $C_2H_5$ | $R_3$: $(CH_2)_{11}OCH_3$ $R_6$: $(CH_2)_{11}OCH_3$ |
| A-28 | 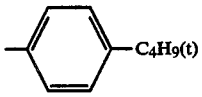 | 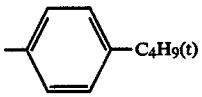 | $R_3$: $C_{11}H_{23}$ $R_6$: $C_{11}H_{23}$ |
| A-29 | $C_{18}H_{35}$ | $C_{18}H_{35}$ | $R_3$: $C_{12}H_{25}$(sec) $R_6$: $C_{12}H_{25}$(sec) |
| A-30 | $CH_3$ | $(CH_2)_{10}Br$ | $R_3$: $OCH_3$ |
| A-31 | 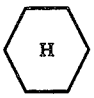 | 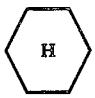 | $R_3$: $C_{16}H_{33}$ $R_6$: $C_{16}H_{33}$ |
| A-32 | $C_8H_{17}$ | $C_8H_{17}$ | $R_3$: 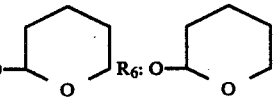 |
| A-33 | 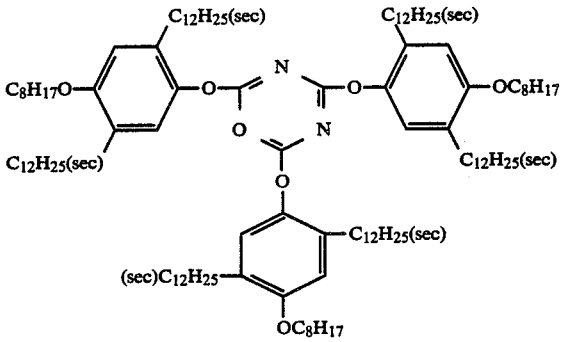 | | |

-continued

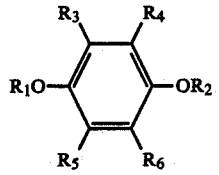

| Compound | $R_1$ | $R_2$ | $R_3 \sim R_6$ |
|---|---|---|---|
| A-34 | | 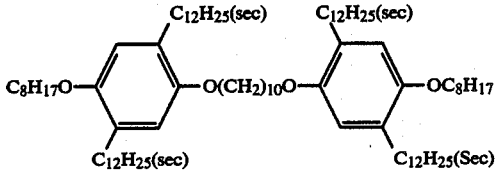  | |
| A-35 | $C_3H_7$(i) | $C_3H_7$(i) | $R_3$: $(CH_2)_{11}OCH_3$ |
| A-36 | $C_{18}H_{37}$ | $C_{18}H_{37}$ | $R_3$: $CH_2$— 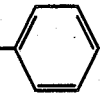 $R_6$: $CH_3$ |
| A-37 | 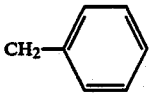  | 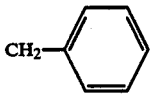  | $R_3$: $C_{16}H_{33}$(sec) $R_6$: $C_{16}H_{33}$(sec) |
| A-38 | $C_{12}H_{25}$ | $C_{16}H_{33}$ | $R_4$: $CH_3$ |
| A-39 | $C_{18}H_{37}$ | $C_{18}H_{37}$ | $R_4$: $CH_3$ |
| A-40 | $C_4H_9$ | $C_4H_9$ | $R_3$: Cl $R_6$: Cl |
| A-41 | $C_5H_{11}$(sec) | $C_5H_{11}$(sec) | $R_4$: $N(CH_2CH_2OH)_2$ |
| A-42 | $C_3H_7$(i) | 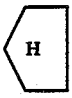  | $R_3$: $C_8H_{17}$(t) $R_6$: $CH_3$ |
| A-43 | $C_7H_{15}$(sec) | $C_7H_{15}$(sec) | $R_3$: $CH_2CO_2C_2H_5$ $R_6$: $CH_2CO_2C_2H_5$ |
| A-44 | $C_8H_{17}$ | $C_8H_{17}$ | $R_3$: $COCH_3$ |
| A-45 | $C_{16}H_{33}$ | $C_{16}H_{33}$ | $R_3$: $COC_{11}H_{23}$ |
| A-46 | $C_{12}H_{25}$(sec) | $C_{12}H_{25}$(sec) | $R_3$: $CO_2C_2H_5$ |
| A-47 | $C_{16}H_{33}$ | $C_{16}H_{33}$ | $R_3$: $OC_2H_5$ $R_6$: $OC_2H_5$ |
| A-48 | $CH_2CO_2C_2H_5$ | $CH_2CO_2C_2H_5$ | $R_3$: $C_4H_9$(t) $R_6$: $C_4H_9$(t) |
| A-49 | $CHCO_2C_2H_5$ \| $C_{12}H_{25}$ | $C_3H_7$ | $R_3$: $C_4H_9$(t) $R_6$: $CH_3$ |
| A-50 | $C_2H_5$ | 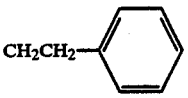  | $R_3$: $NHCOCH_3$ |
| A-51 | $C_{12}H_{25}$ | $C_{12}H_{25}$ | $R_3$: $C_4H_9$(t) $R_6$: $C_4H_9$(t) |
| A-52 | $C_8H_{17}$ | $C_8H_{17}$ | $R_3$: $C_8H_{17}$(t) $R_6$: $C_8H_{17}$(t) |
| A-53 | $C_2H_5$ | $C_2H_5$ | $R_3$: $C_6H_{13}$(t) $R_6$: $C_6H_{13}$(t) |
| A-54 | $CH_3$ | $CH_3$ | $R_3$: $C_4H_9$(t) $R_6$: $C_4H_9$(t) |
| A-55 | $C_4H_9$ | $C_4H_9$ | $R_3$: $C_4H_9$(t) $R_6$: $C_4H_9$(t) |
| A-56 | 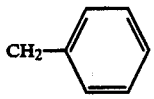  | 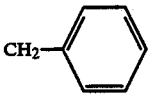  | $R_3$: $C_4H_9$(t) $R_6$: $C_4H_9$(t) |
| A-57 | $C_{18}H_{37}$ | $C_{18}H_{37}$ | $R_3$: $C_4H_9$(t) $R_6$: $C_4H_9$(t) |
| A-58 | $C_{16}H_{33}$ | $C_{16}H_{33}$ | $R_3$: $C_4H_9$(t) $R_6$: $C_4H_9$(t) |
| A-59 | 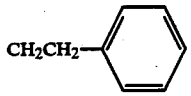  | 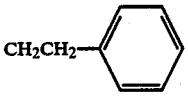  | $R_3$: $C_4H_9$(t) $R_6$: $C_4H_9$(t) |

-continued

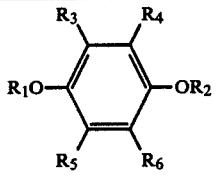

| Compound | $R_1$ | $R_2$ | $R_3 \sim R_6$ |
|---|---|---|---|
| A-60 | $C_4H_9$ | $C_4H_9$ | $R_3$: $C_5H_{11}(t)$ $R_6$: $C_5H_{11}(t)$ |
| A-61 | $C_2H_5$ | $C_2H_5$ | $R_3$: $C_5H_{11}(t)$ $R_6$: $C_5H_{11}(t)$ |
| A-62 | $C_3H_7$ | $C_3H_7$ | $R_3$: $C_5H_{11}(t)$ $R_6$: $C_5H_{11}(t)$ |
| A-63 | $CH_3$ | $CH_3$ | $R_3$: $C_5H_{11}(t)$ $R_6$: $C_5H_{11}(t)$ |
| A-64 | 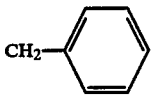 | 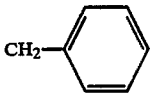 | $R_3$: $C_5H_{11}(t)$ $R_6$: $C_5H_{11}(t)$ |
| A-65 | $CH_3$ | $CH_3$ | $R_3$: $C_6H_{13}(t)$ $R_6$: $C_6H_{13}(t)$ |
| A-66 | $C_3H_7$ | $C_3H_7$ | $R_3$: $C_6H_{13}(t)$ $R_6$: $C_6H_{13}(t)$ |
| A-67 | $C_4H_9$ | $C_4H_9$ | $R_3$: $C_6H_{13}(t)$ $R_6$: $C_6H_{13}(t)$ |
| A-68 | 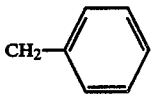 | 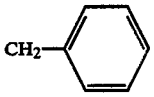 | $R_3$: $C_6H_{13}(t)$ $R_6$: $C_6H_{13}(t)$ |
| A-69 | $CH_3$ | $CH_3$ | $R_3$: $C_8H_{17}(t)$ $R_6$: $C_8H_{17}(t)$ |
| A-70 | $C_2H_5$ | $C_2H_5$ | $R_3$: $C_8H_{17}(t)$ $R_6$: $C_8H_{17}(t)$ |
| A-71 | $C_3H_7$ | $C_3H_7$ | $R_3$: $C_8H_{17}(t)$ $R_6$: $C_8H_{17}(t)$ |
| A-72 | $C_4H_9$ | $C_4H_9$ | $R_3$: $C_8H_{17}(t)$ $R_6$: $C_8H_{17}(t)$ |
| A-73 | 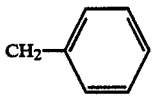 | 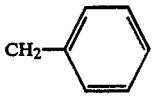 | $R_3$: $C_8H_{17}(t)$ $R_6$: $C_8H_{17}(t)$ |
| A-74 | $CH_3$ | $CH_3$ | $R_3$: $C_{12}H_{25}(t)$ $R_6$: $C_{12}H_{25}(t)$ |
| A-75 | $C_2H_5$ | $C_2H_5$ | $R_3$: $C_{12}H_{25}(t)$ $R_6$: $C_{12}H_{25}(t)$ |
| A-76 | $C_3H_7$ | $C_3H_7$ | $R_3$: $C_{12}H_{25}(t)$ $R_6$: $C_{12}H_{25}(t)$ |
| A-77 | $C_4H_9$ | $C_4H_9$ | $R_3$: $C_{12}H_{25}(t)$ $R_6$: $C_{12}H_{25}(t)$ |
| A-78 | 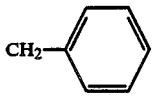 | 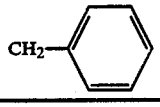 | $R_3$: $C_{12}H_{25}(t)$ $R_6$: $C_{12}H_{25}(t)$ |

These compounds are readily synthesized using the methods described, for example, in Journal of the Chemical Society, pp. 2904–2914 (1965), and the Journal of Organic Chemistry vol. 23, pp. 75–76.

Compound [B] used in embodying the invention is a compound obtained by substituting one or both of the phenolic hydroxide groups on 6'6'-hydroxy-2,2'-spirobichroman.

In the compound used in embodying the invention represented by the previously mentioned general formula [II], the components are as follows. The examples of the alkyl group represented by $R_1$ include methyl, ethyl, propyl, i-propyl, butyl, t-butyl, i-pentyl, sec-pentyl, octyl, t-octyl, dodecyl, octadecyl, and eicosyl groups; the examples of the alkenyl group include allyl, octenyl, and oleyl groups; the examples of the aryl group include phenyl, and naphthyl groups; the examples of the alkoxy group include methoxy, ethoxy, butoxy, and dodecyloxy groups; the examples of the alkenoxy group include aryloxy, hexynyloxy groups; the examples of the aryloxy group include a phenyloxy group.

The examples of the halogen atom represented by either $R_2$ or $R_3$ include fluorine, chlorine, and bromine atoms; the examples of each of the alkyl, alkenyl, and alkoxy groups are identical with those listed for $R_1$.

The examples of the cycloalkyl group represented by R include cyclopentyl, cyclohexyl, and cyclooctyl groups; the examples of the heterocyclic group include imidazolyl, furil, thiazolyl, and pyridyl groups; the examples of the alkyl and alkenyl groups are identical with those previously listed for $R_1$.

Additionally, the examples of the alkyl and alkenyl groups represented by R' are also identical with those previously listed for $R_1$.

The examples of each of the alkyl and alkenyl groups represented by $R_4$, $R_5$ and $R_6$ are identical with those previously listed for $R_1$; the examples of the cycloalkyl and heterocyclic groups are identical with those previously listed for R.

These alkyl, alkenyl, aryl, alkoxy, alkenoxy, aryloxy, cycloalkyl and heterocyclic groups may have a substituent group such as a halogen atom, or an alkyl, aryl, alkoxy, aryloxy, cyano, acyloxy, alkoxycarbonyl, acyl, sulfamoyl, hydroxyl, nitro, or amino group.

Those represented by general formula [II] include the compounds represented by the following general formula [II'].

General formula [II']

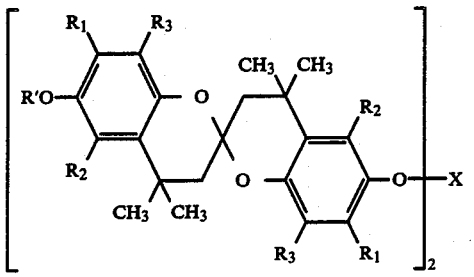

With general formula [II'], R', $R_1$, $R_2$, and $R_3$, are synonymous with those in the previously specified general formula [II]. X represents an substituted or unsubstituted alkylene group; or an alkylene group bonded with carbon chain on an alkenyl group via a bonding group such as —0—, —S—, —NA— (A: a halogen atom, low alkyl, or phenyl group or the like), —$SO_2$—, or phenylene group; or —CO—X'—CO—, —$SO_2$—X', or —CONX—X'—NHCO—(X' represents an alkylene group; or an alkylene or phenyl group bonded with a carbon chain on an alkenyl group via a bonding group such as —O—, —S—, —NA— (A: a hydrogen atom, low alkyl, or phenyl group or the like), —$SO$—$_2$, or phenylene group).

The useful compounds represented by general formulas [II] and [II'] are as follows: $R_1$ represents a substituted or unsubstituted, alkyl, alkenyl or aryl group; $R_2$ and $R_3$ independently represent a hydrogen atom, or a substituted or unsubstituted alkyl group (the substituent group is any of the previously listed substituent groups).

The particularly useful compounds represented by general formulas [II] and [II'] are as follows: $R_1$ is an alkyl group, or a possibly alkyl-substituted phenyl group; $R_2$ and $R_3$ are independently a hydrogen atom; R is an alkyl alkenyl, cycloalkyl, $R_4CO$, $R_5SO_2$ or $R_6NHCO$ group, each possibly having, as a substituent group, a phenyl or alkoxycarbonyl group; $R_4$, $R_5$ and $R_6$ are independently an alkyl group, or a phenyl group possibly having, as a substituent group, an alkyl group; X is an alkylene group or —CO—X'—CO— (wherein X' is an alkylene group).

The typical examples of the compound of the invention are hereinunder listed. However, the scope of the compound useful in embodying the invention is not limited only to these examples.

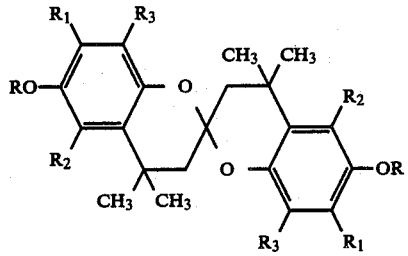

| Compound | R | R' | $R_1$ | $R_2$ | $R_3$ |
|---|---|---|---|---|---|
| B-1 | $CH_3$ | H | $CH_3$ | H | H |
| B-2 | $CH_2{=}CHCH_2$ | H | $CH_3$ | H | H |
| B-3 | (t)$C_5H_{11}$ | H | $CH_3$ | H | H |
| B-4 | 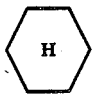 | H | $CH_3$ | H | H |
| B-5 | 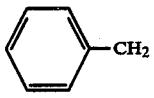 | H | $CH_3$ | H | H |
| B-6 | $C_4H_9$ | H | 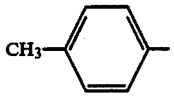 | H | H |
| B-7 | $CH_3CO$ | $CH_3CO$ | $CH_3$ | H | H |
| B-8 | 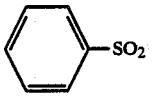 | H | $CH_3$ | H | H |

-continued
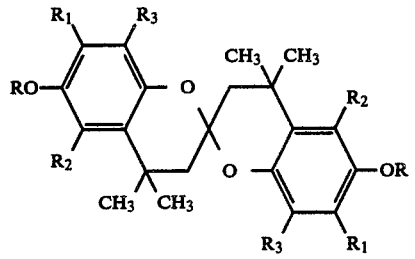
| Compound | R | R' | $R_1$ | $R_2$ | $R_3$ |
|---|---|---|---|---|---|
| B-9 | 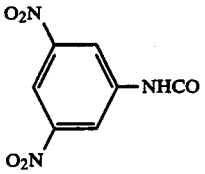 | H | $CH_3$ | H | H |
| B-10 | (t)$C_5H_{11}$ | $CH_3CO$ | $CH_3$ | H | H |
| B-11 | 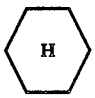 | $C_{11}H_{23}CO$ | $CH_3$ | H | H |
| B-12 | $C_8H_{17}$ | $C_5H_{11}CO$ | $CH_3$ | H | H |
| B-13 | 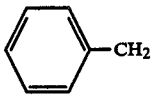 | 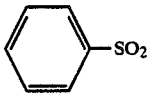 | $CH_3$ | H | H |
| B-14 | $CH_3CO$ | $CH_3CO$ | 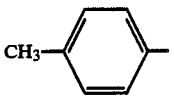 | H | H |
| B-15 | (i)$C_5H_{11}$ | (i)$C_5H_{11}$ | $CH_3$ | H | H |
| B-16 | $CH_2{=}CHCH_2$ | $CH_2{=}CHCH_2$ | (t)$C_4H_9$ | H | H |
| B-17 | $CH_3$ | $C_8H_{17}$ | $CH_3$ | H | H |
| B-18 | $C_4H_9$ | $C_4H_9$ | 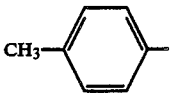 | H | H |
| B-19 | 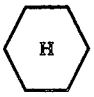 | $CH_3OCOCH_2$ | $CH_3$ | H | H |
| B-20 | 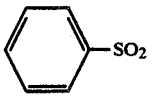 | 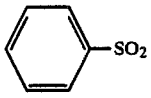 | $CH_3$ | H | H |
| B-21 | 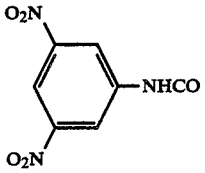 | 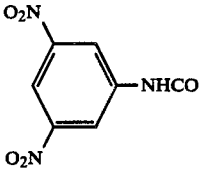 | $CH_3$ | H | H |
| B-22* | $CH_3CO$ | $-(CH_2)_3-$ | $CH_3$ | H | H |

-continued

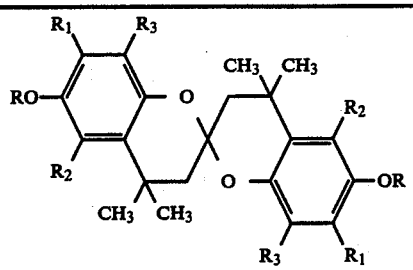

| Compound | R | R' | $R_1$ | $R_2$ | $R_3$ |
|---|---|---|---|---|---|
| B-23* | $C_7H_{15}CO$ | —$COCH_2CO$— | $CH_3$ | H | H |

*indicates a compound represented by general formula [II'].

These compounds are readily synthesized by subjecting 6,6'-dihydroxy-4,4,4',4'-tetramethyl-2,2'-spirochroman compounds, which are available by a method described in Japanese Patent Examined Publication No. 20977/1974, to alkylation or acylation. The similar method is also described in Japanese Patent O.P.I. Publication No. 20327/1978.

In the previously described general formula [III] which represents compound [C] useful in embodying the invention, the examples of the alkyl group represented by R include a methyl, ethyl, propyl, t-octyl, benzyl, and hexadecyl groups; the examples of the similarly represented alkenyl group include an aryl, octenyl, and oleyl groups; and the examples of the similarly represented aryl group include tetrahydropyranyl and pyrimidyl groups.

When R is $R_4CO$—, $R_5SO_2$ or $R_6NHCO$—group, those alkyl, alkenyl aryl and heterocyclic groups represented by $R_4$, $R_5$ and $R_6$ are identical with those previously specified as the examples of R.

The examples of the halogen atom represented by $R_1$ or $R_2$ include a fluorine, chlorine, or bromine atom; the examples of the alkoxy groups include methoxy, ethoxy, butoxy, and benzyloxy groups,; the examples of the alkenoxy group include 2-propenyloxy, and hexenyloxy groups; the examples of the alkyl and alkenyl groups represented by $R_1$ or $R_2$ are identical with the previously specified groups which R represents.

The examples of the alkyl, alkenyl and aryl groups represented by $R_3$ are identical with the previously specified groups which represents. These alkyl, alkenyl, alkoxy, alkenoxy, aryl, and heterocyclic groups may further possess a substituent group.

The typical examples of compound [C] of the invention are hereinunder listed. However, the scope of the compound useful in embodying the invention is not limited only to these examples.

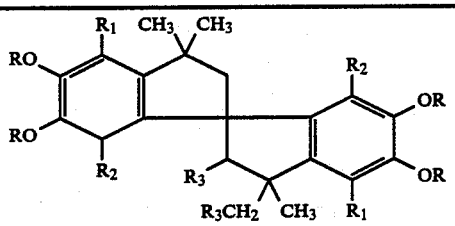

| Compound | R | $R_1$ | $R_2$ | $R_3$ |
|---|---|---|---|---|
| C-1 | $CH_3$ | H | H | H |
| C-2 | $CH_3CO$ | H | H | H |
| C-3 | $C_4H_9$ | H | $CH_3$ | H |

-continued

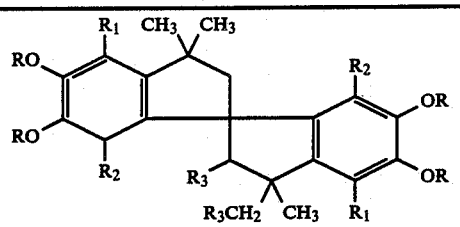

| Compound | R | $R_1$ | $R_2$ | $R_3$ |
|---|---|---|---|---|
| C-4 | 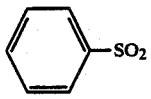 | H | H | H |
| C-5 | $C_2H_5$ | H | H | H |
| C-6 | $CH_3$ | H | H | $CH_3$ |
| C-7 | $C_7H_{15}CO$ | H | H | H |
| C-8 | $C_{12}H_{25}$ | H | H | H |
| C-9 | $C_4H_9$ | H | H | H |
| C-10 | $CH_3OCH_2CH_2$ | H | H | H |
| C-11 | $C_5H_{11}$ | H | H | H |
| C-12 | $CH_2{=}CHCH_2$ | H | H | H |
| C-13 | $C_6H_{13}$ | H | H | H |
| C-14 | $C_3H_7$ | H | H | 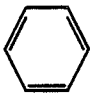 |
| C-15 | $C_8H_{17}$ | H | H | H |
| C-16 | $C_4H_9$ | H | $CH_3O$ | H |
| C-17 | sec-$C_5H_{11}$ | H | H | H |
| C-18 | $C_4H_9$ | H | H | $CH_3$ |
| C-19 | $C_2H_5CO$ | H | H | H |
| C-20 | $C_4H_9$ | H | H | $(CH_3)_2$ |
| C-21 | $C_3H_7$ | H | H | H |
| C-22 | $C_{18}H_{37}$ | H | H | H |
| C-23 | 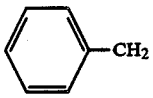 | H | H | H |
| C-24 | $C_{10}H_{21}$ | H | H | H |

These compounds are readily synthesized by subjecting 5,6,5,6-tetrahydroxy-1,1-spirobiindane compounds, which are prepared by a method described in Journal of the Chemical Society, 1934, pp. 1678, to alkylation or esterification by a conventional method.

According to the invention, compound [D] mentioned above which is added to a photosensitive layer in order to control ozone-induced deterioration of the layer has the so-called "hindered amine" structure. With structural formulas (a) and (c), an organic substituent group R represents may be either an aliphatic or aromatic group, and, is typically an alkyl, aryl, aralkyl, or carbamoyl group.

The typical examples of the hindered amine compound advantageously used in the invention (hereinafter referred to as the compound of the invention) are as follows. However, the scope of the invention is not necessarily limited to these examples.

(D-1)

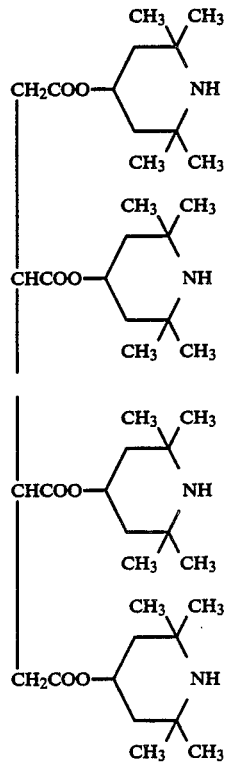

(D-2)

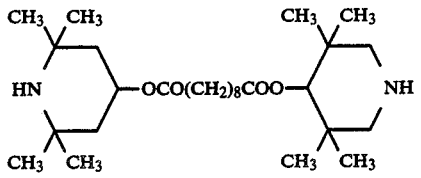

(D-3)

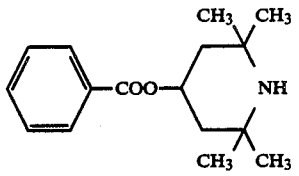

(D-4)

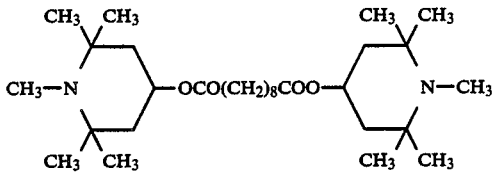

(D-5)

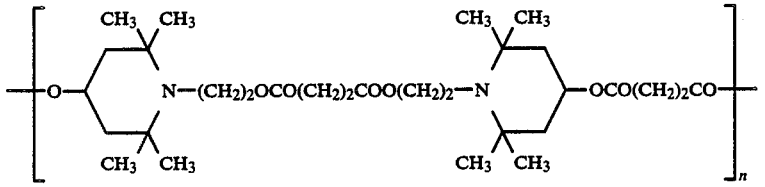

-continued
(D-6)
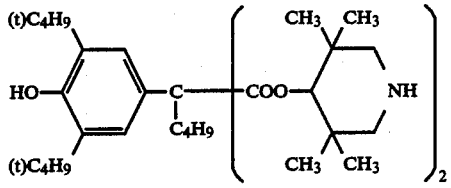
(D-7)
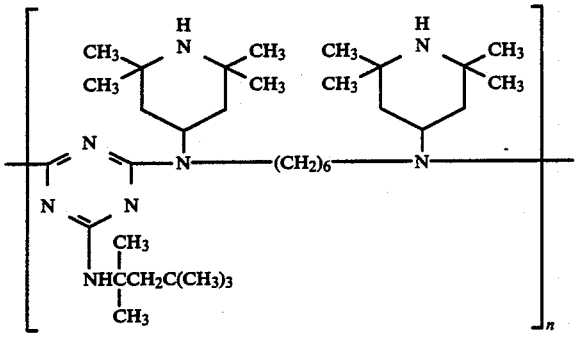
(D-8)
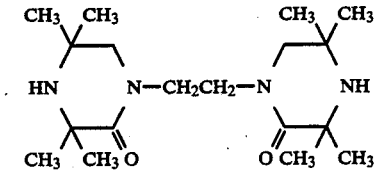
(D-9)
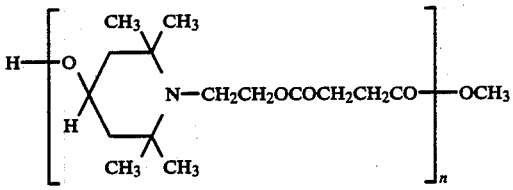
(D-10)
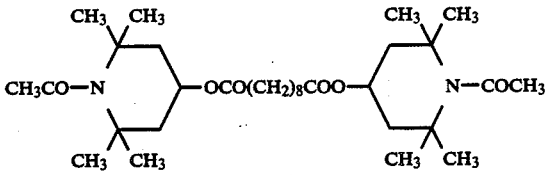
(D-11)
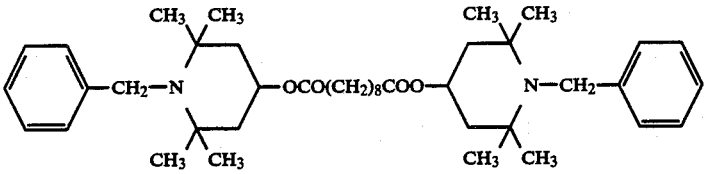
(D-12)
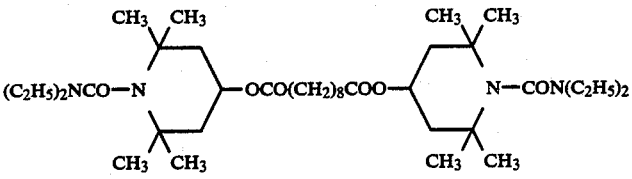

-continued
(D-13)
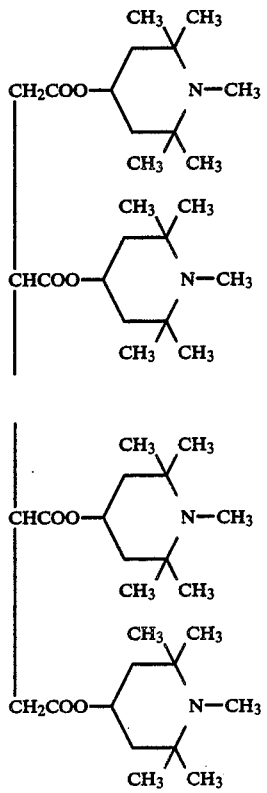
(D-14)
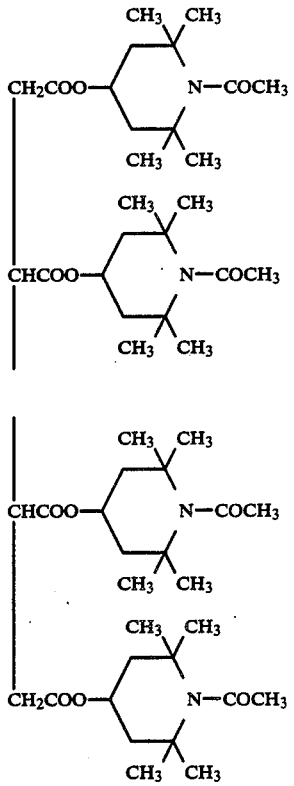

-continued
(D-15)
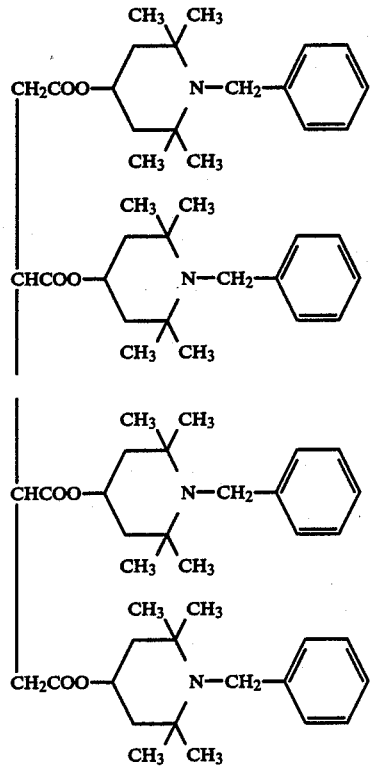
(D-16)
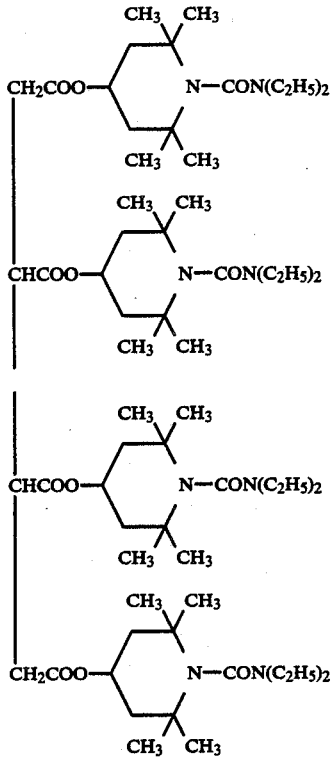
(D-17)
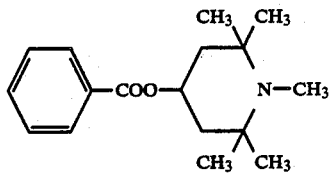

-continued

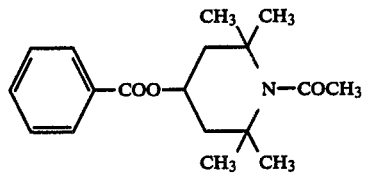

(D-18)

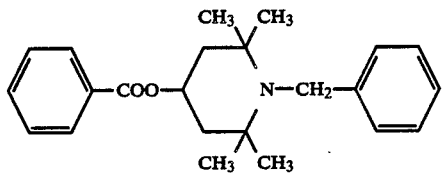

(D-19)

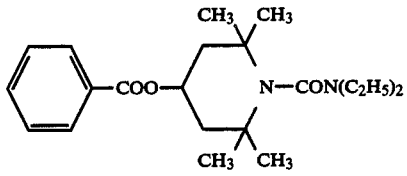

(D-20)

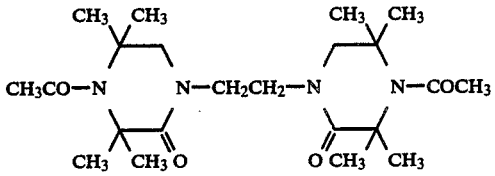

(D-21)

These compounds are known as light-stabilizing agents, and commercially available in the form of Tinuvin 144, 622, 622LD, 765, 770, (Ciba Geigy), Mark LA-57 (Argus Chem.), Timasorb 944LD (Timosa), and the like. These compounds may be synthesized by referring to a method described in Japanese Patent O.P.I. Publication No. 133543/1984.

The amount being added of a compound selected, for use in embodying the invention, from the groups comprising those represented by the previously mentioned formulas [A] through [D] (hereinafter referred to as the compound of the invention) varies depending on the layer constitution of the photosensitive member, the type of charge transporting material. However, as far as the compound selected from the groups [A] through [C], the amount being added is 0.1 to 100 wt %, or, preferably, 1 to 50 wt %, in particular, 5 to 25 wt % per amount of a charge transporting material. The similar amount of compound [D] is 0.01 to 100 wt %, or, particularly, 0.1 to 10 wt % per amount of a charge transporting layer.

The constitution of the photosensitive member of the invention is hereinunder described by referring to the drawings.

Figure 2:
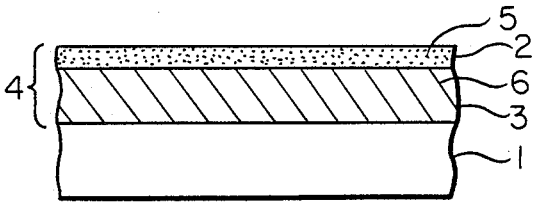
Figure 3:
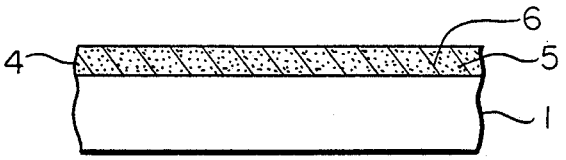

The photosensitive member of the invention in FIG. 1 is constituted, for example, as follows: on a substrate 1 (an electrically conductive substrate, or a sheet provided with an electrically conductive layer) is provided a laminated photosensitive layer 4 comprising not only a lower layer i.e. a charge generating layer 2 (may be hereinafter called CGL) which contains a charge generating material 5 (may be hereinafter called CGM) and, when necessary, a binder resin, but an upper layer i.e. a charge transporting layer 3 (may be hereinafter called CTL) which contains a charge transporting material 6 (may be hereinafter called CTM) and, when necessary, a binder resin. The photosensitive member of the invention in FIG. 2 comprises a substrate 1, provided thereon, a laminated photosensitive layer 4 comprising a lower layer i.e. CTL 2 and an upper layer i.e. CGL 2. The photosensitive member of the invention in FIG. 3 comprises a substrate 1, provided thereon, a single photosensitive layer 4 containing both CGM and CTM, and, according to a specific requirement, a binder resin.

Another example is as follows. A layer constituted like that of FIG. 2 may, in CGL i.e. the upper layer may contain both CGM and CTM, wherein on the photosensitive layer may be disposed a protective layer (OCL), and, an intermediate layer may be disposed between the substrate and the photosensitive layer.

Figure 4:
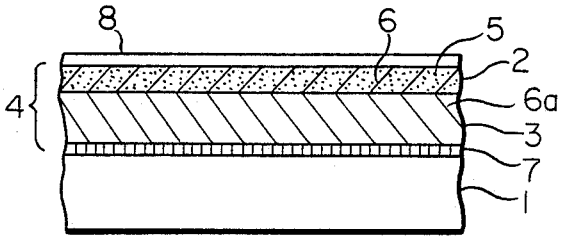

FIG. 4 illustrates one example incorporating the constitution mentioned above, wherein the photosensitive member comprises a substrate 1, provided thereon, an intermediate layer 7, and, a lamination-type photosensitive layer 4 comprising CTL 3 containing CTM 6*a* and a binder resin, and CGL 2 containing CGM 5, ATM 6*b* and a binder resin, whereby as an outer layer a protective layer 8 principally composed of a binder.

The compound of the invention may be incorporated into any of CGL and CTL which constitute a photosensitive member; or a single-layer type photosensitive layer or OCL. The compound may be incorporated into a plurality of layers. The effect of the invention is best achieved by a lamination-type photosensitive member having CGL as the upper layer and CTL as the lower layer.

A charge generating material useful in the invention is any of inorganic pigments and organic dyes as far as it is capable of generating free charge when absorbing visible light. The examples of such an inorganic pigment include amorphous selenium, trigonal selenium, selenium-arsenic alloy, selenium-tellurium alloy, cadmium sulfide, cadmium selenide, cadmium sulfur selenide, mercury sulfide, lead oxide, and lead sulfide. The examples of useful organic pigment are as follows:

(1) Azo pigments such as a monoazo pigment, polyazo pigment, metal-complex azo pigment, pyrazolone azo pigment, stilbene azo pigment, and thiazole azo pigment;
(2) Perylene pigments such as a perylene acid anhydride, and perylene acid imide;
(3) Anthraquinone pigments and polycyclic quinone pigments such as an anthraquinone derivative, anthoanthrone derivative, dibenzpyrenequinone derivative, pyranthrone derivative, violanthronen derivative, and isoviolanthron derivative;
(4) Indigoid pigments such as an indigo derivative, and thioindigo derivative;
(5) Phthalocyanine pigments such as a metal phthalocyanine pigment, and non-metal phthalocyanine pigment;
(6) Carbonium pigments such as a diphenylmethane pigment, triphenylmethane pigment, xanthene pigment, and acridine pigment;
(7) Quinonimine pigments such as an azine pigment, oxazine pigment, and thiazine pigment;
(8) Methine pigments such as a cyanine pigment, and azomethine pigment;
(9) Quinoline pigments;
(10) Nitrilo pigments;
(11) Nitroso pigments;
(12) Benzoquinone dyes, and naphthoquinone dyes;
(13) Napthalimide pigments; and
(14) Perinone pigments such as a benzimidazole derivative Various azo pigments having an electro-attracting group are used because of good electrophotographic properties in terms of sensitivity, memory development phenomenon, and residue electrical potential. However, the most advantageous are polyvalent quinone pigments because of good ozone-resistance.

Though the exact reasons are yet to be known, the probability is that an azo group is more susceptible to ozone-induced oxidation, resulting in deteriorated electrophotographic properties, and that in contrast a polycyclic quinone is stable to ozone.

The azo pigments useful in embodying the invention include the following groups [I] through [V] of example compound.

Example compound group [I]:

X'—N=N—A'—N=N—X'

| Compound | —A— | —X' |
|---|---|---|
| I-1 | 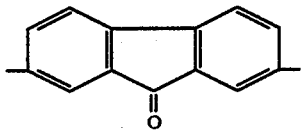 | 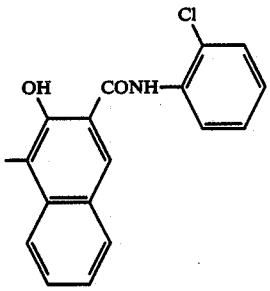 |
| I-2 | " | 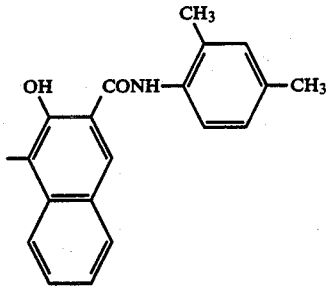 |
| I-3 | 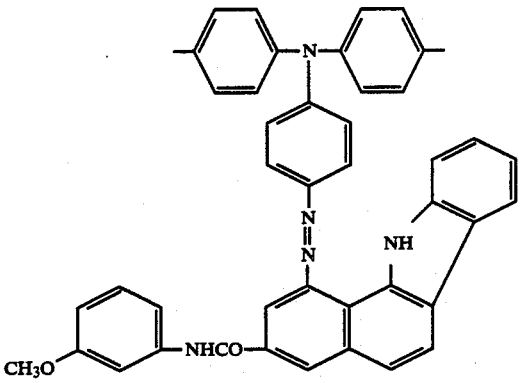 | 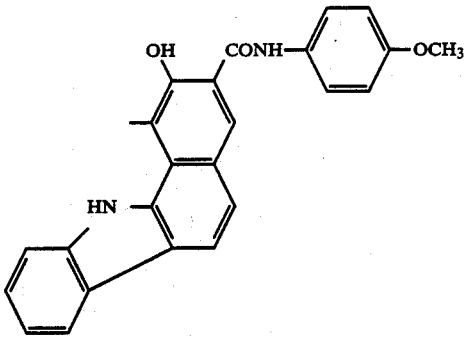 |

-continued
| Compound | X'—N=N—A'—N=N—X' —A— | —X' |
|---|---|---|
| I-4 | 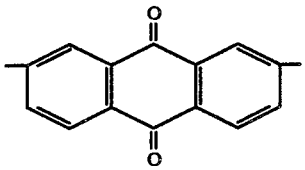 | 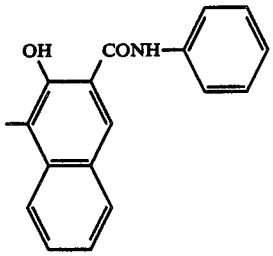 |
| I-5 | 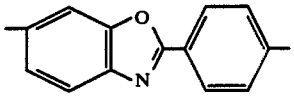 | 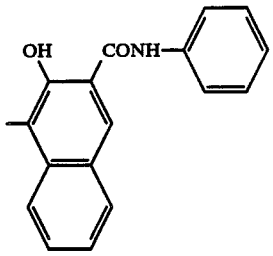 |
| I-6 | 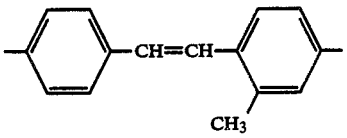 | " |
| I-7 | 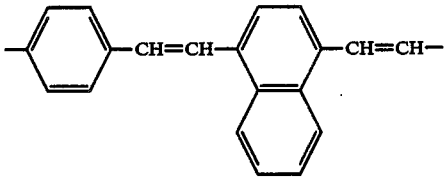 | " |
| I-8 | 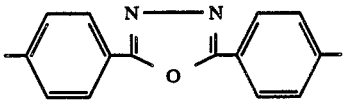 | 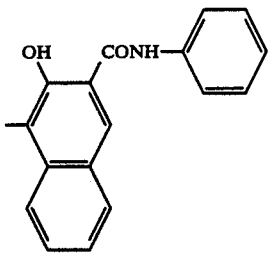 |
Example compound group [II]:
| Compound | X²—N=N—A²—N=N—A³—N=N—X³ —A²— | —A³— | —X², —X³ |
|---|---|---|---|
| II-1 | 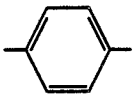 | 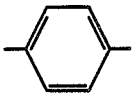 | 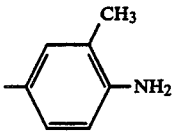 |

-continued
$X^2—N=N—A^2—N=N—A^3—N=N—X^3$
| Compound | $—A^2—$ | $—A^3—$ | $—X^2, —X^3$ |
|---|---|---|---|
| II-2 | " | " | 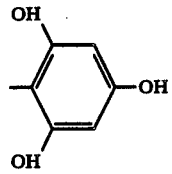 |
| II-3 | " | " | 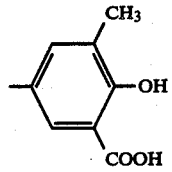 |
| II-4 | " | " | 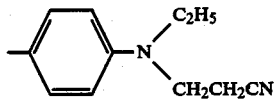 |
| II-5 | " | " | 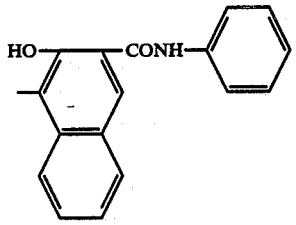 |
| II-6 | " | " | 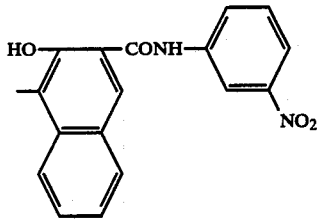 |
| II-7 | " | " | 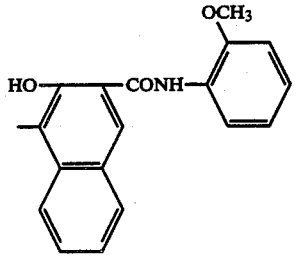 |
| II-8 | " | " | 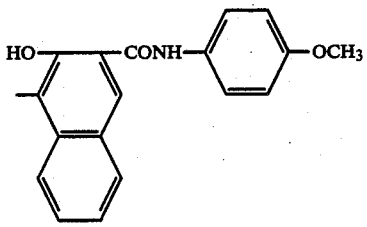 |

-continued
| Compound | $-A^2-$ | $X^2-N=N-A^2-N=N-A^3-N=N-X^3$ $-A^3-$ | $-X^2, -X^3$ |
|---|---|---|---|
| II-9 | " | " | 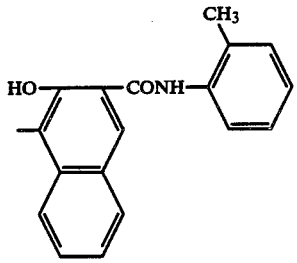 |
| II-10 | " | " | 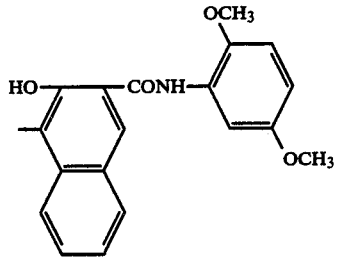 |
| II-11 | " | " | 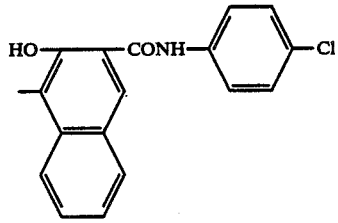 |
| II-12 | " | " | 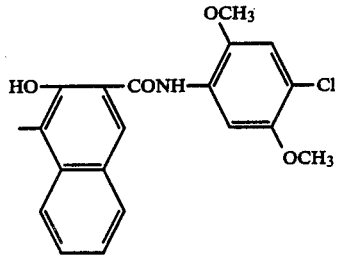 |
| II-13 | " | " | 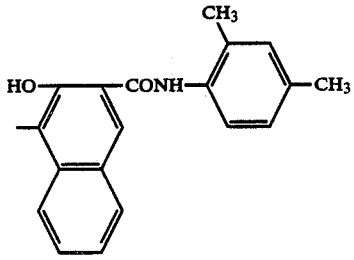 |
| II-14 | " | " | 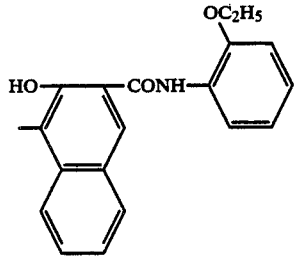 |

-continued
| Compound | $-A^2-$ | $-A^3-$ | $X^2-N=N-A^2-N=N-A^3-N=N-X^3$ <br> $-X^2, -X^3$ |
|---|---|---|---|
| II-15 | " | " | 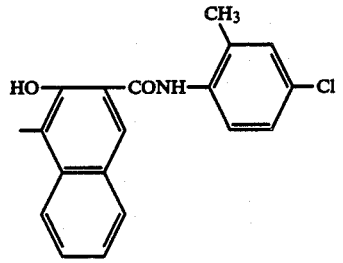 |
| II-16 | " | " | (−X²) 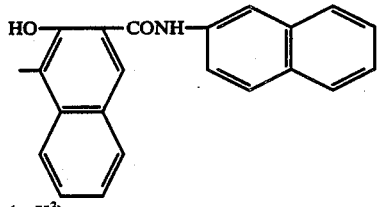 (−X³) 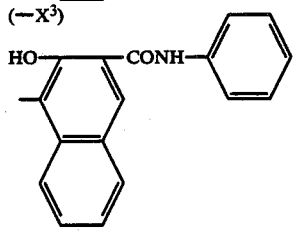 |
| II-17 | " | " | 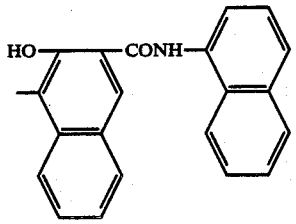 |
| II-18 | " | " | 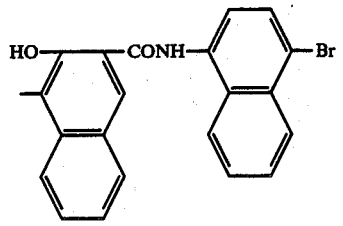 |
| II-19 | " | " | 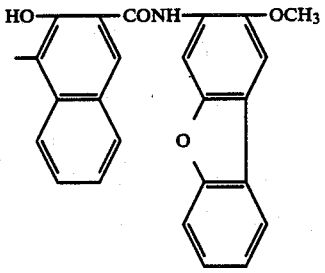 |

-continued
| Compound | $-A^2-$ | $X^2-N=N-A^2-N=N-A^3-N=N-X^3$ $-A^3-$ | $-X^2, -X^3$ |
|---|---|---|---|
| II-20 | " | " | 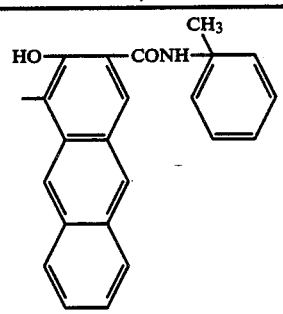 |
| II-21 | " | " | 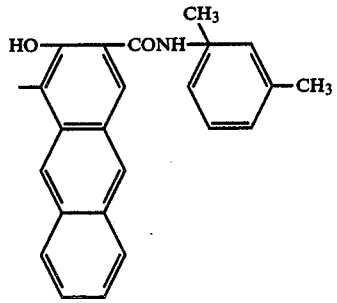 |
| II-22 | " | " | 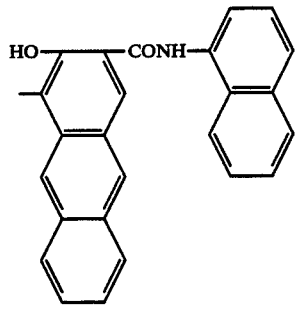 |
| II-23 | " | " | 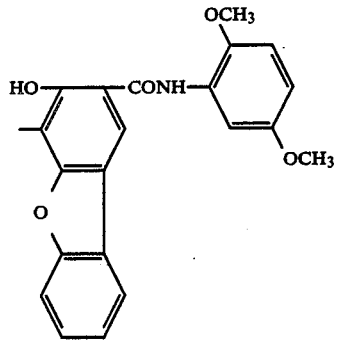 |
| II-24 | " | " | 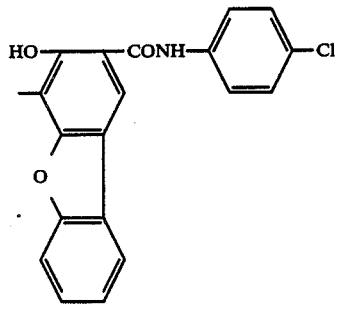 |

-continued
$X^2—N=N—A^2—N=N—A^3—N=N—X^3$
| Compound | $—A^2—$ | $—A^3—$ | $—X^2, —X^3$ |
|---|---|---|---|
| II-25 | " | " | 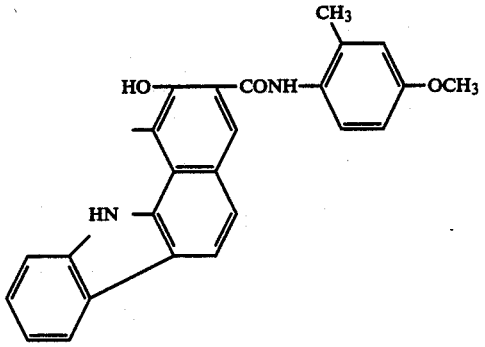 |
| II-26 | " | " | 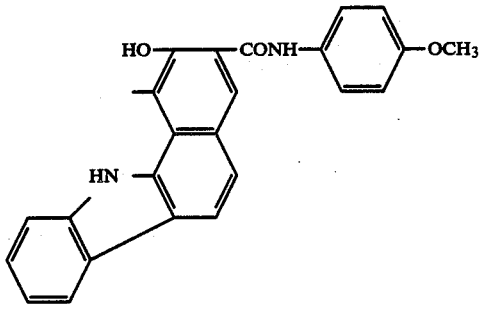 |
| II-27 | " | " | 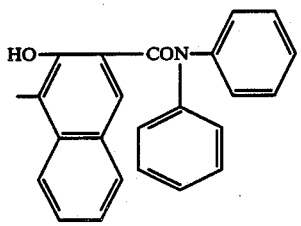 |
| II-28 | " | " | 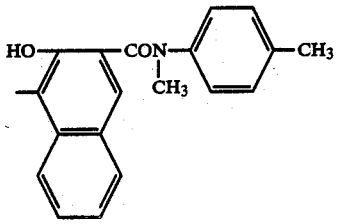 |
| II-29 | " | " | 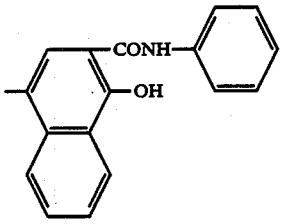 |

-continued
$X^2—N=N—A^2—N=N—A^3—N=N—X^3$
| Compound | $—A^2—$ | $—A^3—$ | $—X^2, —X^3$ |
|---|---|---|---|
| II-30 | " | " | 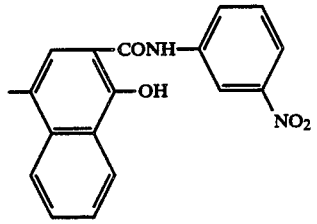 |
| II-31 | " | " | 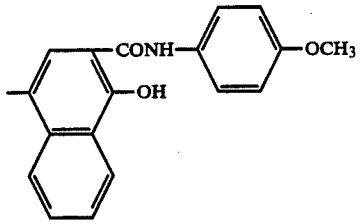 |
| II-32 | " | " | 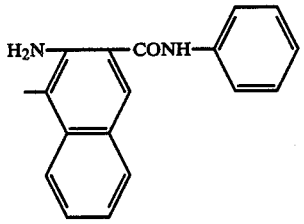 |
| II-33 | " | " | 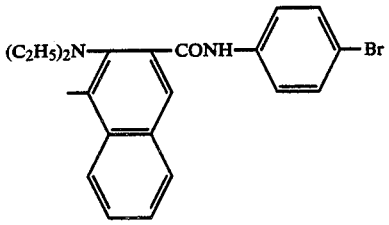 |
| II-34 | " | " | 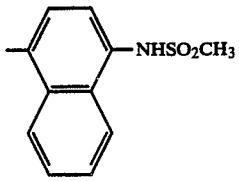 |
| II-35 | " | " | 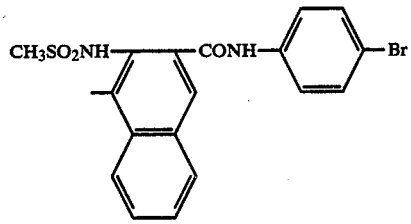 |

-continued
| Compound | $X^2-N=N-A^2-N=N-A^3-N=N-X^3$ | | |
|---|---|---|---|
| | $-A^2-$ | $-A^3-$ | $-X^2, -X^3$ |
| II-36 | " | " | 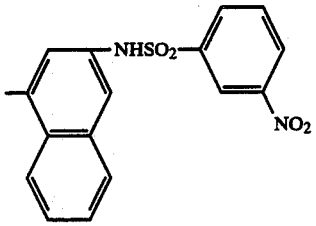 |
| II-37 | 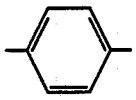 | 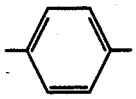 | 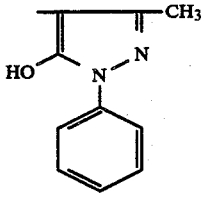 |
| II-38 | " | " | 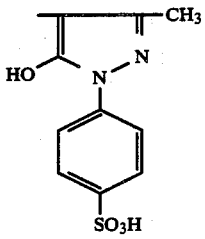 |
| II-39 | " | " | 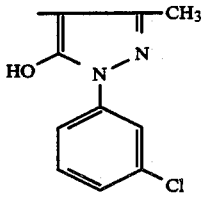 |
| II-40 | " | " | 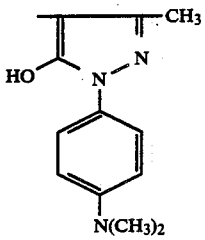 |
| II-41 | " | " | 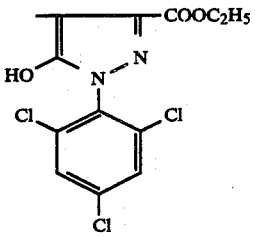 |

-continued
| Compound | $X^2-N=N-A^2-N=N-A^3-N=N-X^3$ | | |
|---|---|---|---|
| | $-A^2-$ | $-A^3-$ | $-X^2, -X^3$ |
| II-42 | 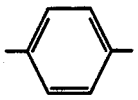 | 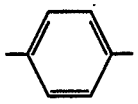 | 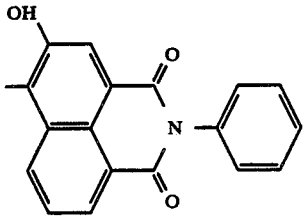 |
| II-43 | " | " | 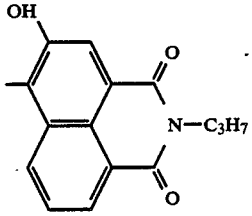 |
| II-44 | " | " | 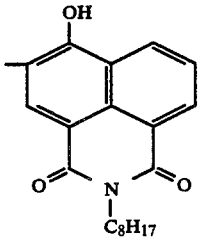 |
| II-45 | " | " | 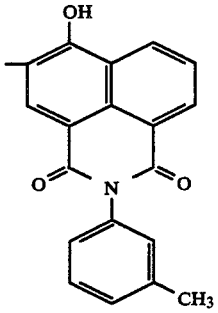 |
| II-46 | 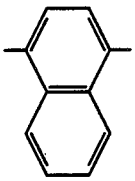 | 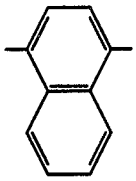 | 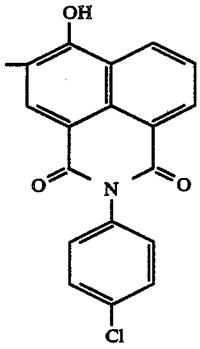 |
| II-47 | 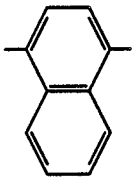 | 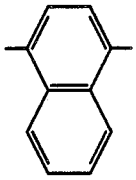 | 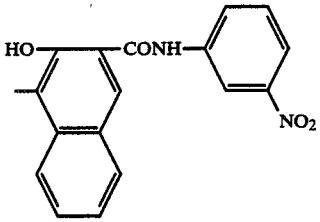 |

-continued
| Compound | $X^2$—N=N—$A^2$—N=N—$A^3$—N=N—$X^3$ | | |
|---|---|---|---|
| | —$A^2$— | —$A^3$— | —$X^2$, —$X^3$ |
| II-48 | " | 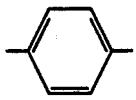 | " |
| II-49 | 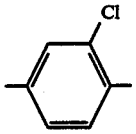 | 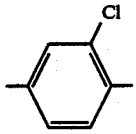 | 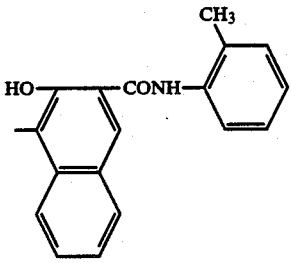 |
| II-50 | 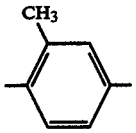 | 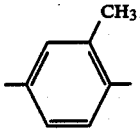 | 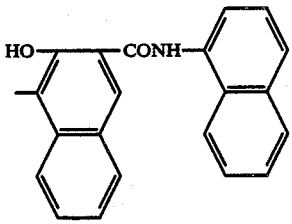 |
| II-51 | 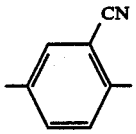 | 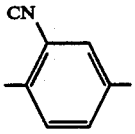 | " |
| II-52 | 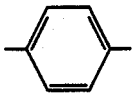 | 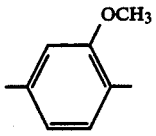 | 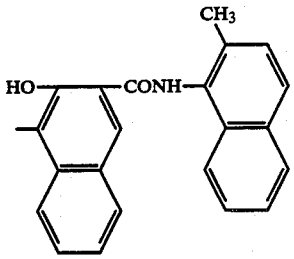 |
| II-53 | " | 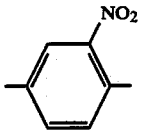 | 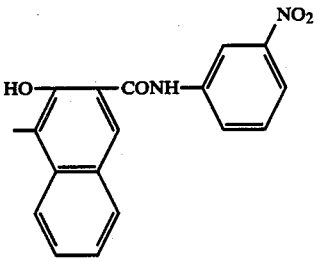 |
| II-54 | 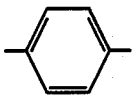 | 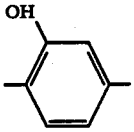 | 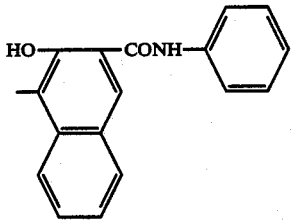 |

-continued
| Compound | $X^2$—N=N—$A^2$—N=N—$A^3$—N=N—$X^3$ | | |
|---|---|---|---|
| | —$A^2$— | —$A^3$— | —$X^2$, —$X^3$ |
| II-55 | 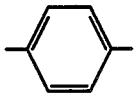 | 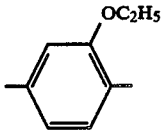 | 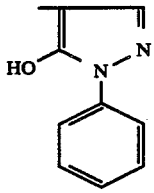 |
| II-56 | 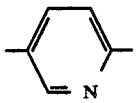 | 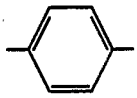 | 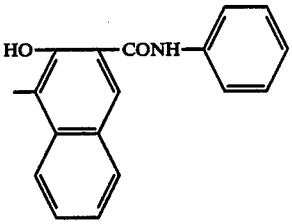 |
| II-57 | 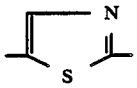 | 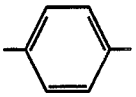 | 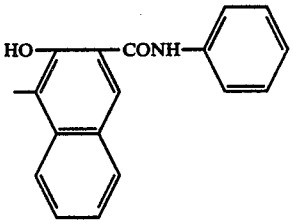 |
| II-58 | 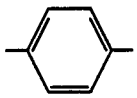 | 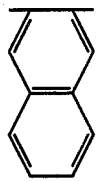 | 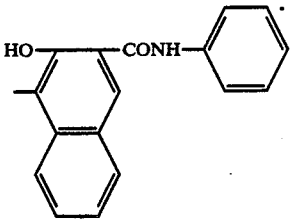 |
| II-59 | 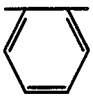 | 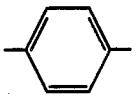 | 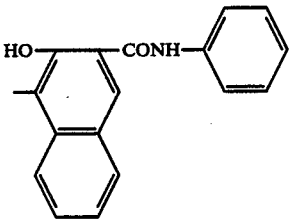 |
| II-60 | 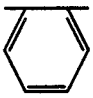 | 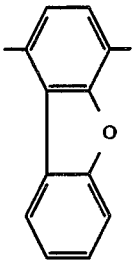 | 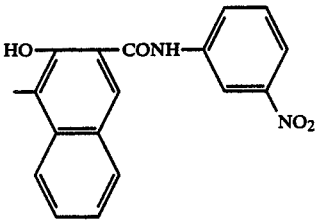 |

-continued
| Compound | $X^2—N=N—A^2—N=N—A^3—N=N—X^3$ | | | |
|---|---|---|---|---|
| | $—A^2—$ | $—A^3—$ | | $—X^2, —X^3$ |
| II-61 | 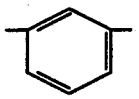 | 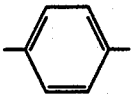 | | 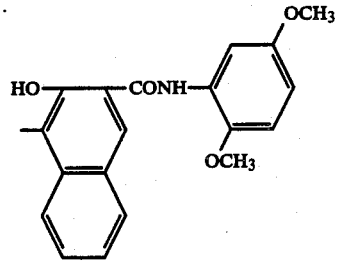 |
| II-62 | 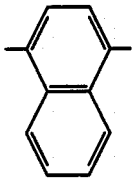 | 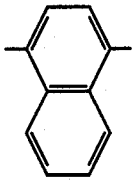 | | 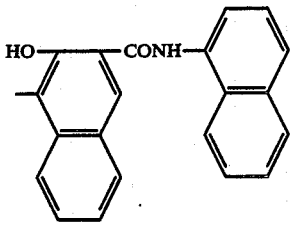 |
| II-63 | 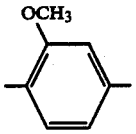 | 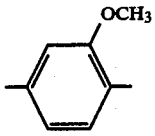 | | 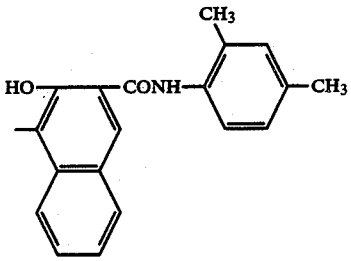 |
| II-64 | 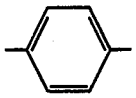 | 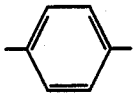 | | 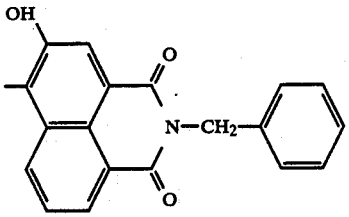 |
Example compound group [III]:
| Compound | $X^4—N=N—A^4—N=N—A^5—N=N—A^6—N=N—X^5$ | | | |
|---|---|---|---|---|
| | $—A^4—$ | $—A^5—$ | $—A^6—$ | $—X^4, —X^5$ |
| III-1 | 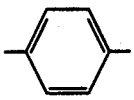 | 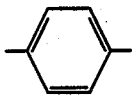 | 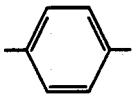 | 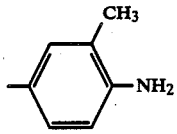 |
| III-2 | " | " | " | 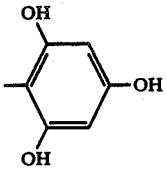 |

-continued
| | $X^4-N=N-A^4-N=N-A^5-N=N-A^6-N=N-X^5$ | | | |
|---|---|---|---|---|
| Compound | $-A^4-$ | $-A^5-$ | $-A^6-$ | $-X^4, -X^5$ |
| III-3 | " | " | " | 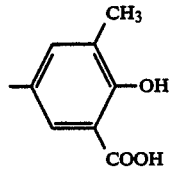 |
| III-4 | " | " | " | 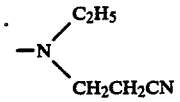 |
| III-5 | " | " | " | 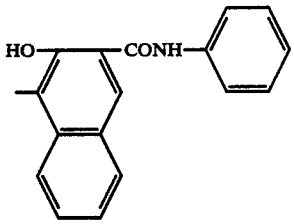 |
| III-6 | " | " | " | 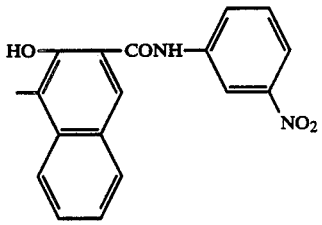 |
| III-7 | " | " | " | 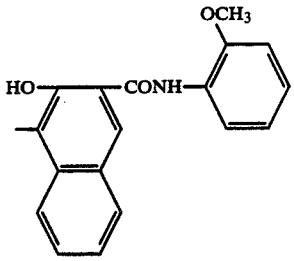 |
| III-8 | " | " | " | 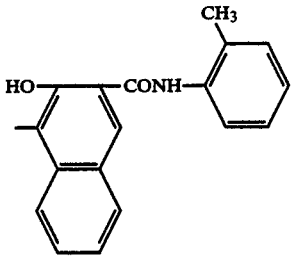 |
| III-9 | " | " | " | 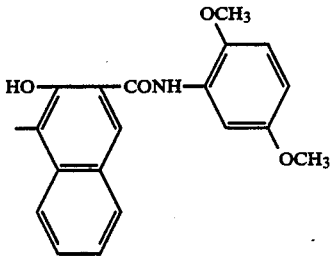 |

-continued
| $X^4—N=N—A^4—N=N—A^5—N=N—A^6—N=N—X^5$ | | | | |
|---|---|---|---|---|
| Compound | $—A^4—$ | $—A^5—$ | $—A^6—$ | $—X^4, —X^5$ |
| III-10 | " | " | " | 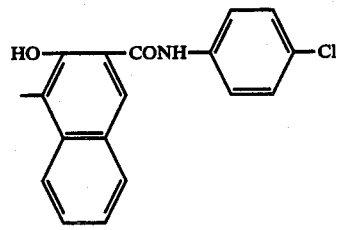 |
| III-11 | " | " | " | 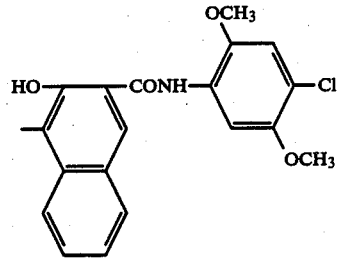 |
| III-12 | " | " | " | 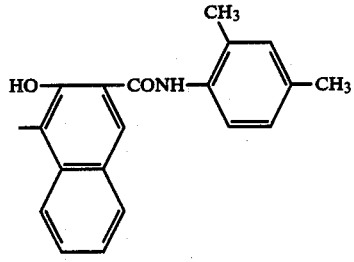 |
| III-13 | " | " | " | 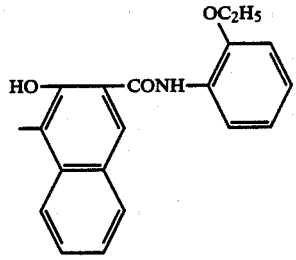 |
| III-14 | " | " | " | 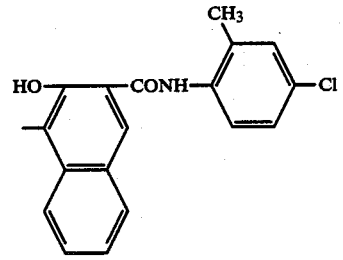 |
| III-15 | " | " | " | 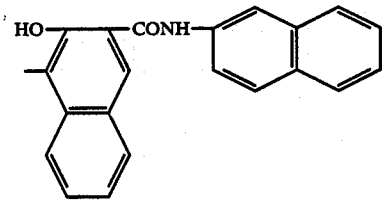 |

-continued
$X^4—N=N—A^4—N=N—A^5—N=N—A^6—N=N—X^5$
| Compound | $—A^4—$ | $—A^5—$ | $—A^6—$ | $—X^4, —X^5$ |
|---|---|---|---|---|
| III-16 | " | " | " | 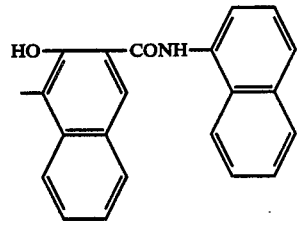 |
| III-17 | " | " | " | 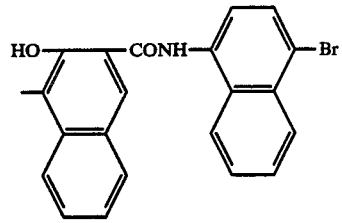 |
| III-18 | " | " | " | 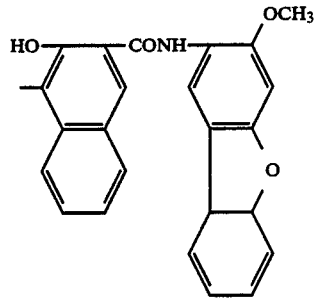 |
| III-19 | " | " | " | 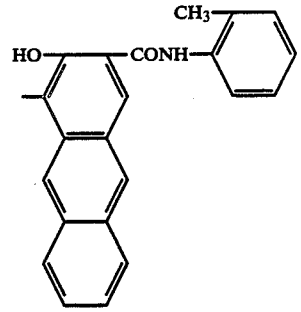 |
| III-20 | " | " | " | 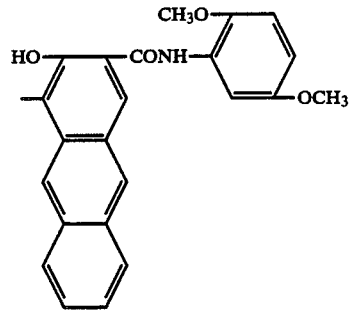 |

-continued
$X^4—N=N—A^4—N=N—A^5—N=N—A^6—N=N—X^5$
| Compound | $—A^4—$ | $—A^5—$ | $—A^6—$ | $—X^4, —X^5$ |
|---|---|---|---|---|
| III-21 | " | " | " | 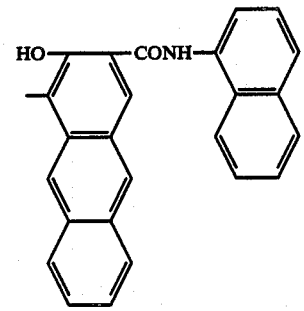 |
| III-22 | " | " | " | 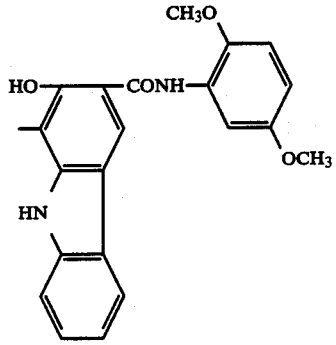 |
| III-23 | " | " | " | 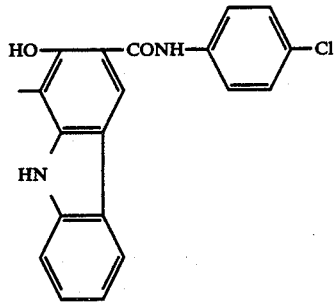 |
| III-24 | " | " | " | 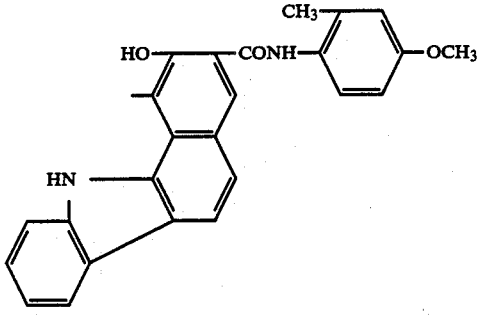 |

-continued
| | $X^4-N=N-A^4-N=N-A^5-N=N-A^6-N=N-X^5$ | | | |
|---|---|---|---|---|
| Compound | $-A^4-$ | $-A^5-$ | $-A^6-$ | $-X^4, -X^5$ |
| III-25 | " | " | " | 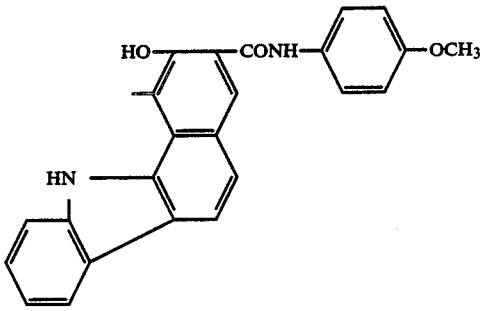 |
| III-26 | " | " | " | 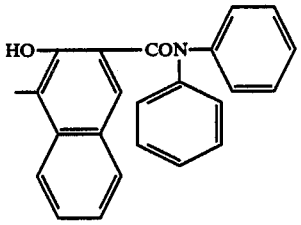 |
| III-27 | " | " | " | 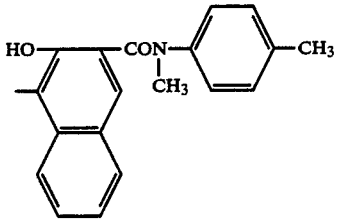 |
| III-28 | " | " | " | 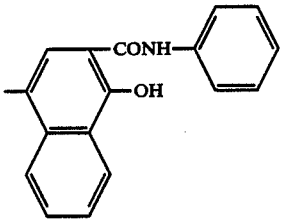 |
| III-29 | " | " | " | 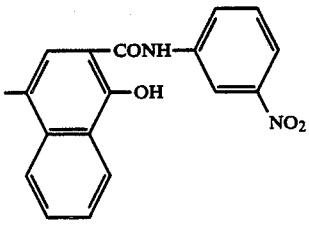 |
| III-30 | " | " | " | 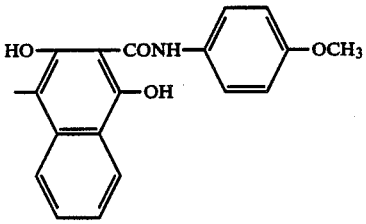 |

-continued
| | $X^4-N=N-A^4-N=N-A^5-N=N-A^6-N=N-X^5$ | | | |
|---|---|---|---|---|
| Compound | $-A^4-$ | $-A^5-$ | $-A^6-$ | $-X^4, -X^5$ |
| III-31 | " | " | " | 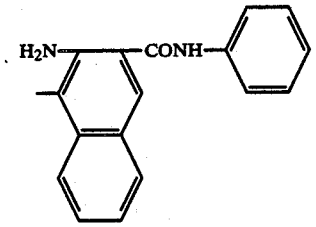 |
| III-32 | " | " | " | 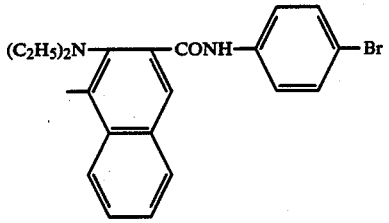 |
| III-33 | " | " | " | 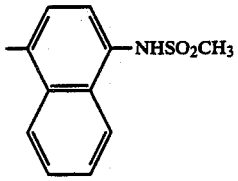 |
| III-34 | " | " | " | 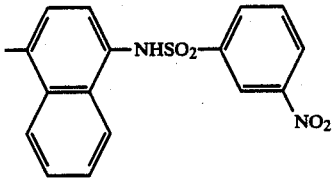 |
| III-35 | " | " | " | 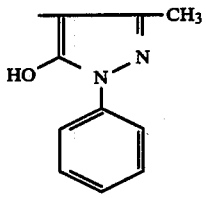 |
| III-36 | " | " | " | 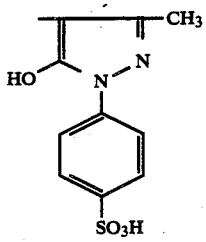 |
| III-37 | " | " | " | 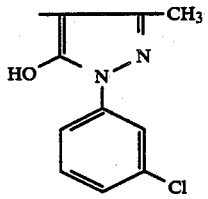 |

-continued
$X^4—N=N—A^4—N=N—A^5—N=N—A^6—N=N—X^5$
| Compound | $—A^4—$ | $—A^5—$ | $—A^6—$ | $—X^4, —X^5$ |
|---|---|---|---|---|
| III-38 | " | " | " | 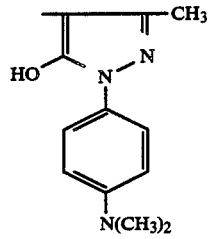 |
| III-39 | " | " | " | 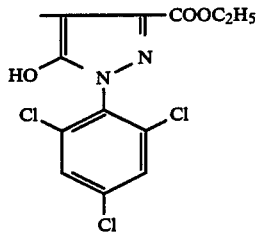 |
| III-40 | " | " | " | 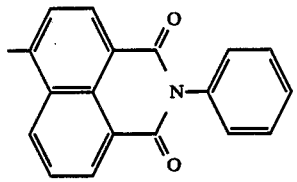 |
| III-41 | " | " | " | 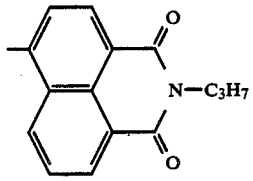 |
| III-42 | " | " | " | 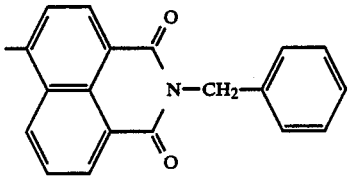 |
| III-43 | " | " | " | 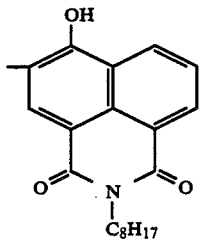 |

-continued
| $X^4-N=N-A^4-N=N-A^5-N=N-A^6-N=N-X^5$ | | | | |
|---|---|---|---|---|
| Compound | $-A^4-$ | $-A^5-$ | $-A^6-$ | $-X^4, -X^5$ |
| III-44 | " | " | " | 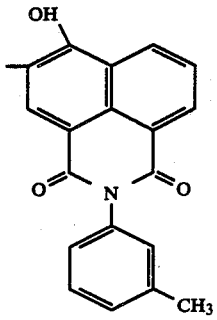 |
| III-45 | " | " | " | 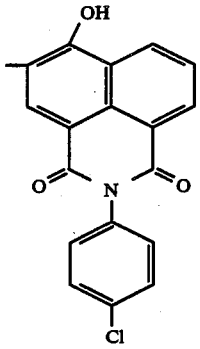 |
| III-46 | " | " | " | 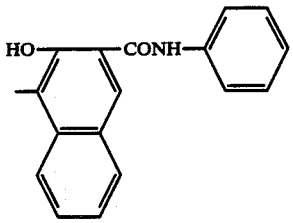 |
| III-47 | " | " | " | 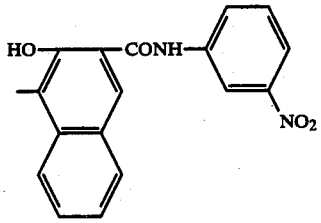 |
| III-48 | 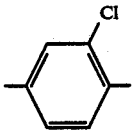 | " | 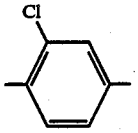 | 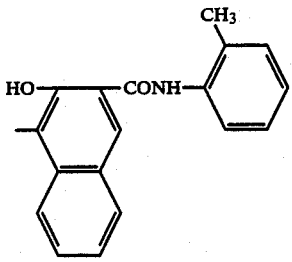 |

-continued
| | $X^4-N=N-A^4-N=N-A^5-N=N-A^6-N=N-X^5$ | | | |
|---|---|---|---|---|
| Compound | $-A^4-$ | $-A^5-$ | $-A^6-$ | $-X^4, -X^5$ |
| III-49 | 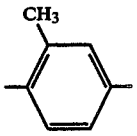 | " | 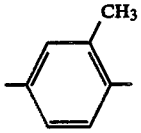 | 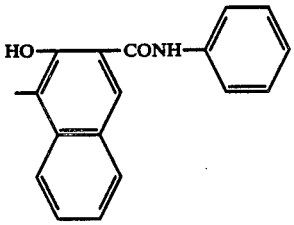 |
| III-50 | 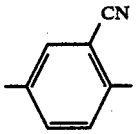 | " | 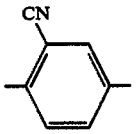 | 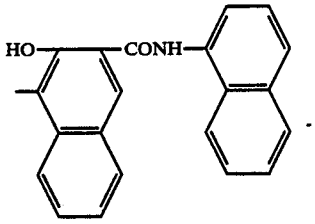 |
| III-51 | 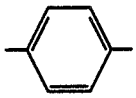 | " | 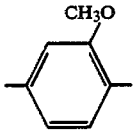 | 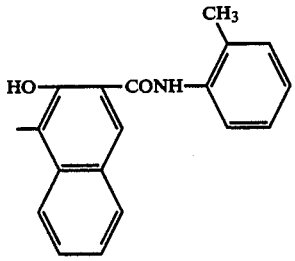 |
| III-52 | " | " | 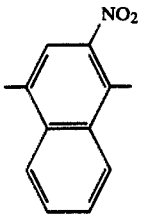 | 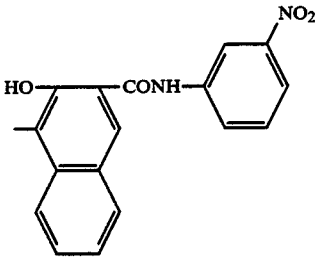 |
| III-53 | " | " | 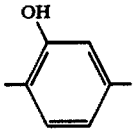 | 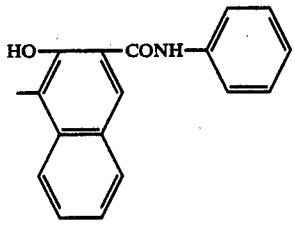 |
| III-54 | " | " | 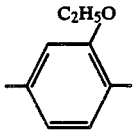 | 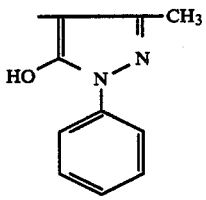 |

-continued
$X^4—N=N—A^4—N=N—A^5—N=N—A^6—N=N—X^5$
| Compound | $—A^4—$ | $—A^5—$ | $—A^6—$ | $—X^4$, $—X^5$ |
|---|---|---|---|---|
| III-55 | 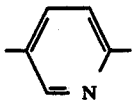 | " | 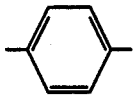 | 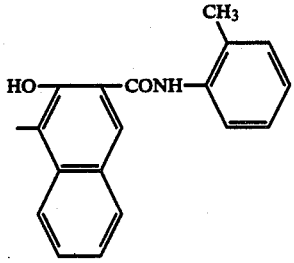 |
| III-56 | 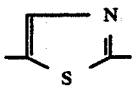 | " | " | 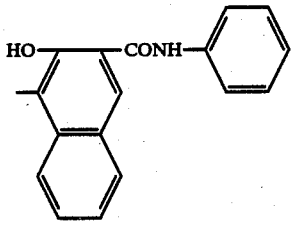 |
| III-57 | 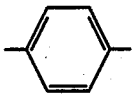 | " | 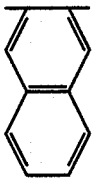 | 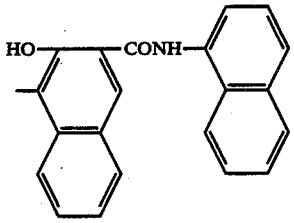 |
| III-58 | 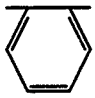 | " | 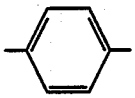 | 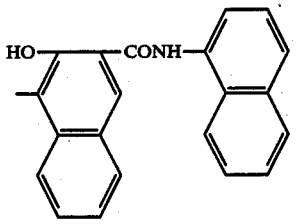 |
| III-59 | " | " | 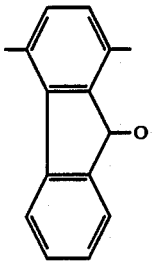 | 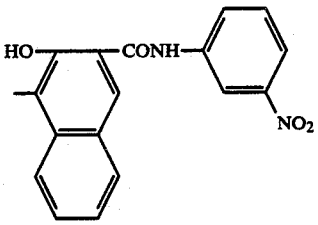 |
| | | | | $—X^4$ |
| III-60 | 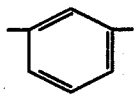 | " | 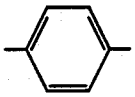 | 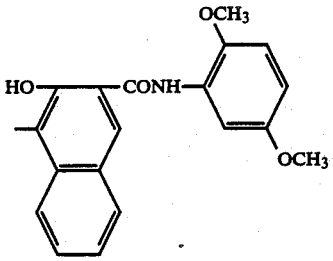 |
| | | | | $—X^5$ |

-continued
| | $X^4-N=N-A^4-N=N-A^5-N=N-A^6-N=N-X^5$ | | | |
|---|---|---|---|---|
| Compound | $-A^4-$ | $-A^5-$ | $-A^6-$ | $-X^4$, $-X^5$ |
| | | | | 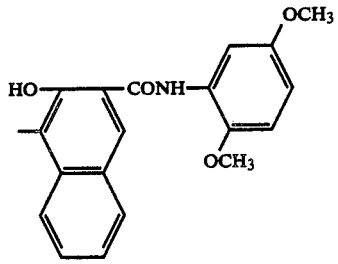 |
| III-61 | 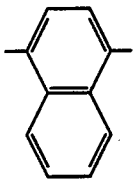 | " | 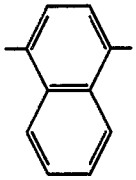 | 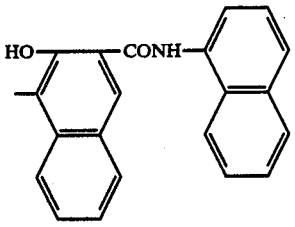 |
| III-62 | 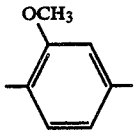 | " | 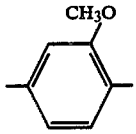 | 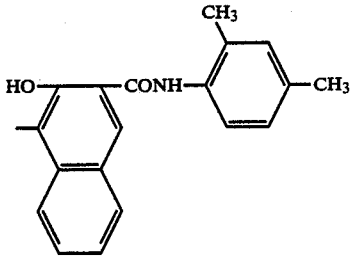 |
| III-63 | 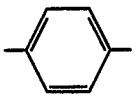 | " | 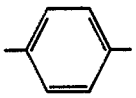 | 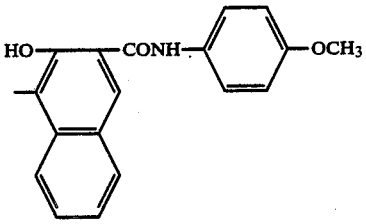 |
| III-64 | " | " | " | 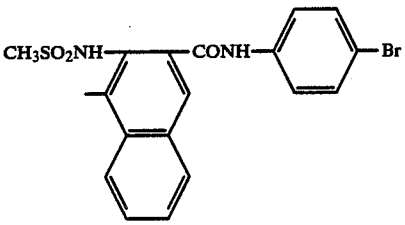 |
Example compound group [IV]:

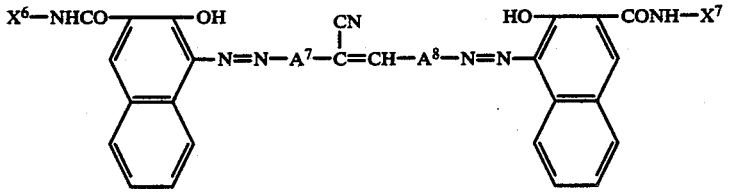
| Compound | —A7— | —A8— | —X6, —X7 |
|---|---|---|---|
| IV-1 | 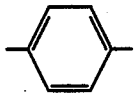 | 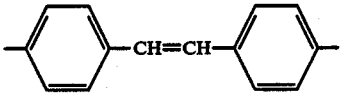 | 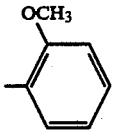 |
| IV-2 | " | " | 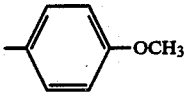 |
| IV-3 | " | " | 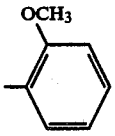 |
| IV-4 | " | " | —X6 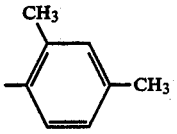 —X7 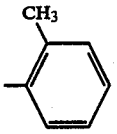 |
| IV-5 | " | 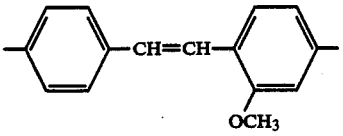 | 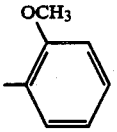 |
| IV-6 | 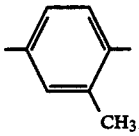 | 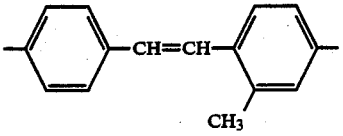 | 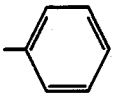 |
| IV-7 | 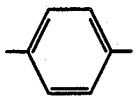 | 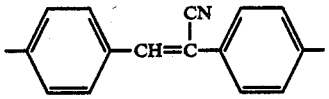 | 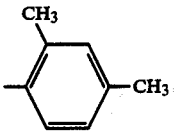 |
| IV-8 | 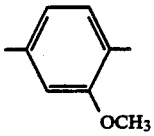 | 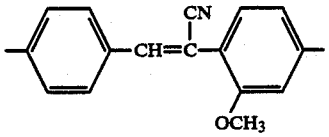 | 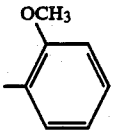 |

-continued
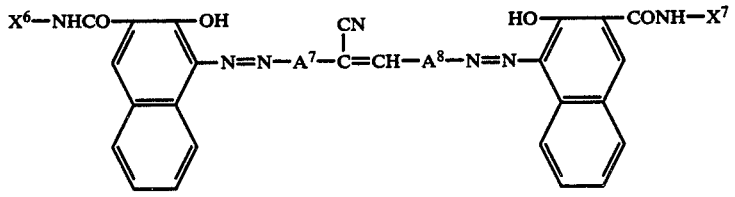
| Compound | —A7— | —A8— | —X6, —X7 |
|---|---|---|---|
| IV-9 | 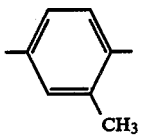 | 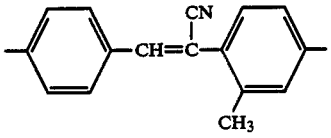 | 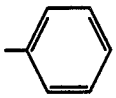 |
| IV-10 | 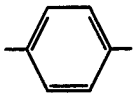 | 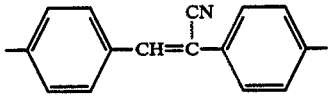 | 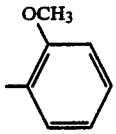 |
| IV-11 | " | " | 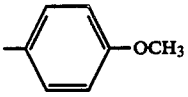 |
| IV-12 | " | " | 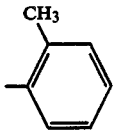 |
| IV-13 | 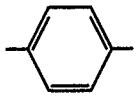 | 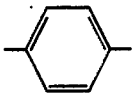 | 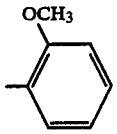 |
| IV-14 | " | " | 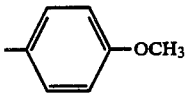 |
| IV-15 | " | " | 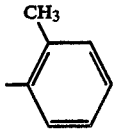 |
| IV-16 | " | " | 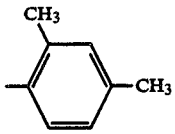 |
| IV-17 | 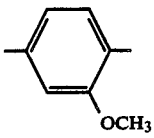 | " | 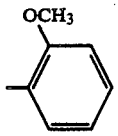 |

-continued
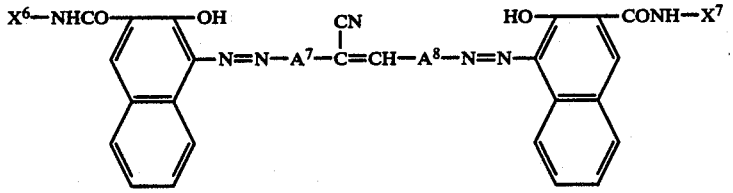
| Compound | —A7— | —A8— | —X6, —X7 |
|---|---|---|---|
| IV-18 | 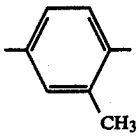 | " | 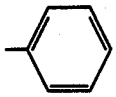 |
Example compound group [V]:
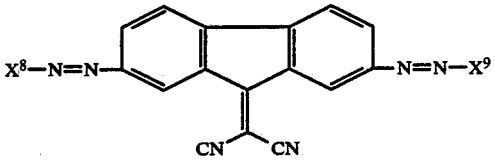
| Compound | —X8, —X9 |
|---|---|
| V-1 | 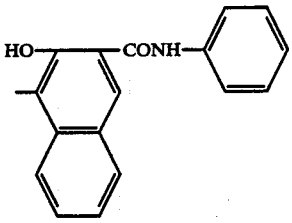 |
| V-2 | 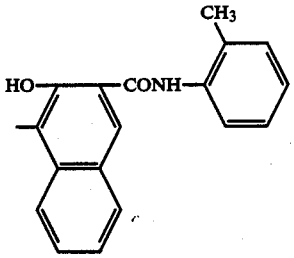 |
| V-3 | 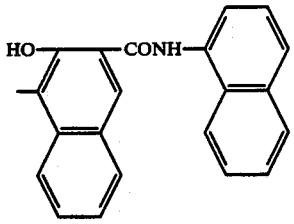 |

-continued
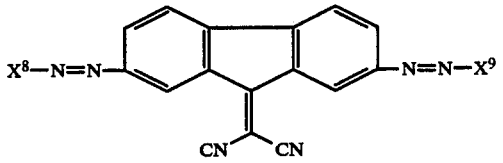
| Compound | $-X^8$, $-X^9$ |
|---|---|
| V-4 | 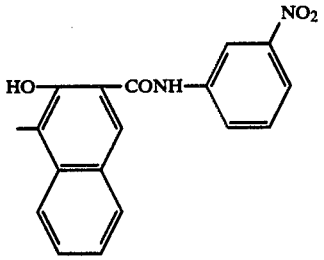 |
| V-5 | 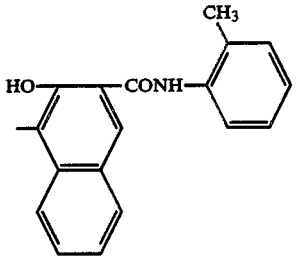 |
| V-6 | 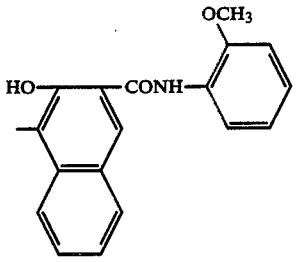 |
| V-7 | 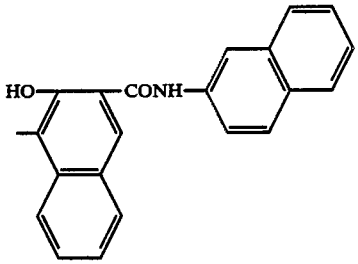 |
| V-8 | 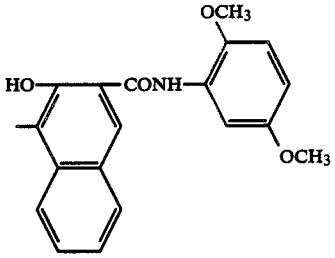 |

-continued
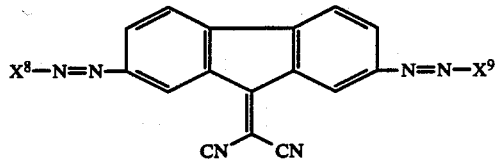
| Compound | $-X^8$, $-X^9$ |
|---|---|
| V-9 | 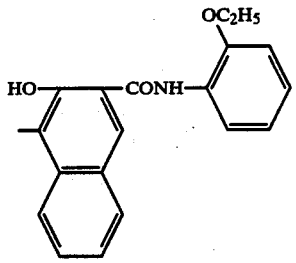 |
| V-10 | 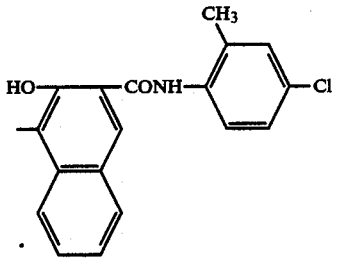 |
| V-11 | 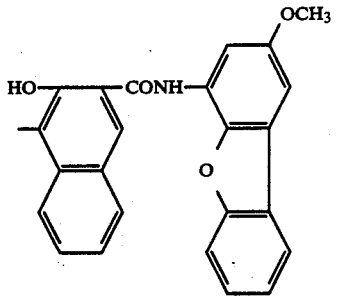 |
| V-12 | 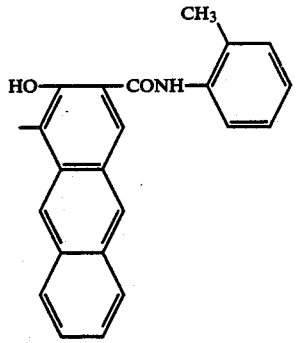 |

-continued
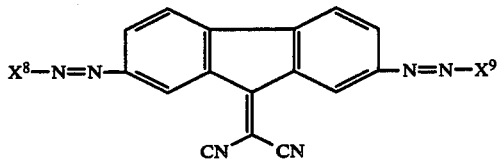
| Compound | $-X^8$, $-X^9$ |
|---|---|
| V-13 | 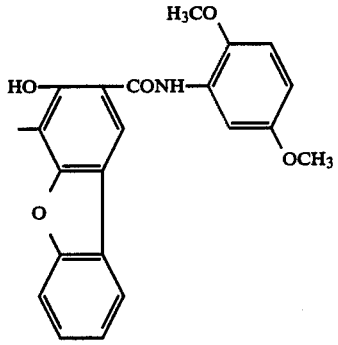 |
| V-14 | 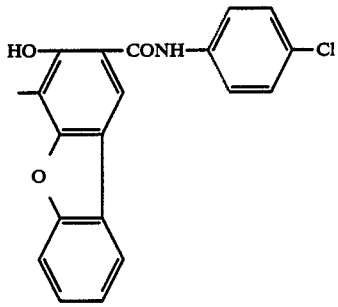 |
| V-15 | 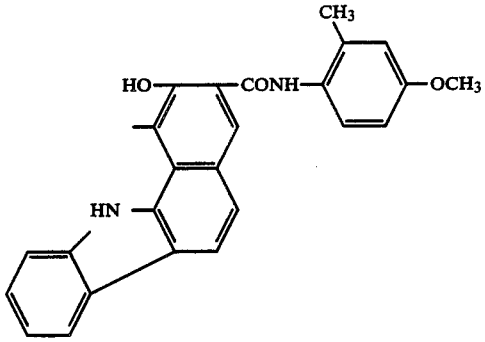 |
| V-16 | 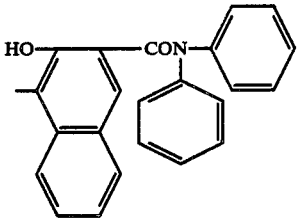 |

-continued
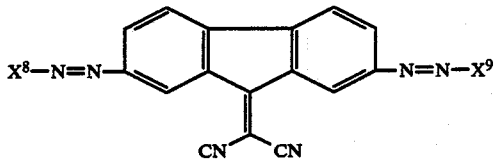
| Compound | $-X^8, -X^9$ |
|---|---|
| V-17 | 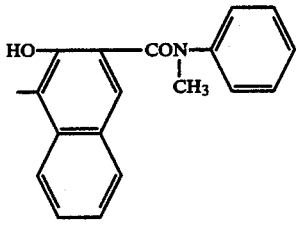 |
| V-18 | 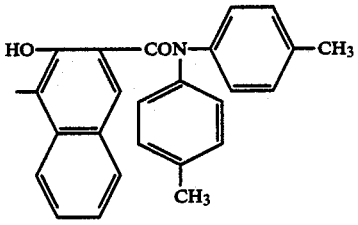 |
| V-19 | 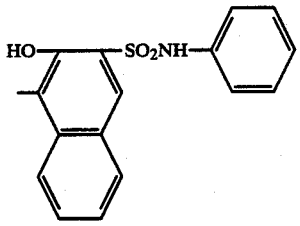 |
| V-20 | 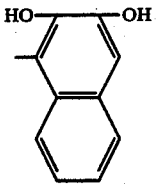 |
| V-21 | 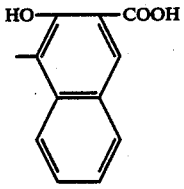 |
| V-22 | 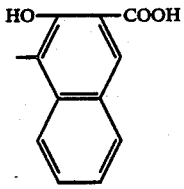 |

-continued
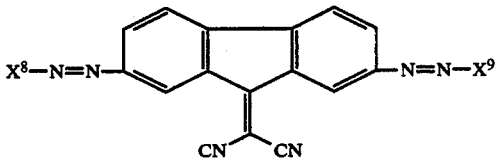
| Compound | $-X^8$, $-X^9$ |
|---|---|
| V-23 | 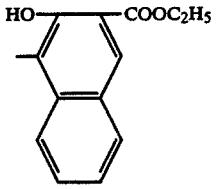 |
| V-24 | 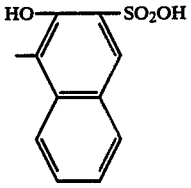 |
| V-25 | 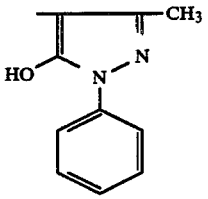 |
| V-26 | 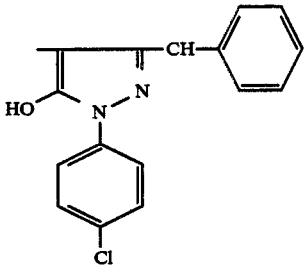 |
| V-27 | 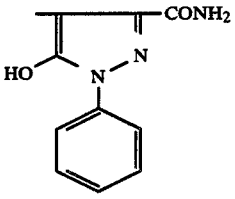 |
| V-28 | 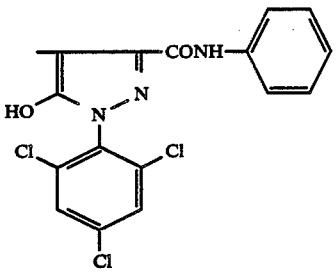 |

Additionally, the following groups [VI] through [VIII] of example compound i.e. polycyclic quinone pigment are particularly advantageously used as CGM.

Example compound group [VI]:

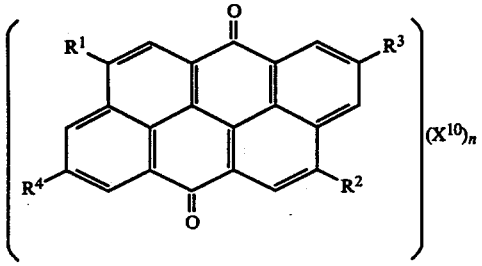

| Compound | $R^1$ | $R^2$ | $R^3$ | $R^4$ | $X^{10}$ | n |
|---|---|---|---|---|---|---|
| VI-1 | — | — | — | — | — | 0 |
| VI-2 | Cl | Cl | — | — | — | 0 |
| VI-3 | Br | Br | — | — | — | 0 |
| VI-4 | — | — | Br | Br | — | 0 |
| VI-5 | Br | Br | Br | Br | — | 0 |
| VI-6 | — | — | — | — | I | 2 |
| VI-7 | — | — | — | — | " | 3 |
| VI-8 | — | — | — | — | " | 4 |
| VI-9 | — | — | — | — | $NO_2$ | 2 |
| VI-10 | — | — | — | — | CN | 2 |
| VI-11 | — | — | — | — | $COCH_3$ | 2 |

Example compound group [VII]:

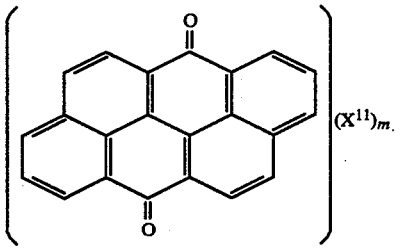

| Compound | $X^{11}$ | m |
|---|---|---|
| VII-1 | — | 0 |
| VII-2 | Cl | 2 |
| VII-3 | Br | 2 |
| VII-4 | I | 2 |
| VII-5 | I | 3 |
| VII-6 | I | 4 |
| VII-7 | $NO_2$ | 2 |
| VII-8 | CN | 2 |
| VII-9 | $COC_6H_5$ | 2 |

Example compound group [VIII]:

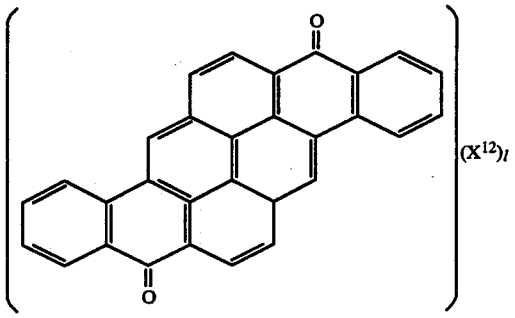

| Compound | $X^{12}$ | l |
|---|---|---|
| VIII-1 | — | 0 |
| VIII-2 | Cl | 2 |
| VIII-3 | Br | 2 |
| VIII-4 | " | 3 |
| VIII-5 | " | 4 |
| VIII-6 | I | 4 |
| VIII-7 | $NO_2$ | 3 |
| VIII-8 | CN | 4 |
| VIII-9 | $COCH_3$ | 4 |

The range of charge transporting material useful in the invention is not particularly limited. The useful charge generating materials include an oxazole derivative, oxadiazole derivative, thiazole derivative, thiadiazole derivative, triazole derivative, imidazole derivative, imidazolone derivative, imidazolidine derivative, bisimidazolidine derivative, styril derivative, hydrazone derivative, pyrazoline derivative, oxazolone derivative, benzothiazole derivative, benzimidazole derivative, quinazoline derivative, benzofuran derivative, acridine derivative, phenazine derivative, aminostilbene derivative, poly-N-vinylcarbazole derivative, poly-1-vinylpiren derivative, and poly-9-vinylanthrathene.

However, the preferred CTMs according to the invention are those excelling in transporting holes, which are generated in the course of irradiation with a light source, to the substrate, and those readily used as combined with the previously mentioned carrier generating materials. Such CTMs are styril compounds included in the following example compound group [IX] or [X].

Example compound group [IX]:

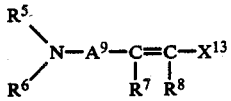

| Compound | $-R^5$ | $-R^6$ | $-R^7$ | $-R^8$ | $-A^9-$ | $-X^{13}$ |
|---|---|---|---|---|---|---|
| IX-1 | 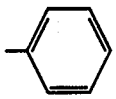 | 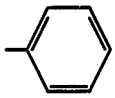 | —H | 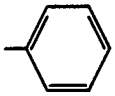 | 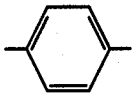 | 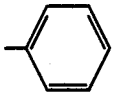 |

-continued
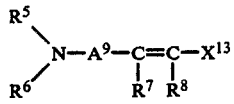
| Compound | $-R^5$ | $-R^6$ | $-R^7$ | $-R^8$ | $-A^9-$ | $-X^{13}$ |
|---|---|---|---|---|---|---|
| IX-2 | 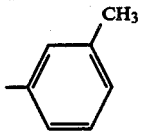 | " | " | " | " | 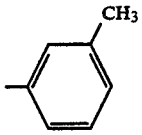 |
| IX-3 | 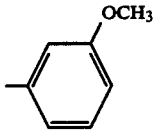 | " | " | " | " | 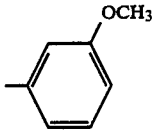 |
| IX-4 | $-CH_3$ | $-CH_3$ | " | $-H$ | " | 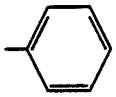 |
| IX-5 | $-C_2H_5$ | $-C_2H_5$ | " | " | " | " |
| IX-6 | " | " | " | " | " | 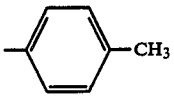 |
| IX-7 | " | " | " | " | " | 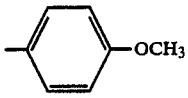 |
| IX-8 | 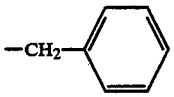 | 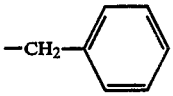 | " | " | " | 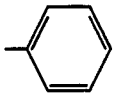 |
| IX-9 | 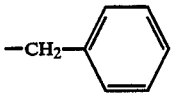 | 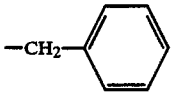 | $-H$ | 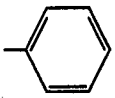 | 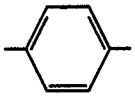 | 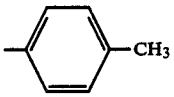 |
| IX-10 | " | " | " | " | " | 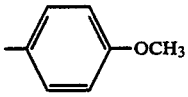 |
| IX-11 | " | " | $-H$ | $-H$ | 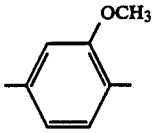 | 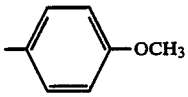 |
| IX-12 | $-C_2H_5$ | " | " | " | 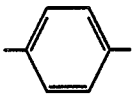 | " |
| IX-13 | 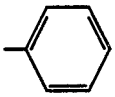 | 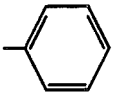 | " | " | " | 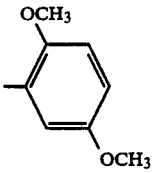 |

-continued
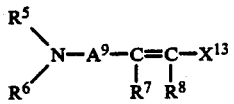
| Compound | $-R^5$ | $-R^6$ | $-R^7$ | $-R^8$ | $-A^9-$ | $-X^{13}$ |
|---|---|---|---|---|---|---|
| IX-14 | " | " | " | " | " | 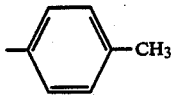 |
| IX-15 | " | " | " | " | " | 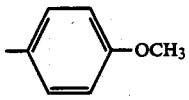 |
| IX-16 | " | " | " | " | " | 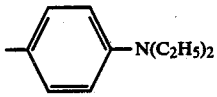 |
| IX-17 | " | " | " | " | " | 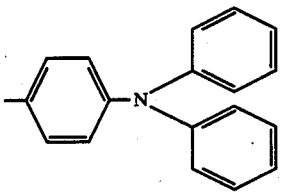 |
| IX-18 | " | " | " | " | 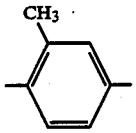 | 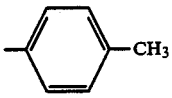 |
| IX-29 | 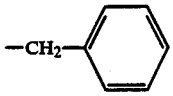 | 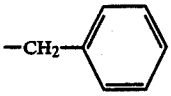 | $-H$ | $-H$ | 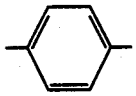 | 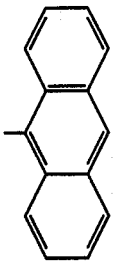 |
| IX-30 | " | " | " | " | 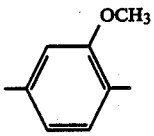 | " |
| IX-31 | 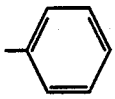 | 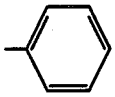 | " | " | 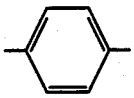 | 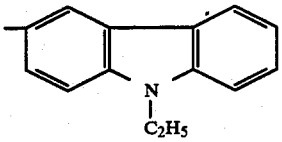 |
| IX-32 | " | " | " | " | 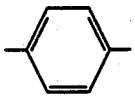 | 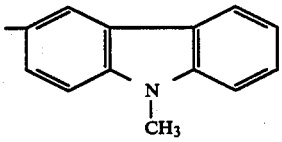 |

-continued
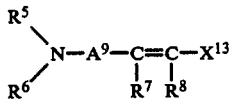
| Compound | $-R^5$ | $-R^6$ | $-R^7$ | $-R^8$ | $-A^9-$ | $-X^{13}$ |
|---|---|---|---|---|---|---|
| IX-33 | 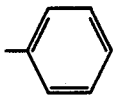 | 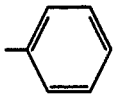 | —H | —H | 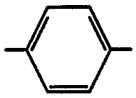 | 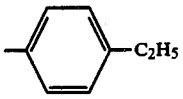 |
| IX-34 | " | " | " | " | " | 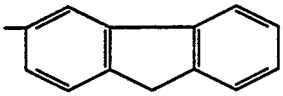 |
| IX-35 | 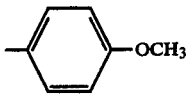 | " | " | " | " | 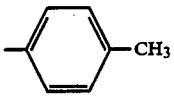 |
| IX-36 | " | " | " | " | " | 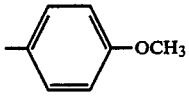 |
| IX-37 | 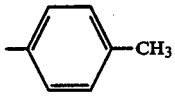 | " | " | " | " | " |
| IX-38 | 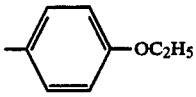 | " | " | " | " | 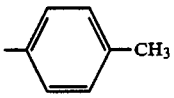 |
| IX-39 | 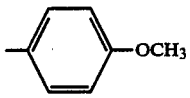 | 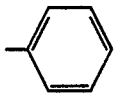 | —H | —H | 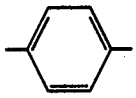 | 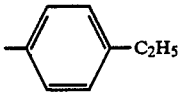 |
| IX-40 | " | " | " | " | " | 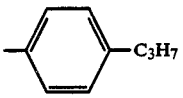 |
| IX-41 | " | " | " | " | " | 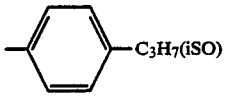 |
| IX-42 | " | " | " | " | " | 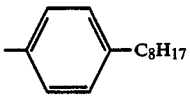 |
| IX-43 | " | " | " | " | " | 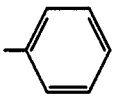 |
| IX-44 | " | " | " | " | " | 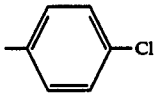 |

-continued
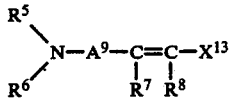
| Compound | $-R^5$ | $-R^6$ | $-R^7$ | $-R^8$ | $-A^9-$ | $-X^{13}$ |
|---|---|---|---|---|---|---|
| IX-45 | " | " | " | " | " | 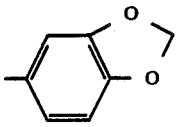 |
| IX-46 | " | " | " | " | " | 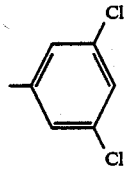 |
| IX-47 | " | " | " | " | " | 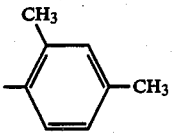 |
| IX-48 | " | " | " | " | " | 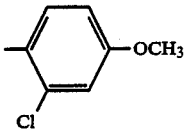 |
| IX-49 | 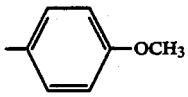 | 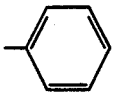 | —H | —H | 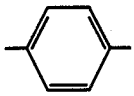 | 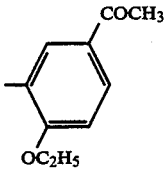 |
| IX-50 | " | " | " | " | " | 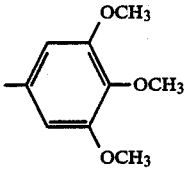 |
| IX-51 | " | " | " | " | " | 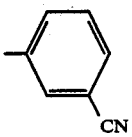 |
| IX-52 | " | " | " | " | " | 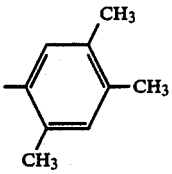 |
| IX-53 | " | " | " | " | " | 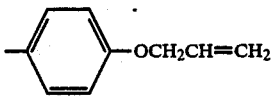 |

-continued
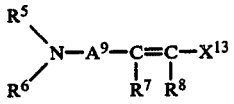
| Compound | $-R^5$ | $-R^6$ | $-R^7$ | $-R^8$ | $-A^9-$ | $-X^{13}$ |
|---|---|---|---|---|---|---|
| IX-54 | 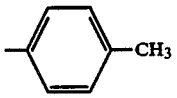 | " | " | " | " | 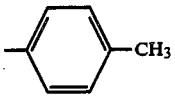 |
| IX-55 | " | " | " | " | " | 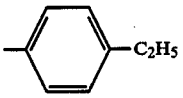 |
| IX-56 | " | " | " | " | " | 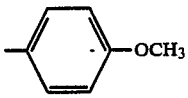 |
| IX-57 | " | " | " | " | " | 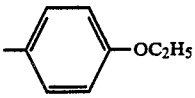 |
| IX-58 | " | " | " | " | " | 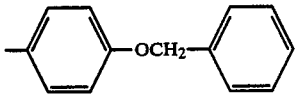 |
| IX-59 | 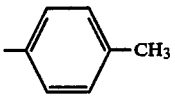 | 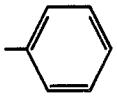 | —H | —H | 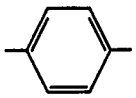 | 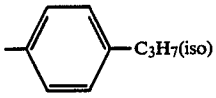 |
| IX-60 | " | " | " | " | " | 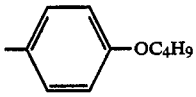 |
| IX-61 | " | " | " | " | " | 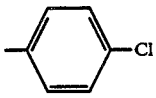 |
| IX-62 | " | " | " | " | " | 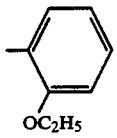 |
| IX-63 | " | " | " | " | " | 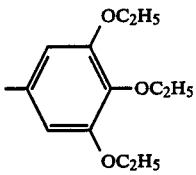 |
| IX-64 | " | " | " | " | " | 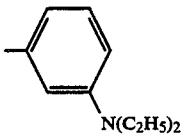 |

-continued
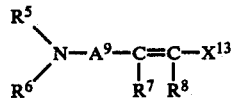
| Compound | $-R^5$ | $-R^6$ | $-R^7$ | $-R^8$ | $-A^9-$ | $-X^{13}$ |
|---|---|---|---|---|---|---|
| IX-65 | " | " | " | " | " | 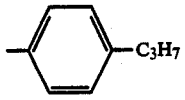 |
| IX-66 | 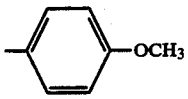 | 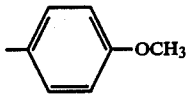 | —H | —H | " | 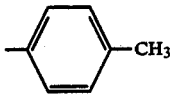 |
| IX-67 | " | 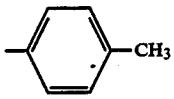 | " | " | " | 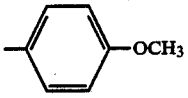 |
| IX-68 | " | " | " | " | " | 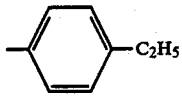 |
| IX-19 | 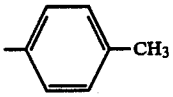 | 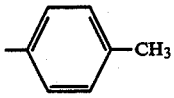 | —H | —H | 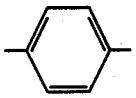 | 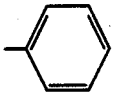 |
| IX-20 | " | " | " | " | " | 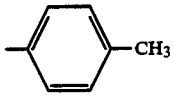 |
| IX-21 | " | " | —H | —H | 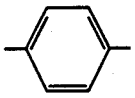 | 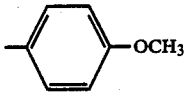 |
| IX-22 | " | " | —H | —H | 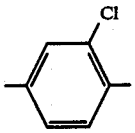 | 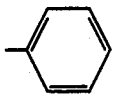 |
| IX-23 | " | " | " | " | 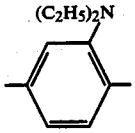 | 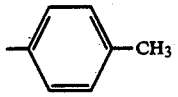 |
| IX-24 | 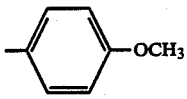 | 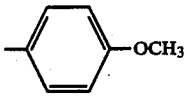 | " | " | 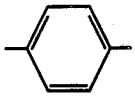 | 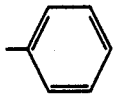 |
| IX-25 | " | " | " | " | " | 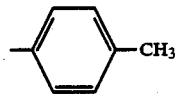 |
| IX-26 | " | " | " | " | " | 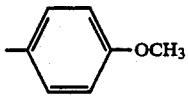 |

-continued
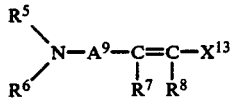
| Compound | $-R^5$ | $-R^6$ | $-R^7$ | $-R^8$ | $-A^9-$ | $-X^{13}$ |
|---|---|---|---|---|---|---|
| IX-27 | " | " | " | " | 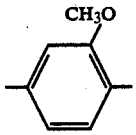 | 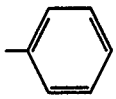 |
| IX-28 | $-C_2H_5$ | $-C_2H_5$ | " | " | 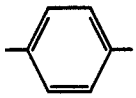 | 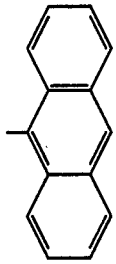 |
| IX-69 | 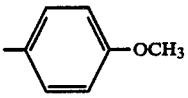 | 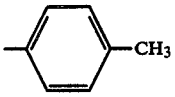 | H | H | 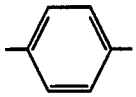 | 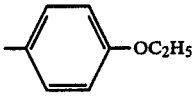 |
| IX-70 | " | " | " | " | " | 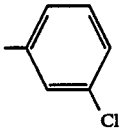 |
| IX-71 | " | " | " | " | " | 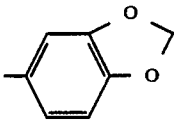 |
| IX-72 | " | " | " | " | 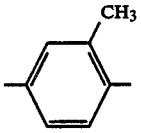 | 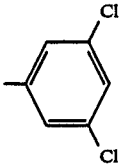 |
| IX-73 | " | " | " | " | 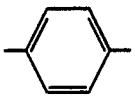 | 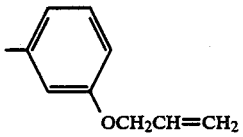 |
| IX-74 | 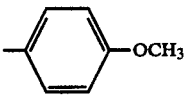 | 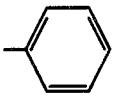 | " | " | " | 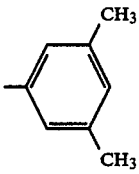 |
| IX-75 | 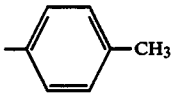 | " | " | " | " | " |

-continued
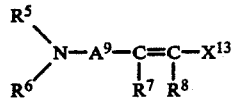
| Compound | $-R^5$ | $-R^6$ | $-R^7$ | $-R^8$ | $-A^9-$ | $-X^{13}$ |
|---|---|---|---|---|---|---|
| IX-76 | 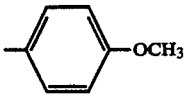 | 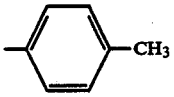 | " | " | " | " |
| IX-77 | 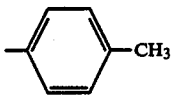 | 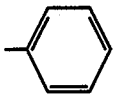 | —H | —H | " | 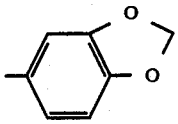 |
| IX-78 | 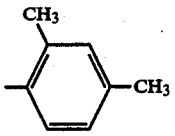 | " | $-CH_3$ | " | " | 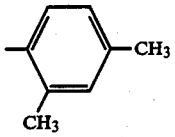 |
| IX-79 | 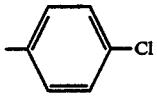 | 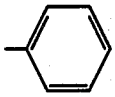 | $-CH_3$ | —H | 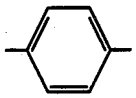 | 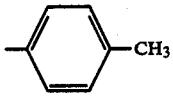 |
| IX-80 | 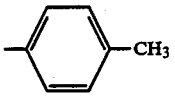 | 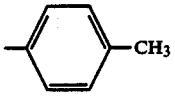 | —H | $-CH_3$ | " | 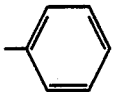 |
| IX-81 | 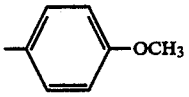 | 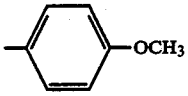 | " | " | " | 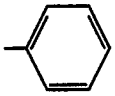 |
Example compound group [X]:
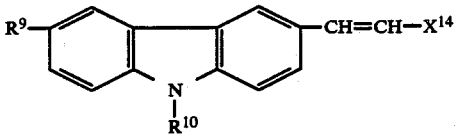
| Compound | $-R^9$ | $-R^{10}$ | $-X^{14}$ |
|---|---|---|---|
| X-1 | —H | 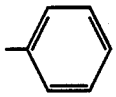 | 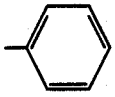 |
| X-2 | " | " | 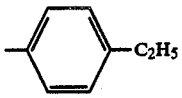 |
| X-3 | " | " | 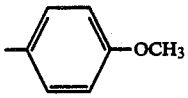 |

-continued
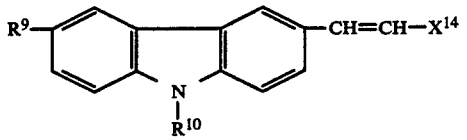
| Compound | —R9 | —R10 | —X14 |
|---|---|---|---|
| X-4 | " | " | 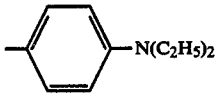  |
| X-5 | " | 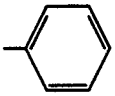 | 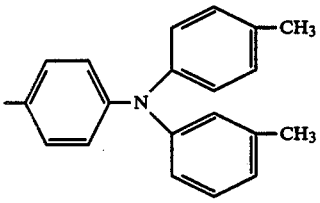  |
| X-6 | " | 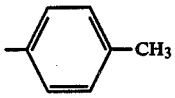  | 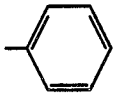 |
| X-7 | " | " | 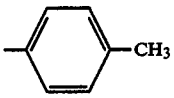  |
| X-8 | " | " | 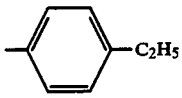  |
| X-9 | " | " | 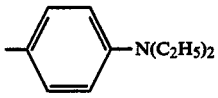  |
| X-10 | " | " | 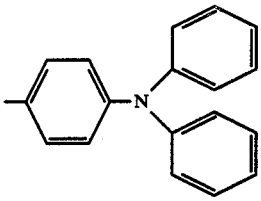  |
| X-11 | " | 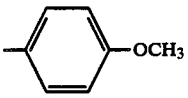  | 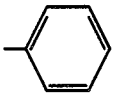 |
| X-12 | " | " | 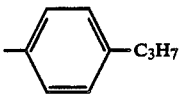  |
| X-13 | " | 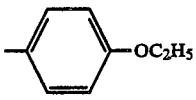  | 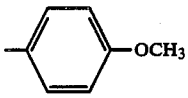  |

-continued
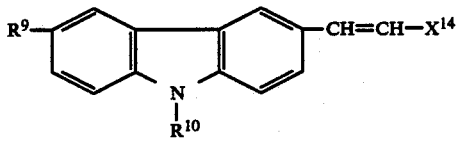
| Compound | —R9 | —R10 | —X14 |
|---|---|---|---|
| X-14 | " | 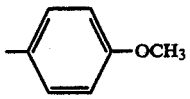 | 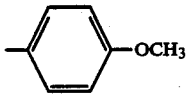 |
| X-15 | " | " | 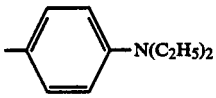 |
| X-16 | " | " | 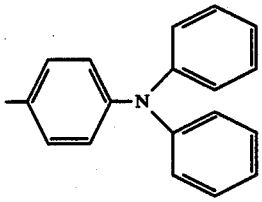 |
| X-17 | " | 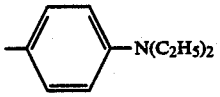 | 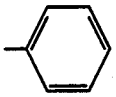 |
| X-18 | " | " | 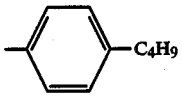 |
| X-19 | " | 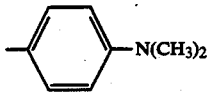 | 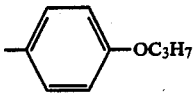 |
| X-20 | " | 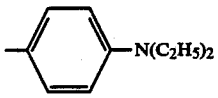 | 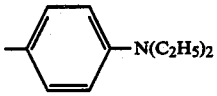 |
| X-21 | " | 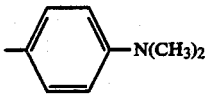 | 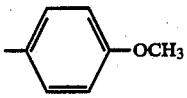 |
| X-22 | —Cl | 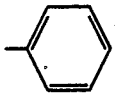 | 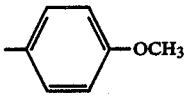 |
| X-23 | —OCH3 | 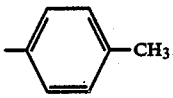 | 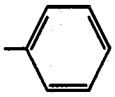 |
| X-24 | —OH | 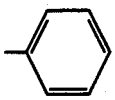 | 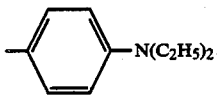 |

-continued
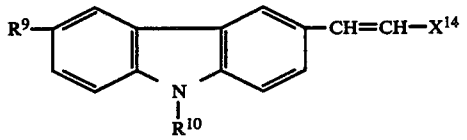
| Compound | —R9 | —R10 | —X14 |
|---|---|---|---|
| X-25 | —N(C2H5)2 | 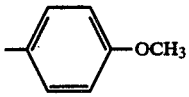 | 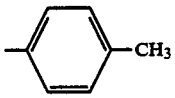 |
| X-26 | —H | 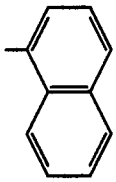 | 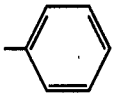 |
| X-27 | " | 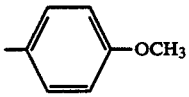 | 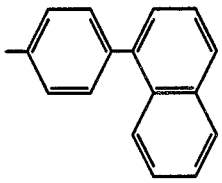 |
| X-28 | " | 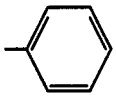 | 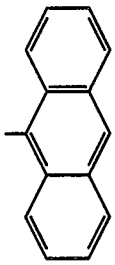 |
| X-29 | " | " | 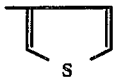 |
| X-30 | " | 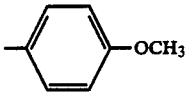 | 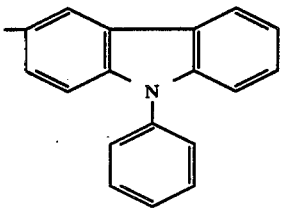 |
| X-31 | —OCH3 | " | 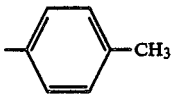 |
| X-32 | " | 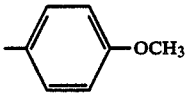 | 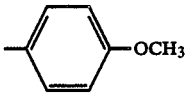 |

-continued
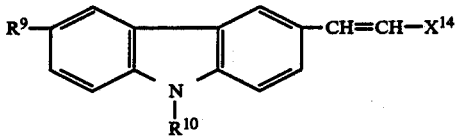
| Compound | $-R^9$ | $-R^{10}$ | $-X^{14}$ |
|---|---|---|---|
| X-33 | " | " | 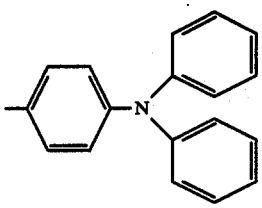 |
Other useful compounds serving as CTM are hydrazone compounds include in the following example compound groups [XI] through [XV].
Example compound group [XI]:
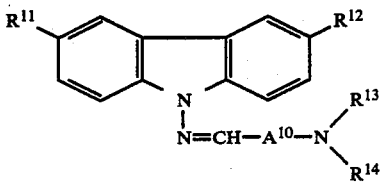
| Compound | $-R^{11}$ | $-R^{12}$ | $-R^{13}$ | $-R^{14}$ | $-A^{10}-$ |
|---|---|---|---|---|---|
| XI-1 | —H | —H | 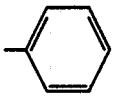 | 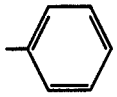 | 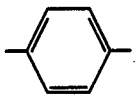 |
| XI-2 | " | " | 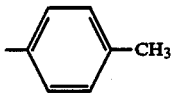 | 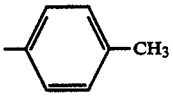 | " |
| XI-3 | " | " | " | 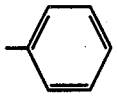 | " |
| XI-4 | —H | —H | 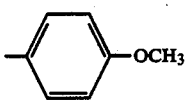 | 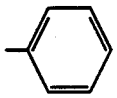 | 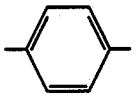 |
| XI-5 | " | " | " | 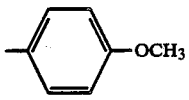 | " |
| XI-6 | " | —Cl | 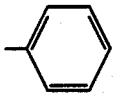 | 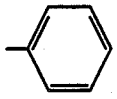 | " |
| XI-7 | " | " | 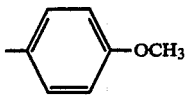 | 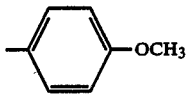 | " |

-continued
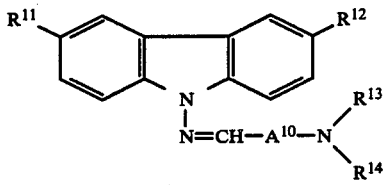
| Compound | $-R^{11}$ | $-R^{12}$ | $-R^{13}$ | $-R^{14}$ | $-A^{10}-$ |
|---|---|---|---|---|---|
| XI-8 | " | " | 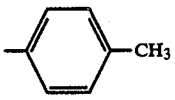 | 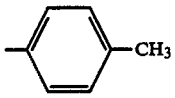 | " |
| XI-9 | " | —H | 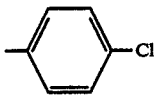 | 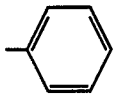 | " |
| XI-10 | " | " | 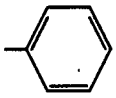 | " | 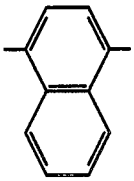 |
| XI-11 | " | " | 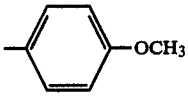 | 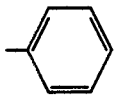 | 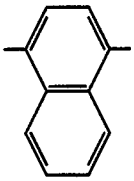 |
| XI-12 | " | " | 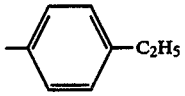 | " | 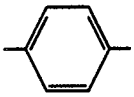 |
| XI-13 | " | " | 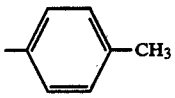 | 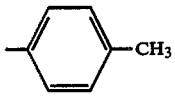 | " |
| XI-14 | " | —Cl | 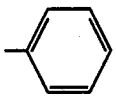 | 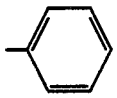 | 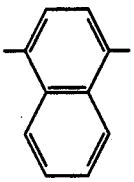 |
Example compound group [XII]:
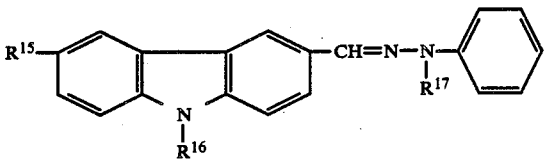
| Compound | $-R^{15}$ | $-R^{16}$ | $-R^{17}$ |
|---|---|---|---|
| XII-1 | —H | $-CH_3$ | $-CH_3$ |
-continued
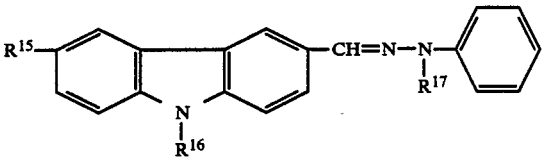
| Compound | $-R^{15}$ | $-R^{16}$ | $-R^{17}$ |
|---|---|---|---|
| XII-2 | " | " | $-C_2H_5$ |

-continued
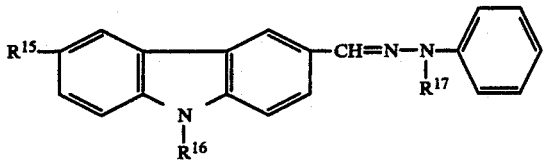
| Compound | $-R^{15}$ | $-R^{16}$ | $-R^{17}$ |
|---|---|---|---|
| XII-3 | " | " | 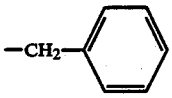 |
| XII-4 | " | " | 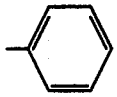 |
| XII-5 | " | $-C_2H_5$ | $-CH_3$ |
| XII-6 | " | " | $-C_2H_5$ |
| XII-7 | " | " | 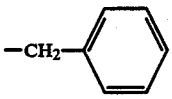 |
-continued
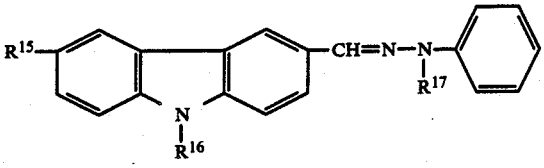
| Compound | $-R^{15}$ | $-R^{16}$ | $-R^{17}$ |
|---|---|---|---|
| XII-8 | " | " | 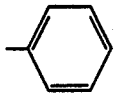 |
| XII-9 | " | $-CH_2CH_2OH$ | $-CH_3$ |
| XII-10 | " | " | $-C_2H_5$ |
| XII-11 | " | " | 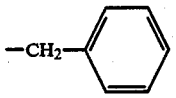 |
| XII-12 | $-Cl$ | " | " |
Example compound group [XIII]:
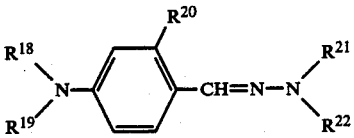
| Compound | $-R^{18}$ | $-R^{19}$ | $-R^{20}$ | $-R^{21}$ | $-R^{22}$ |
|---|---|---|---|---|---|
| XIII-1 | $-C_2H_5$ | $-C_2H_5$ | $-H$ | 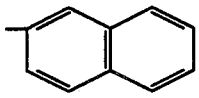 | 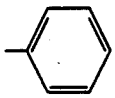 |
| XIII-2 | " | " | " | 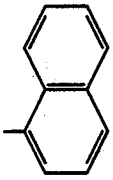 | " |
| XIII-3 | " | " | " | " | 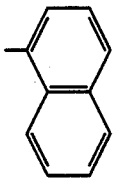 |
| XIII-4 | " | " | " | 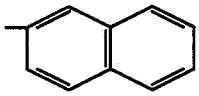 | 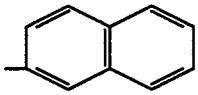 |

-continued
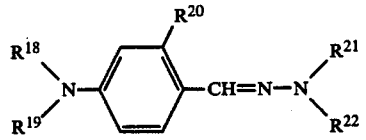
| Compound | $-R^{18}$ | $-R^{19}$ | $-R^{20}$ | $-R^{21}$ | $-R^{22}$ |
|---|---|---|---|---|---|
| XIII-5 | " | " | " | " | 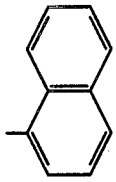 |
| XIII-6 | $-C_3H_7$ | $-C_3H_7$ | " | 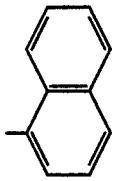 | 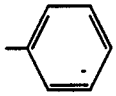 |
| XIII-7 | $-C_4H_9$ | $-C_4H_9$ | " | 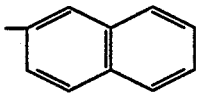 | " |
| XIII-8 | 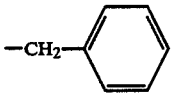 | 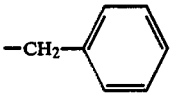 | " | 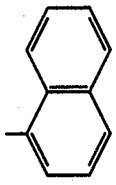 | " |
| XIII-9 | 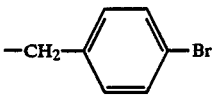 | 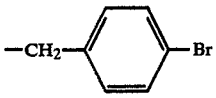 | $-H$ | 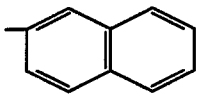 | 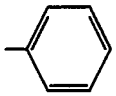 |
| XIII-10 | 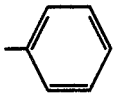 | 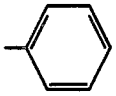 | " | 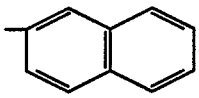 | " |
| XIII-11 | $-C_2H_5$ | $-(CH_2)_2N(CH_3)_2$ | " | " | 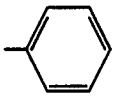 |
| XIII-12 | " | $-CH_2CH_2OCH_3$ | " | " | " |
| XIII-13 | " | $-C_2H_5$ | $-CH_3$ | 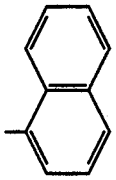 | " |
| XIII-14 | " | " | $-OCH_3$ | " | " |
| XIII-15 | " | " | $-OC_4H_9$ | " | " |

-continued
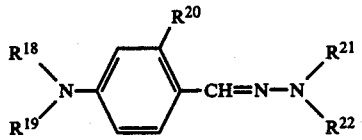
| Compound | $-R^{18}$ | $-R^{19}$ | $-R^{20}$ | $-R^{21}$ | $-R^{22}$ |
|---|---|---|---|---|---|
| XIII-16 | 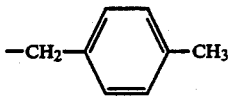 | 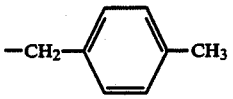 | $-H$ | " | " |
| XIII-17 | $-C_2H_5$ | $-C_2H_5$ | " | 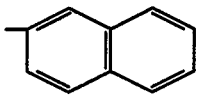 | 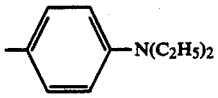 |
| XIII-18 | " | " | " | " | 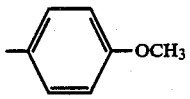 |
| XIII-19 | $-C_2H_5$ | $-CH_2CH_2Cl$ | $-H$ | 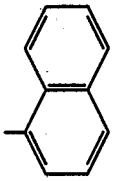 | 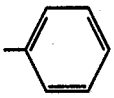 |
| XIII-20 | " | $-C_2H_5$ | " | 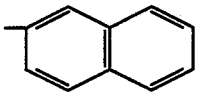 | 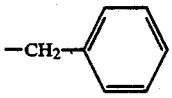 |
| XIII-21 | " | " | " | " | $-C_2H_5$ |
| XIII-22 | $-C_3H_7$ | $-C_3H_7$ | " | 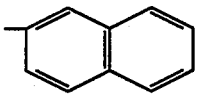 | 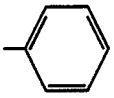 |
Example compound group [XIV]:
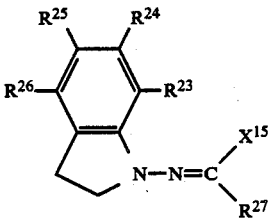
| Compound | $-R^{23}$ | $-R^{24}$ | $-R^{25}$ | $-R^{26}$ | $-R^{27}$ | $-X^{15}$ |
|---|---|---|---|---|---|---|
| XIV-1 | $-H$ | $-H$ | $-H$ | $-H$ | $-H$ | 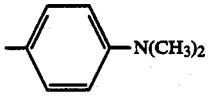 |
| XIV-2 | " | " | " | " | " | 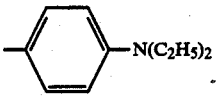 |

-continued
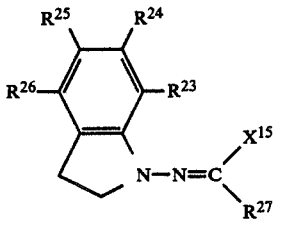
| Compound | —R23 | —R24 | —R25 | —R26 | —R27 | —X15 |
|---|---|---|---|---|---|---|
| XIV-3 | " | " | " | " | " | 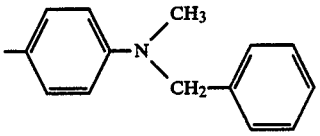 |
| XIV-4 | —H | —H | —CH3 | —H | —H | 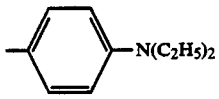 |
| XIV-5 | " | " | —H | " | " | 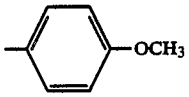 |
| XIV-6 | " | " | —OCH3 | " | " | 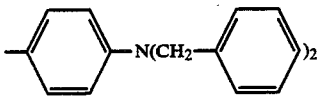 |
| XIV-7 | " | " | —H | " | " | 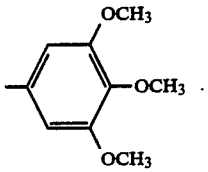 |
| XIV-8 | " | " | " | " | " | 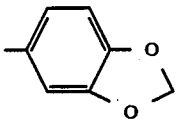 |
| XIV-9 | " | " | " | " | " | 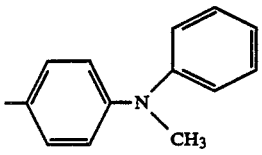 |
| XIV-10 | " | " | " | " | " | 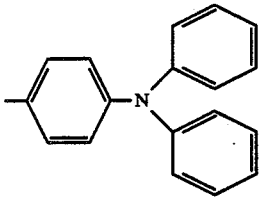 |
| XIV-11 | " | —CH3 | " | " | " | " |

-continued
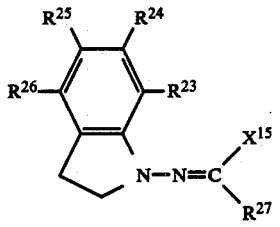
| Compound | $-R^{23}$ | $-R^{24}$ | $-R^{25}$ | $-R^{26}$ | $-R^{27}$ | $-X^{15}$ |
|---|---|---|---|---|---|---|
| XIV-12 | " | —H | " | " | " | 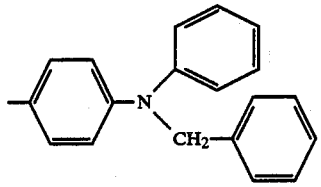 |
| XIV-13 | —H | —H | —H | —H | —H | 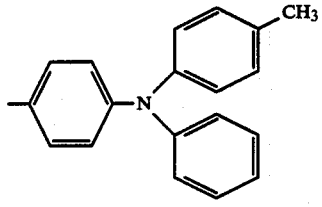 |
| XIV-14 | " | " | " | " | " | 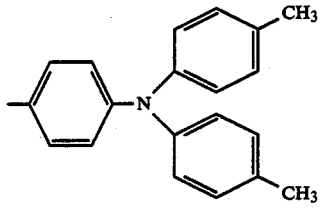 |
| XIV-15 | " | " | " | " | " | 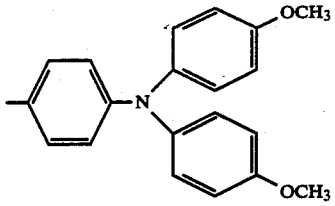 |
| XIV-16 | " | $-OCH_3$ | " | " | " | 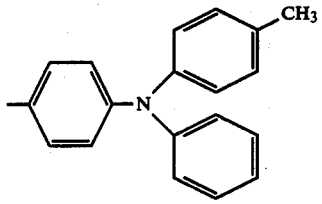 |
| XIV-17 | " | —H | " | —Cl | " | 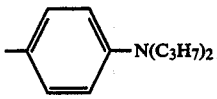 |
| XIV-18 | $-C_2H_5$ | " | " | —H | $-CH_3$ | 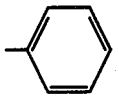 |

-continued
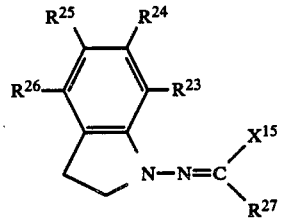
| Compound | $-R^{23}$ | $-R^{24}$ | $-R^{25}$ | $-R^{26}$ | $-R^{27}$ | $-X^{15}$ |
|---|---|---|---|---|---|---|
| XIV-19 | —H | " | " | " | 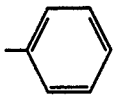 | 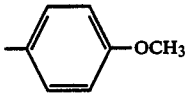 |
| XIV-20 | " | " | " | " | $-C_2H_5$ | 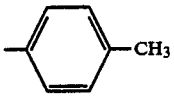 |
| XIV-21 | " | " | " | " | 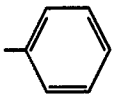 | 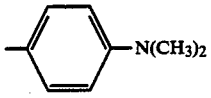 |
| XIV-22 | —H | —H | —H | —H | $-CH_3$ | 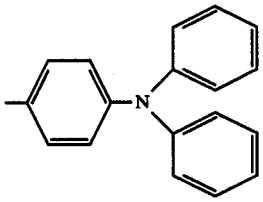 |
| XIV-23 | " | " | " | " | —H | 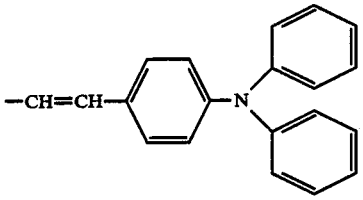 |
| XIV-24 | " | " | " | " | " | 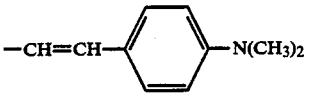 |
| XIV-25 | " | " | " | " | " | 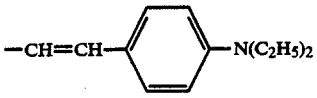 |
| XIV-26 | " | " | " | " | " | 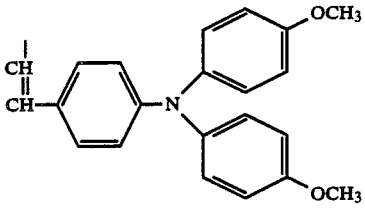 |
| XIV-27 | " | " | " | " | $-CH_3$ | 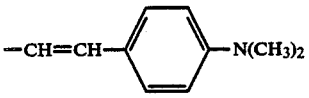 |

-continued
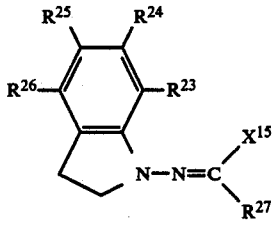
| Compound | $-R^{23}$ | $-R^{24}$ | $-R^{25}$ | $-R^{26}$ | $-R^{27}$ | $-X^{15}$ |
|---|---|---|---|---|---|---|
| XIV-28 | " | " | " | " | " | 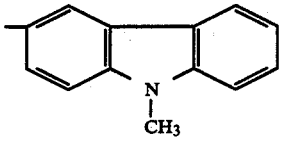 |
| XIV-29 | " | " | " | " | " | 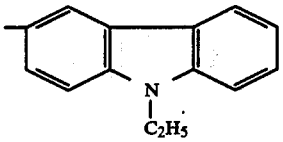 |
| XIV-30 | —H | —H | —H | —H | —H | 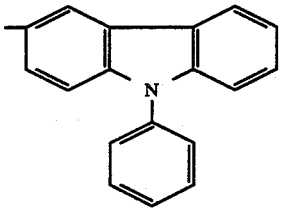 |
| XIV-31 | " | " | " | " | " | 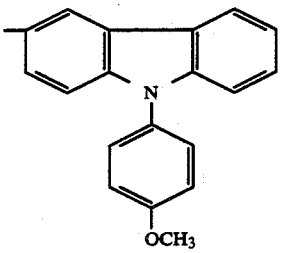 |
| XIV-32 | " | " | " | " | " | 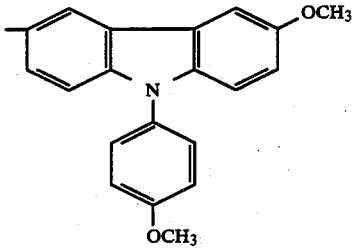 |
| XIV-33 | " | " | $-CH_3$ | " | " | 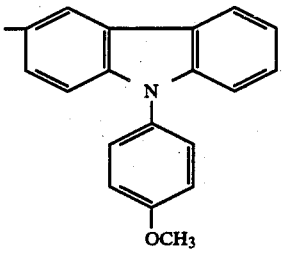 |

-continued
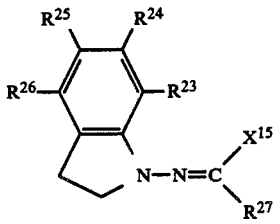
| Compound | $-R^{23}$ | $-R^{24}$ | $-R^{25}$ | $-R^{26}$ | $-R^{27}$ | $-X^{15}$ |
|---|---|---|---|---|---|---|
| XIV-34 | " | " | " | " | " | 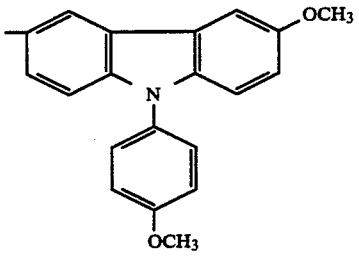 |
| XIV-35 | " | " | —H | " | " | 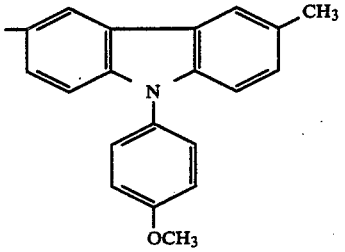 |
| XIV-36 | —H | $-CH_3$ | —H | —H | —H | 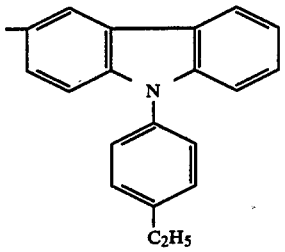 |
| XIV-37 | " | —H | " | " | " | 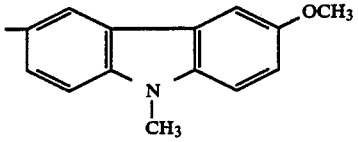 |
| XIV-38 | " | " | " | " | " | 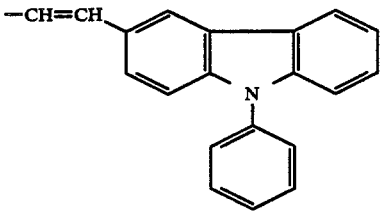 |

-continued
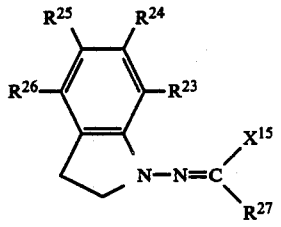
| Compound | $-R^{23}$ | $-R^{24}$ | $-R^{25}$ | $-R^{26}$ | $-R^{27}$ | $-X^{15}$ |
|---|---|---|---|---|---|---|
| XIV-39 | " | " | " | " | " | 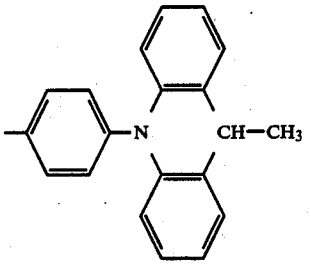 |
| XIV-40 | $-N(CH_3)_2$ | " | " | " | " | 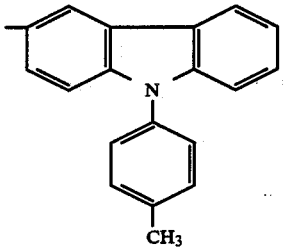 |
| XIV-41 | —H | —H | —H | —H | —H | 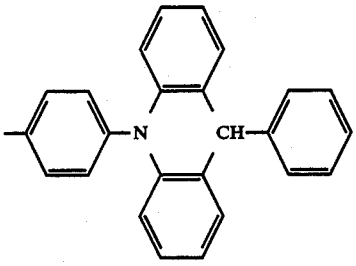 |
| XIV-42 | " | " | " | " | " | 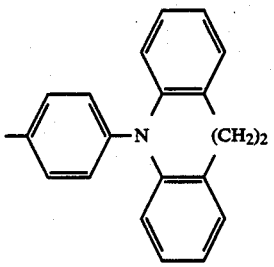 |
| XIV-43 | " | " | " | " | " | 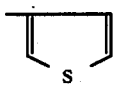 |
| XIV-44 | " | " | " | " | " | 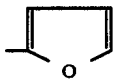 |

-continued
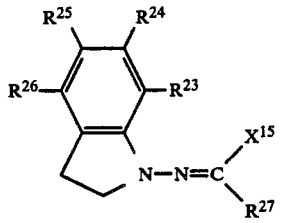
| Compound | $-R^{23}$ | $-R^{24}$ | $-R^{25}$ | $-R^{26}$ | $-R^{27}$ | $-X^{15}$ |
|---|---|---|---|---|---|---|
| XIV-45 | " | " | " | " | " | 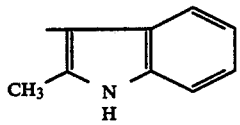 |
| XIV-46 | " | " | " | " | " | 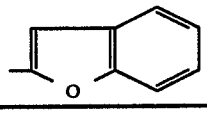 |
Example compound group [XV]:
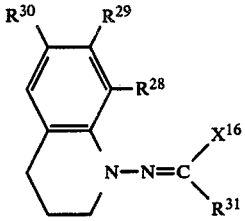
| Compound | $-R^{28}$ | $-R^{29}$ | $-R^{30}$ | $-R^{31}$ | $-X^{16}$ |
|---|---|---|---|---|---|
| XV-1 | —H | —H | —H | —H | 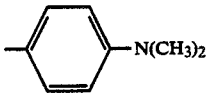 |
| XV-2 | " | " | " | " | 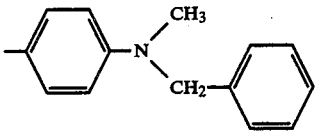 |
| XV-3 | " | " | $-CH_3$ | —H | 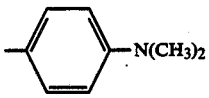 |
| XV-4 | " | " | —H | " | " |
| XV-5 | " | " | " | " | 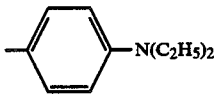 |
| XV-6 | " | $-OCH_3$ | " | " | " |
| XV-7 | " | —H | " | " | 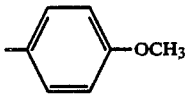 |

-continued
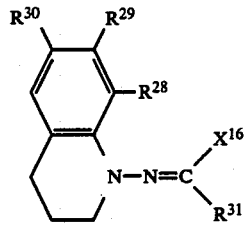
| Compound | $-R^{28}$ | $-R^{29}$ | $-R^{30}$ | $-R^{31}$ | $-X^{16}$ |
|---|---|---|---|---|---|
| XV-8 | " | " | " | " | 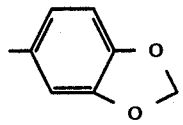 |
| XV-9 | " | " | " | " | 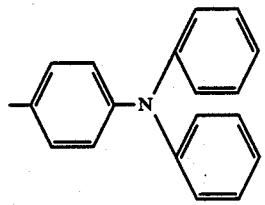 |
| XV-10 | " | " | " | " | 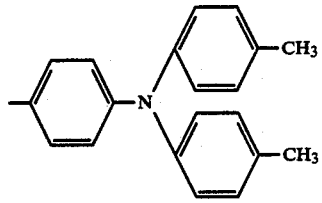 |
| XV-11 | " | " | " | " | 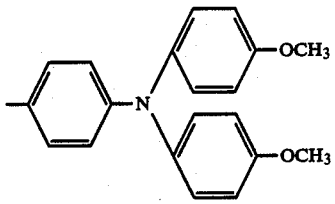 |
| XV-12 | " | " | $-CH_3$ | " | 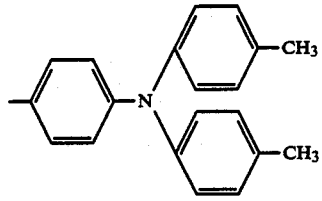 |
| XV-13 | " | " | $-OCH_3$ | " | 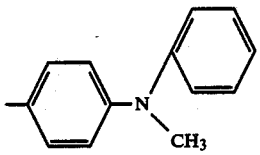 |

-continued
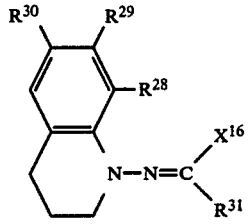
| Compound | —R28 | —R29 | —R30 | —R31 | —X16 |
|---|---|---|---|---|---|
| XV-14 | " | " | —Cl | " | 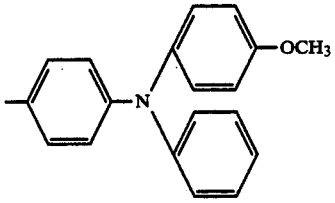 |
| XV-15 | " | " | —H | 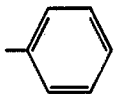 | 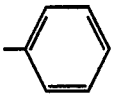 |
| XV-16 | " | " | " | " | 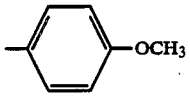 |
| XV-17 | " | " | " | —CH3 | 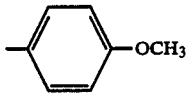 |
| XV-18 | " | " | " | " | 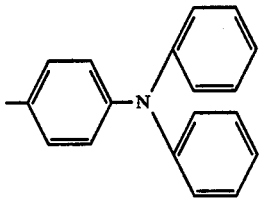 |
| XV-19 | " | " | " | 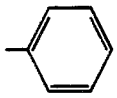 | 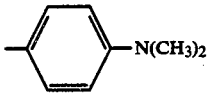 |
| XV-20 | " | " | " | —H | 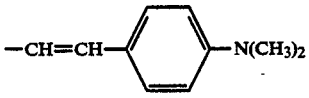 |
| XV-21 | " | " | " | " | 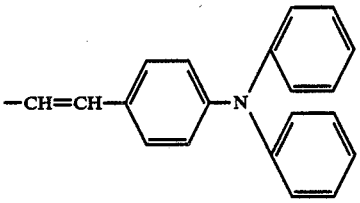 |
| XV-22 | —CH3 | " | " | " | 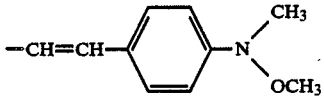 |

-continued
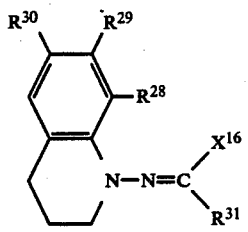
| Compound | $-R^{28}$ | $-R^{29}$ | $-R^{30}$ | $-R^{31}$ | $-X^{16}$ |
|---|---|---|---|---|---|
| XV-23 | —H | " | " | $-CH_3$ | 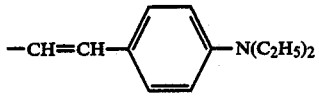 |
| XV-24 | " | " | " | —H | 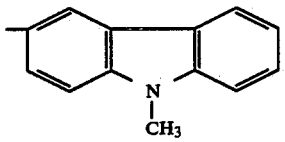 |
| XV-25 | " | " | " | " | 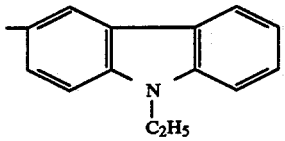 |
| XV-26 | " | " | " | " | 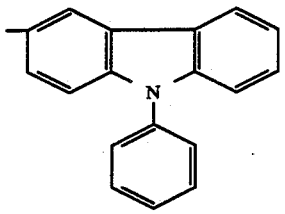 |
| XV-27 | " | " | $-CH_3$ | " | 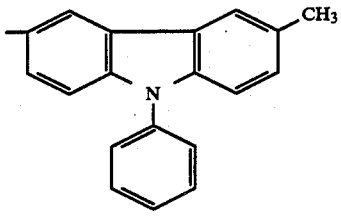 |
| XV-28 | " | " | —H | " | 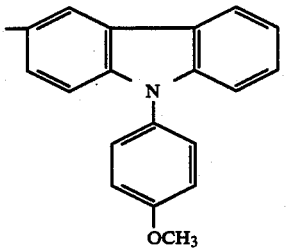 |

-continued
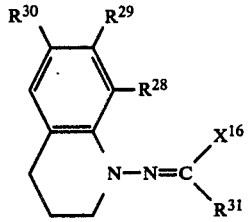
| Compound | $-R^{28}$ | $-R^{29}$ | $-R^{30}$ | $-R^{31}$ | $-X^{16}$ |
|---|---|---|---|---|---|
| XV-29 | " | " | $-CH_3$ | " | 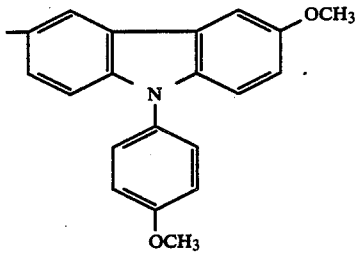 |
| XV-30 | " | " | —H | " | 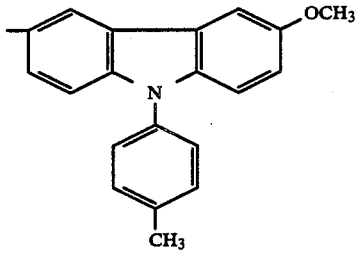 |
| XV-31 | " | " | " | " | 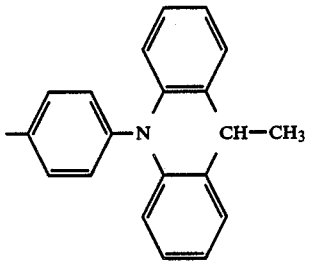 |
| XV-32 | " | " | " | " | 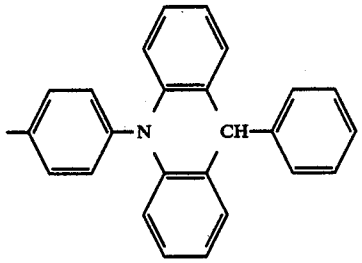 |
| XV-33 | " | " | " | " | 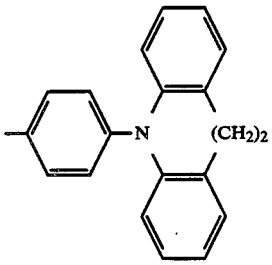 |

-continued
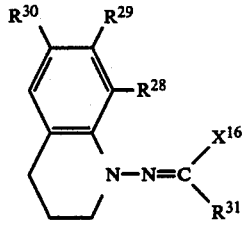
| Compound | $-R^{28}$ | $-R^{29}$ | $-R^{30}$ | $-R^{31}$ | $-X^{16}$ |
|---|---|---|---|---|---|
| XV-34 | " | " | " | " | 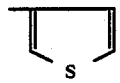 |
| XV-35 | " | " | —CN | " | 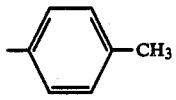 |
| XV-36 | " | $-N(C_2H_5)_2$ | —H | " | 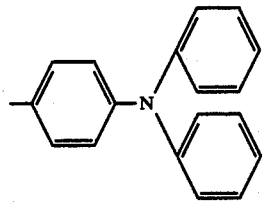 |
| XV-37 | $-C_2H_5$ | —H | " | " | 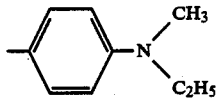 |
| XV-38 | —H | " | " | " | 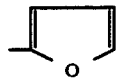 |
| XV-39 | " | " | " | " | 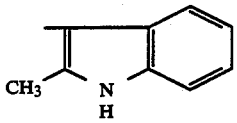 |
| XV-40 | " | " | " | " | 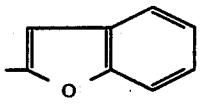 |
| XV-41 | " | " | " | " | 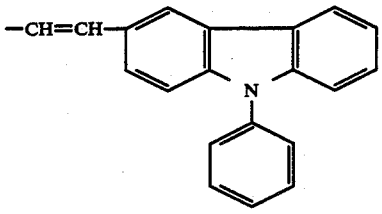 |
| XV-42 | $-C_3H_7$ | " | " | $-CH_3$ | 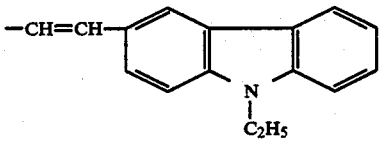 |

Additionally, other useful CTMs are pyrazoline compounds included in the following example compound group [XVI].

Example compound group [XVI]:

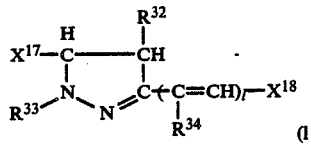

(l = 0 1)

| Compound | $-X^{17}$ | $-R^{32}$ | $-R^{33}$ | $-R^{34}$ | l | $-X^{18}$ |
|---|---|---|---|---|---|---|
| XVI-1 | $-C_6H_4-N(CH_3)_2$ | $-CH_3$ | $-C_6H_5$ | $-H$ | 1 | $-C_6H_4-N(CH_3)_2$ |
| XVI-2 | " | $-H$ | " | $-CH_3$ | " | " |
| XVI-3 | $-C_6H_4-N(C_2H_5)_2$ | $-CH_3$ | " | " | " | $-C_6H_4-N(C_2H_5)_2$ |
| XVI-4 | $-C_6H_4-OCH_3$ | " | " | $-H$ | " | $-C_6H_4-OCH_3$ |
| XVI-5 | " | $-H$ | " | $-CH_3$ | " | " |
| XVI-6 | $-C_6H_4-N(C_2H_5)_2$ | $-CH_3$ | $-C_6H_4-OCH_3$ | $-H$ | " | $-C_6H_4-N(C_2H_5)_2$ |
| XVI-7 | $-C_6H_4-N(CH_3)_2$ | " | $-C_6H_5$ | " | " | $-C_6H_4-OCH_3$ |
| XVI-8 | $-C_6H_4-OCH_3$ | " | " | " | " | $-C_6H_4-N(CH_3)_2$ |
| XVI-9 | $-C_6H_4-N(CH_3)_2$ | $-H$ | " | $-CH_3$ | " | $-C_6H_4-OC_2H_5$ |
| XVI-10 | $-C_6H_4-OC_2H_5$ | $-H$ | $-C_6H_5$ | $-CH_3$ | 1 | $-C_6H_4-N(C_2H_5)_2$ |
| XVI-11 | $-C_6H_4-N(C_2H_5)_2$ | $-C_6H_5$ | " | $-C_6H_5$ | " | $-C_6H_4-N(C_2H_5)_2$ |
| XVI-12 | $-C_6H_4-N(CH_3)_2$ | $-CH_3$ | " | $-H$ | " | $-C_6H_4-N(CH_2-C_6H_5)_2$ |
| XVI-13 | $-C_6H_4-N(C_2H_5)_2$ | " | " | $-H$ | 0 | $-C_6H_4-N(C_2H_5)_2$ |
| XVI-14 | " | $-C_2H_5$ | " | " | 1 | " |
| XVI-15 | $-C_6H_4-N(C_4H_9)_2$ | $-H$ | " | $-C_3H_7$ | " | $-C_6H_4-OC_2H_5$ |
| XVI-16 | $-C_6H_4-N(C_2H_5)_2$ | $-CH_2-C_6H_5$ | $-C_6H_4-OC_2H_5$ | $-H$ | " | $-C_6H_4-N(C_2H_5)_2$ |
| XVI-17 | " | $-H$ | $-C_6H_5$ | $-CH_2-C_6H_5$ | " | " |
| XVI-18 | $-C_6H_4-N(CH_3)_2$ | " | " | $-CH_3$ | " | $-C_6H_4-N(C_6H_5)_2$ |

-continued
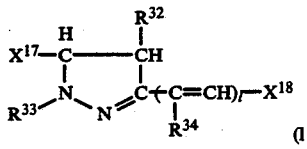
(l = 0 1)
| Compound | $-X^{17}$ | $-R^{32}$ | $-R^{33}$ | $-R^{34}$ | l | $-X^{18}$ |
|---|---|---|---|---|---|---|
| XVI-19 | 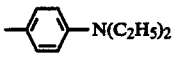 | $-CH_3$ | " | $-H$ | " | 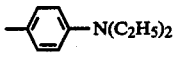 |
Additionally, other useful CTMs are amine derivatives included in the following example compound group [XVII].
Example compound group [XVII]:
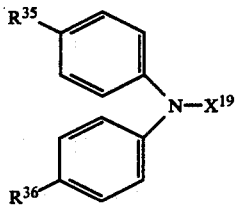
| Compound | $-R^{35}$ | $-R^{36}$ | $-X^{19}$ |
|---|---|---|---|
| XVII-1 | $-H$ | $-H$ | 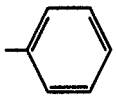 |
| XVII-2 | " | " | 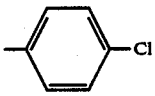 |
| XVII-3 | $-Br$ | $-Br$ | 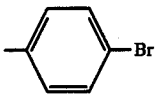 |
| XVII-4 | $-H$ | $-H$ | 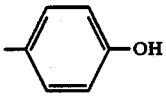 |
| XVII-5 | " | " | 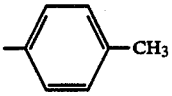 |
| XVII-6 | " | " | 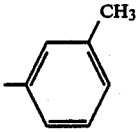 |
| XVII-7 | " | " | 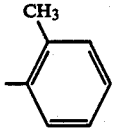 |

-continued
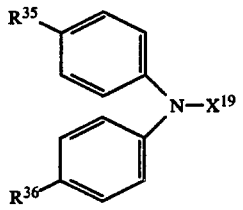
| Compound | $-R^{35}$ | $-R^{36}$ | $-X^{19}$ |
|---|---|---|---|
| XVII-8 | $-CH_3$ | $-H$ | 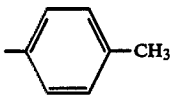 |
| XVII-9 | " | $-CH_3$ | " |
| XVII-10 | $-H$ | $-H$ | 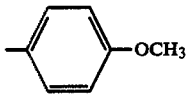 |
| XVII-11 | $-H$ | $-H$ | 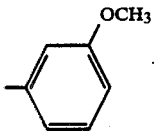 |
| XVII-12 | " | " | 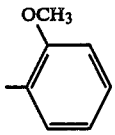 |
| XVII-13 | $-OCH_3$ | " | 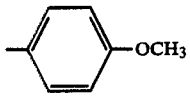 |
| XVII-14 | " | $-OCH_3$ | " |
| XVII-15 | $-CH_3$ | H | " |
| XVII-16 | $-H$ | " | 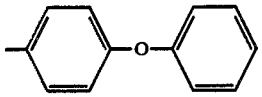 |
| XVII-17 | " | " | 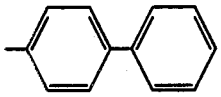 |
| XVII-18 | " | " | 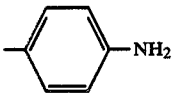 |
| XVII-19 | " | " | 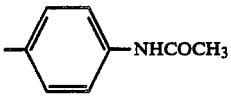 |
| XVII-20 | $-H$ | $-H$ | 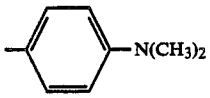 |

-continued
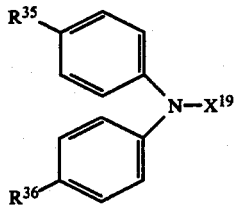
| Compound | $-R^{35}$ | $-R^{36}$ | $-X^{19}$ |
|---|---|---|---|
| XVII-21 | —H | —H | 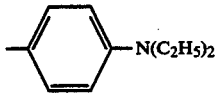 |
| XVII-22 | " | " | 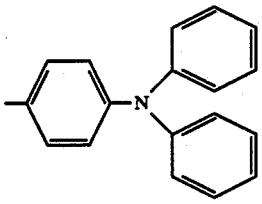 |
| XVII-23 | " | " | 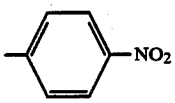 |
| XVII-24 | $-NO_2$ | " | 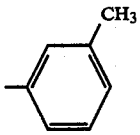 |
| XVII-25 | —H | " | 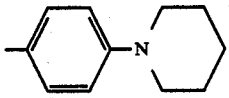 |
| XVII-26 | " | " | 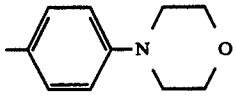 |
| XVII-27 | " | " | 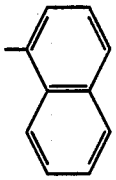 |
| XVII-28 | $-CH_3$ | $-CH_3$ | " |
| XVII-29 | —H | —H | 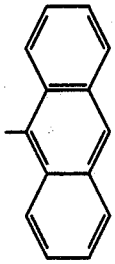 |

-continued

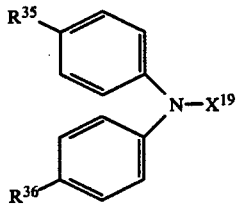

| Compound | $-R^{35}$ | $-R^{36}$ | $-X^{19}$ |
|---|---|---|---|
| XVII-30 | $-CH_3$ | $-CH_3$ | 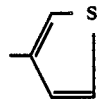 |
| XVII-31 | $-H$ | $-H$ | 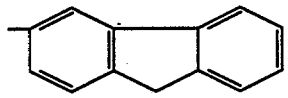 |
| XVII-32 | $-CH_3$ | $-CH_3$ | 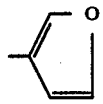 |
| XVII-33 | $-H$ | $-H$ | 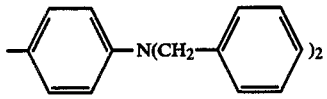 |

As mentioned previously, the examples of layer constitution of a photosensitive layer on the photosensitive member of the invention are categorized into a multilayer constitution and a single layer constitution. Furthermore, in order to improve sensitivity, and to reduce residual potential and fatigue caused in the course of repeated operations, one or a plurality of electron accepting material may be incorporated into any single layer constituting a surface layer such as a CTL, CGL, single-layer type photosensitive layer or OCL, or, additionally, into another layer.

The examples of electron accepting materials applicable to the photosensitive member of the invention include succinic acid anhydride, maleic acid anhydride, dibrom maleic acid anhydride, phthalic acid anhydride, tetrachlorophthalic acid anhydride, tetrabromophthalic acid anhydride, trinitrophthalic acid anhydride, tetranitrophthalic acid anhydride, pyromellitic acid anhydride, mellitic acid anhydride, tetracyanoethylene, tetrachanoquinodimethane, O-dinitrobenzene, m-dinitrobenzene, 1,3,5-trinitrobenzene, paranitrobenzonitrile, picryl chloride, quinonechlorimide, chloranil, bromanyl, 2-methylnapthoquinone, dichlorodicyanoparabenzoquinone, anthraquinone, dinitroanthraquinone, trinitrofluorenone, 9-fluorenilidene[dicyanomethylenemalononitrile], picric acid, p-nitrosuccinic acid, 3,5-dinitrosuccinic acid, pentafluorosuccinic acid, 5-nitrosalicylic acid, 3,5-dinitrosalicylic acid, and phthalic acid.

The examples of binder resin applicable to a photosensitive layer according to the invention are as follows: addition polymerization resins such as polyethylene, polypropylene, acrylic resin, methacrylic resin, vinyl chloride resin, vinyl acetate resin, epoxy resin, polyurethane resin, phenol resin, polyester resin, alkyd resin, polycarbonate resin, silicon resin, and melamine resin; polyaddition resins, condensation polymerization resins, and copolymer resins containing more than two of recurring units in these resins; insulative resins such as vinyl chloride/vinyl acetate copolymeric resin, and vinyl chloride/vinyl acetate/maleic acid copolymeric resin; and polymeric organic semiconductors such as poly-N-vinylcarbazole.

The previously mentioned intermediate layer serves as a subbing layer or a barrier layer, and contains, in addition to any of the binder resins above, polyvinyl alcohol, ethylcellulose, carboxymethylcellulose, vinyl chloride/vinyl acetate copolymer, vinyl chloride/vinyl acetate/maleic acid copolymer, casein, N-alkoxymethyl nylon, and starch.

The examples of an electrically conductive substrate which supports the previously mentioned photosensitive member are as follows: a metal plate made of, for example, aluminum or nickel; metal drum or metal foil; plastic film having an evaporation-deposited aluminum, tin oxide, or indium oxide; paper coated with an electrically conductive material; plastic film for plastic drum.

CGL may be formed by a method for vacuum depositing the FGM onto the substrate; or by a method where a CGM is independently, or together with an appropriate binder resin, dissolved in an appropriate solvent, thereby the mixture is homogenized, and the resultant dispersion is applied to and dried over the substrate.

When dispersing the CGL for forming a CGL, the preferred form of the CGL is fine powder having an average particle size of less than 2 μm, in particular, less than 1 μm. Too large a particle size hinders dispersion into the layer, and, at the same time, particles may be partly exposed on the layer surface, resulting in less smooth surface, which may further result in an electrical discharge on the exposed portions of particles, or in toner filming where toner particles adhere onto the exposed portions.

Too small a particle size, however, readily results in aggregated particles, increased resistance of the layer, and increased lattice defects; these disadvantages in turn in deteriorated sensitivity and repeatability. Preparing excessively fine particles also incurs difficulties. Accordingly, the lower limit of the average particle size should be 0.01 μm.

The CGL may be formed in the following manner. The CGL contained in a dispersed medium is converted into fine particles by means of a ball mill, homogenizer or the like, thereby to the mixture is added a binder resin and mixed and homogenized. Then the resultant dispersion is applied and dried. Uniform dispersing is attained by dispersing the particles under the influence of ultrasonic wave.

The examples of a solvent useful in forming CGL include N,N-dimethyl formaldehyde, benzene, toluene, xylene, monochlorobenzene, 1,2-dichloroethane, dichloromethane, 1,1,2-trichloroethane, tetrahydrofuran, methylethylketone, ethyl, acetate, and butyl acetate.

The amount of CGL is 20 to 200 parts by weight, or, preferably, 25 to 100 parts by weight per 100 parts by weight of a binder resin contained in the CGL. When the amount of CGL is smaller than this range, lower sensitivity to light results in increased residual potential; when the amount is greater than this range, dark attenuation increases and acceptable potential decreases.

The preferred thickness of the CGL formed as mentioned above is, for the positive charge type application, 1 to 10 μm, in particular, 3 to 7 μm; for the negative charge type application, 0.01 to 10 μm, in particular, 0.1 to 3 μm.

The CGL for the positive charge type application serves as the outermost layer. Being vulnerable to wear, the CGL requires a greater thickness for improved durability. A greater thickness, however, incurs loss in sensitivity. Means for preventing this problem in addition of CTM to the CGL. However, the structure of CTM is, when compared to CGM, more susceptible to ozone-induced oxidation, and CTM is readily oxidated by ozone, deteriorating durability of the photosensitive member. The invention solves this dilemma by incorporating the compound of the invention.

The CTL may be formed in a manner identical with that of the CGL; a dispersion is prepared by solving and homogenizing the CTM singly, or together with a binder resin, thereby the dispersion is applied and dried).

The amount of CTM is 20 to 200 parts by weight, or, preferably, 30 to 150 parts by weight per 100 parts by weight of a binder resin contained in the CTL.

When the amount of CTL is smaller than this range, lower sensitivity to light often results in increased residual potential; when the amount is greater than this range, the CTM is less readily dissolved in a solvent.

The preferred thickness of the CTM is 5 to 50 μm, in particular, 5 to 30 μm.

The preferred ratio of CGL to CTL is preferably 1:1 to 1:30.

With the previously mentioned single layer constitution, the amount of CGM contained in a binder resin is 20 to 200 parts by weight, or, preferably 20 to 100 parts by weight per 100 parts by weight of a binder resin.

When the amount of CGL is smaller than this range, lower sensitivity to light often results in increased residual potential; when the amount is greater than this range, both dark attenuation and acceptable potential deteriorate.

Next, the amount of CTM contained in a binder resin is 20 to 200 parts by weight, or, preferably, 35 to 100 parts by weight per 100 parts by weight of a binder resin.

When the amount of CTM is smaller than this range, lower sensitivity to light often results in increased residual potential; when the amount is greater than this range, the CTM is less readily dissolved in a solvent.

With a single layer-type photosensitive layer, the preferred ratio of CGM to CTM is, in terms of weight, 1:3 to 1:2.

With a protective layer which is incorporated according to a specific requirement, a binder used is a transparent resin having a volume resistance of greater than $10^8$ Ωcm, or, preferably, greater than $10^{10}$ Ω.cm, in particular, $10^{13}$ Ωcm. This binder should contain light-setting or thermosetting resin at a rate of more than 50 wt %.

The examples of such a light-setting or thermosetting resin are as follows: thermosetting acrylic resin, silicon resin, epoxy resin, urethane resin, urea resin, phenol resin, polyester resin, alkyd resin, and melamine resin; light-setting cinnamic resin; and copolymeric or condensation resins comprising any of these resins; and any of light-setting and thermosetting resins applicable to an eletrophotographic material. The protective layer may, in compliance with a specific requirement, contain less than 50 wt % of a thermoplastic resin in order to improve processability and physical property (prevention of cracks, and increased flexibility). The examples of such a thermoplastic resin include polypropylene, acrylic resin, methacrylic resin, vinyl chloride resin, vinyl acetate resin, epoxy resin, butyral resin, polycarbonate resin, silicon resin; and copolymeric resins of these resins, for example, vinyl chloride/vinyl acetate copolymeric resin; and polymeric organic semiconductor such as poly-N-vinylcarbazole; and any of thermoplastic resins applicable to an eletrophotographic material.

The protective layer may contain an electron accepting material. This layer may additionally contain, in compliance with a specific requirement, an ultrasonic absorbent or the like to protect the CGL. These ingredients are, together with the binder, dissolved in a solvent, whereby the solution is applied and dried to form a layer of less than 2 μm thickness, or, preferably, less than 1 μm thickness, by means of dip coating, spray coating, blade coating, or roll coating process or the like.

The present invention is hereinunder described by referring to examples. However, the scope of embodiment of the invention is not limited only to these preferred examples.

EXAMPLE 1

First, on an electrically conductive substrate comprising a polyester film: having an aluminum foil lamination was formed a 0.1 μm thick intermediate layer of vinyl chloride/vinyl acetate/maleic acid copolymer (S-Lec MF-10, manufactured by Sekisui Chemical Co., Ltd.).

Second, a 1,2-dichloroethane solution having dissolved 16.5 wt % mixture of CTM (IX-75) and polycarbonate resin (Panlite L-1250 manufactured by Teijin Chemicals Ltd.; a ratio of IX-75 to Panlite was 75:100 by weight) was prepared. The solution was applied onto the intermediate layer by means of dip coating and then dried to form a 15 μm thick CTL.

Third, sublimated 4,10-dibromoanthoanthrone (VI-3) serving as CGM and Panlite L-1250 (ratio of VI-3 to Panlite L-1250 50:100 by weight) were pulverized for 24 hours with a ball mill, whereby 9 wt % 1,2-dichloroethane was added. The resultant solution was homogenized in a ball mill for another 24 hours and then CTM (IX-75) was added to the dispersion at a rate of 75 wt % against Panlite L-1250 together with compound (A-21) of the invention at a rate of 10 wt % against CTM. Monochlorobenzene was further added to the resultant dispersion so that a ratio of monochlorobenzene and 1,2-dichloroethane became 3:7 by volume. The obtained coating solution was sprayed on the previously mentioned CTL so as to form a 5 μm thick CGL. Thus, a photosensitive member having a lamination structure according to the invention was obtained.

COMPARATIVE EXAMPLE 1

A comparative photosensitive member was prepared similarly to Example 1 except that compound (A-21) in CGL was omitted.

EXAMPLE 2

A photosensitive member of the invention was prepared in a manner identical with Example 1 except that compound (A-21) was replaced with compound (A-53).

EXAMPLE 3

A solution was prepared by dissolving 1.55 parts by weight of a thermosetting resin comprising acrylic, melamine, and epoxy resins (a ratio among constituents was 1:1:1) together with 0.155 parts by weight of a compound (A-21) of the invention into 100 parts by weight of a mixed solvent of monochlorobenzene and 1,1,2-trichloroethane (the ratio of mixture was 1:1 by volume). The obtained coating solution was prayed on and dried over a photosensitive member similar to Example 1 except lacking compound (A-21) in a CGL, (i.e. a photosensitive member identical with Comparative example 1) in order to form a 1 μm thick protective layer. Thus, a photosensitive member of the invention was obtained.

EXAMPLE 4

On a photosensitive member similar to Example 1 except lacking compound (A-21) in a CGL was sprayed and dried a primer PH91 (manufactured by Toshiba Silicon) for silicon hard coating in order to form a 0.1 μm thick layer, further sprayed and dried thereon, a solution dissolving silicon hard coat, Tossguard 510, (manufactured by Toshiba Silicon) and 10 parts by weight of compound (A-21) in order to form a 1 μm thick protective layer. Thus, a photosensitive member of the invention was obtained.

EXAMPLE 5

First, on an electrically conductive substrate comprising a polyester film having an aluminum foil lamination was formed an intermediate layer identical with that of Example 1.

Second, a methylethyl ketone solution dissolving 8 wt % butyral resin (S-Lec BX-1, manufactured by Sekisui Chemical Co., Ltd.) and 6 wt % CTM (IX-75) was prepared. This solution was applied on and dried over the intermediate layer to form a 10 μm thick CTL.

Third, 0.2 g CGM (IV-7) was pulverized in Paint Conditioner (manufactured by Red Devil) for 30 minutes, into which 8.3 g mixed solvent of 1,2-dichloroethane and 1,1,2-trichloroethane dissolving 0.5 wt % polycarbonate resin (previously mentioned Panlite L-1250) was added and homogenized for 3 minutes. Next, 19.1 g mixed solvent of 1,2-dichloroethane and 1,1,2-trichloroethane dissolving 3.3 wt % polycarbonate resin, 2.6 wt % CTM (IX-75) and 0.26 wt % compound (A-21) was added to the dispersion, which was further homogenized for another 30 minutes. The obtained dispersion was sprayed on and dried over the CTL to form a 5 μm thick CGL. Thus, a photosensitive member having a lamination-type photosensitive layer according to the invention was obtained.

COMPARATIVE EXAMPLE 2

A comparative photosensitive member was prepared similarly to Example 5 except that compound (A-21) in CGL was omitted.

EXAMPLE 6

A photosensitive member of the invention was prepared in a manner identical with Example 5 except that compound (A-21) was replaced with compound (A-53).

EXAMPLE 7

A protective layer identical with that of Example 3, wherein compound (A-21) used in Example 3 being retained, was formed on a photosensitive member identical with Example 5 except lacking compound (A-21) in a CGL (i.e. a photosensitive member of Comparative example 2) in order to provide a photosensitive member of the invention.

EXAMPLE 8

A protective layer identical with that of Example 4, wherein compound (A-21) being retained, was formed on a photosensitive member identical with Example 5 except lacking compound (A-21) in a CGL, in order to provide a photosensitive member of the invention.

EXAMPLE 9

First, on a polyester film having an evaporated aluminum on it was disposed and intermediate layer identical with that of Example 1.

Second, 40 g of sublimated 4,10-dibromoanthoanthrone (VI-3) was pulverized in a ceramic ball mill for 24 hours at 40 rpm, thereby 20 g Panlite L-1250 (previously mentioned) and 1300 ml 1,2-dichloroethane were added. The resultant mixture was homogenized for another 24 hours to provide a coating solution for CGL.

This solution was applied to the intermediate layer above so as to form a 1 μm thick CGL.

Third, a solution was prepared by dissolving 7.5 g CTM (IX-61), 10 g Panlite L-1250 and 0.75 g compound (A-21) into 80 ml 1,2-dichloroethane. The solution was applied onto the CGL to form a 15 μm thick CTL. Thus, a photosensitive member of the inventions was obtained.

COMPARATIVE EXAMPLE 3

A comparative photosensitive member was prepared similarly to Example 9 except that compound (A-21) in a CTL was omitted.

EXAMPLE 10

First, on an electrically conductive substrate comprising a 100 μm thick polyethylene terephthalate film having an evaporated aluminum was disposed an intermediate layer identical with that of Example 1.

Second, a 1.5 g bisazo compound (IV-7) serving as CGL was dispersed into a 100 ml mixed solvent of 1,2-dichloroethane and monoethanolamine (mixed at a ratio of 1000:1 by volume) with a ball mill for 8 hours. The resultant dispersion was applied to and thoroughly dried over the intermediate layer to form a 0.3 μm thick CGL.

Third, a solution was prepared by dissolving 11.25 g styril compound (IX-43) serving as CTM, 15 g Panlite L-1250 (previously mentioned), and 1.125 g compound (A-21) into 100 ml 1,2-dichloroethane. The obtained solution was applied to and thoroughly dried over the CGL to form a 15 μm thick CTL. Thus, a photosensitive member of the invention was obtained.

COMPARATIVE EXAMPLE 4

A comparative photosensitive member was prepared similarly to Example 10 except that compound (A-21) in CTL was omitted.

EXAMPLES 11 through 18

Photosensitive members of Examples 11 through 18 of the invention were prepared in a manner identical with Example 1 except that compound (a-21) was replaced respectively with each of compounds (A-54), (A-55), (A-56), (A-57), (A-62), (A-67), (A-72) and (A-77).

Twenty-two types of photosensitive members thus obtained were respectively tested for ozone-resistance in a manner hereinunder described. An ozone fatigue tester, comprising an eletrostatic tester (model SP-428, manufactured by Kawaguchi Denki Seisakusho) equipped with a ozonator (Model 0-1-2, manufacture by Nippon Ozone) and an ozone monitor (Model EG-2001, manufactured by Ebara Jitsugyo), was employed in the present test. A photosensitive member was loaded in the ozone fatigue tester and subjected to the following characteristic test in the presence of 90 ppm ozone.

To a photosensitive member was applied an electrical potential either +6 kV or −6 kV, depending the type of photosensitive member, (i.e. +6 kV applied to a positive-electrification type photosensitive member and −6 kV applied to a negative-electrification type photosensitive member), thereby corona discharge was applied to each photosensitive layer for 5 seconds in order to electrify the layer, which was the allowed to stand for 5 seconds (this potential is initial voltage $V_o$). And then, a photosensitive member as irradiated with a tungsten lamp, wherein illuminance of the surface of a photosensitive layer was set at 14 lux. Each photosensitive member underwent this procedure 100 times repeatedly, and then the residual potential (V) was measured. The ozone resistance of each photosensitive member was evaluated based on the value obtained by the formula $V/V_o \times 100(\%)$.

A larger value $V/V_o \times 100(\%)$ indicates that a subject photosensitive member is less susceptible to ozone-induced deterioration.

The results obtained are listed in Table 1.

TABLE 1

| Example Comparative | Compound added | CGM | CTM | $V_1/V_o \times 100$ (%) |
|---|---|---|---|---|
| Example 1 | A-21 | VI-3 | IX-75 | 80 |
| Comparative 1 | — | " | " | 50 |
| Example 2 | A-53 | " | " | 80 |
| Example 3 | A-21 | " | " | 85 |
| Example 4 | " | " | " | 87 |
| Example 5 | " | IV-7 | " | 83 |
| Comparative 2 | — | " | " | 45 |
| Example 6 | A-53 | " | " | 82 |
| Example 7 | A-21 | " | " | 85 |
| Example 8 | " | " | " | 87 |
| Example 9 | " | VI-3 | IX-61 | 93 |
| Comparative 3 | — | " | " | 60 |
| Example 10 | A-21 | IV-7 | IX-43 | 92 |
| Comparative 4 | — | " | " | 60 |
| Example 11 | A-55 | IV-3 | IX-75 | 83 |
| Example 12 | A-57 | " | " | 82 |
| Example 13 | A-54 | " | " | 84 |
| Example 14 | A-56 | " | " | 84 |
| Example 15 | A-62 | " | " | 82 |
| Example 16 | A-67 | " | " | 81 |
| Example 17 | A-72 | " | " | 83 |
| Example 18 | A-77 | " | " | 82 |

As is apparent from Table 1, addition of a compound according to the invention remarkably improves the potential loss, during corona electrification, induced by the presence of ozone.

EXAMPLE 19

A photosensitive member of the invention was prepared in a manner identical with Example 1 except that compound (A-21) was replaced with compound (B-12).

COMPARATIVE EXAMPLE 5

A comparative photosensitive member was prepared similarly to Example 19 except that compound (B-12) in CGL was omitted.

EXAMPLE 20

A photosensitive member of the invention was prepared in a manner identical with Example 19 except that compound (B-12) was replaced with compound (B-3).

EXAMPLE 21

A solution was prepared by dissolving 1.55 parts by weight of a thermosetting resin comprising acrylic, melamine, and epoxy resins (a ratio among constituents was 1:1:1) together with 0.155 parts by weight of a compound (B-12) of the invention into 100 parts by weight of a mixed solvent of monochlorobenzene and 1,1,2-trichloroethane (the ratio of mixture was 1:1 by volume). The obtained solution was sprayed on and dried over a photosensitive member similar to Example 19 except lacking compound (B-12) in a CGL (i.e. a photosensitive member identical with Comparative example 1) in order to form a 1 μm thick protective layer. Thus, a photosensitive member of the invention was obtained.

EXAMPLE 22

On a photosensitive member similar to Example 19 except lacking compound (B-12) in a CGL was sprayed and dried a primer PH91 (manufactured by Toshiba Silicon) for silicon hard coating to form a 0.1 μm thick layer, whereby a solution dissolving silicon hard coat, Tossguard 510, (manufactured by Toshiba Silicon) and 10 parts by weight (per 100 parts by weight of resin component) of compound (B-12) was sprayed and dried so as to form a 1 μm thick protective layer. Thus, a photosensitive member of the invention was obtained.

EXAMPLE 23

A photosensitive member of the invention was prepared in a manner identical with Example 5 except that compound (A-21) was replaced with compound (B-12).

COMPARATIVE EXAMPLE 6

A comparative photosensitive member was prepared similarly to Example 23 except that compound (B-12) in a CGL was omitted.

EXAMPLE 24

A photosensitive member of the invention was prepared in a manner identical with Example 23 except that compound (B-12) was replaced with compound (B-3).

EXAMPLE 25

A protective layer identical with that of Example 21, wherein compound (B-12) used in Example 21 being retained, was disposed on a photosensitive member identical with Example 23 except lacking compound (B-12) in a CGL (i.e. a photosensitive member of Comparative example 6) in order to provide a photosensitive member of the invention.

EXAMPLE 26

A protective layer identical with that of Example 22, wherein compound (B-12) used in Example 22 being retained, was disposed on a photosensitive member identical with Example 23 except lacking compound (B-12) in a CGL in order to provide a photosensitive member of the invention.

EXAMPLE 27

A photosensitive member of the invention was prepared in a manner identical with Example 9 except that compound (A-21) was replaced with compound (B-12).

COMPARATIVE EXAMPLE 7

A comparative photosensitive member was prepared similarly to Example 27 except that compound (B-12) in a CTL was omitted.

EXAMPLE 28

A photosensitive member of the invention was prepared in a manner identical with Example 10 except that compound (A-21) was replaced with compound (B-12).

COMPARATIVE EXAMPLE 8

Comparative photosensitive members were prepared similarly to Example 28 except that compound (B-12) in CTL was omitted.

Fourteen types of photosensitive members thus obtained were evaluated for their ozone-resistance in a manner identical with that Example 1.

The results obtained are listed in Table 2.

TABLE 2

| Photosensitive member | Compound added | CGM | CTM | $V_1/V_o \times 100$ (%) |
|---|---|---|---|---|
| Example 19 | B-12 | VI-3 | IX-75 | 85 |
| Comparative 5 | — | " | " | 50 |
| Example 20 | B-3 | " | " | 84 |
| Example 21 | B-12 | " | " | 90 |
| Example 22 | " | " | " | 91 |
| Example 23 | " | IV-7 | " | 84 |
| Comparative 6 | — | " | " | 45 |

TABLE 2-continued

| Photosensitive member | Compound added | CGM | CTM | $V_1/V_o \times 100$ (%) |
|---|---|---|---|---|
| Example 24 | B-3 | " | " | 85 |
| Example 25 | B-12 | " | " | 90 |
| Example 26 | " | " | " | 91 |
| Example 27 | " | VI-3 | IX-61 | 95 |
| Comparative 7 | — | " | " | 60 |
| Example 28 | B-12 | IV-7 | IX-43 | 88 |
| Comparative 8 | — | " | " | 60 |

As is apparent from Table 2, addition of a compound according to the invention remarkably improves the potential loss, during corona electrification, induced by the presence of ozone.

EXAMPLE 29

A photosensitive member of the invention was prepared in a manner identical with Example 1 except that compound (A-21) was replaced with compound (C-1).

COMPARATIVE EXAMPLE 9

A comparative photosensitive member was prepared similarly to Example 29 except that compound (C-1) in CGL was omitted.

EXAMPLE 30

A photosensitive member of the invention was prepared in a manner identical example 29 except that compound (C-1) was replaced with compound (C-2).

EXAMPLE 31

A solution was prepared by dissolving 1.55 parts by weight of a thermosetting resin comprising acrylic, melamine, and epoxy resins (a ratio among constituents was 1:1:1) together with 0.155 parts by weight of a compound (C-1) of the invention into 100 parts by weight of a mixed solvent of monochlorobenzene and 1,1,2-trichloroethane (the ratio of mixture was 1:1 by volume). The obtained solution was sprayed on and dried over a photosensitive member similar to Example 29 except lacking compound (C-1) in a CGL (i.e. a photosensitive member identical with Comparative example 1) in order to form a 1 μm thick protective layer. Thus, a photosensitive member of the invention was obtained.

EXAMPLE 32

On a photosensitive member similar to Example 29 except lacking compound (C-1) in a CGL was applied by means of spray coating and dried a primer PH91 (manufactured by Toshiba Silicon) for silicon hard coating to form a 0.1 μm thick layer, whereby a solution dissolving silicon hard coat, Tossguard 510, (manufactured by Toshiba Silicon) and 10 parts by weight (per 100 parts by weight of resin component) of compound (C-1) was sprayed and dried so as to a 1 μm thick protective layer. Thus, a photosensitive member of the invention was obtained.

EXAMPLE 33

A photosensitive member of the invention was prepared in a manner identical with Example 5 except that compound (A-21) was replaced with compound (C-1).

COMPARATIVE EXAMPLE 10

A comparative photosensitive member was prepared similarly to Example 33 except that compound (C-1) in CGL was omitted.

EXAMPLE 34

A photosensitive member of the invention was prepared in a manner identical with Example 33 except that compound (C-1) was replaced with compound (C-2).

EXAMPLE 35

A protective layer identical with that of Example 31, wherein compound (C-1) used in Example 31 being retained, was disposed on a photosensitive member identical with Example 33 except lacking compound (C-1) in a CGL (i.e. a photosensitive member of Comparative example 10) in order to provide a photosensitive member of the invention.

EXAMPLE 36

A protective layer identical with that of Example 32, wherein compound (C-1) used in Example 32 being retained, was disposed on a photosensitive member identical with Example 33 except lacking compound (C-1) in a CGL in order to provide a photosensitive member of the invention.

EXAMPLE 37

A photosensitive member of the invention was prepared in a manner identical with Example 9 except that compound (A-21) was replaced with compound (C-1).

COMPARATIVE EXAMPLE 11

A comparative photosensitive member was prepared similarly to Example 37 except that compound (C-1) in CTL was omitted.

EXAMPLE 38

A photosensitive member of the invention was prepared in a manner identical with Example 10 except that compound (A-21) was replaced with compound (C-1).

COMPARATIVE EXAMPLE 12

Comparative photosensitive members were prepared similarly to Example 38 except that compound (C-1) in CTL was omitted.

Fourteen types of photosensitive members thus obtained were evaluated for their ozone-resistance in a manner identical with that of Example 1.

The results obtained are listed in Table 3.

TABLE 3

| Photosensitive member | Compound added | CGM | CTM | $V_1/V_o \times 100$ (%) |
|---|---|---|---|---|
| Example 29 | C-1 | VI-3 | IX-75 | 85 |
| Comparative 9 | — | " | " | 50 |
| Example 30 | C-2 | " | " | 86 |
| Example 31 | C-1 | " | " | 90 |
| Example 32 | " | " | " | 92 |
| Example 33 | " | IV-7 | " | 83 |
| Comparative 10 | — | " | " | 45 |
| Example 34 | C-2 | " | " | 82 |
| Example 35 | C-1 | " | " | 87 |
| Example 36 | " | " | " | 90 |
| Example 37 | " | VI-3 | IX-61 | 93 |
| Comparative 11 | — | " | " | 66 |
| Example 38 | C-1 | IV-7 | IX-43 | 85 |
| Comparative 12 | — | " | " | 50 |

As is apparent from Table 3, addition of a compound according to the invention remarkably improves the potential loss, during corona electrification, induced by the presence of ozone.

EXAMPLE 39

A photosensitive member of the invention was prepared in a manner identical with Example 1 except that compound (A-21) was replaced with compound (D-9).

COMPARATIVE EXAMPLE 13

A comparative photosensitive member was prepared similarly to Example 39 except that compound (D-9) in CGL was omitted.

EXAMPLE 40

A photosensitive member of the invention was prepared in a manner identical with Example 39 except that compound (D-9) was replaced with compound (D-2).

EXAMPLE 41

A solution was preferably by dissolving 1.55 parts by weight of a thermosetting resin comprising acrylic, melamine, and epoxy resins (a ratio among constituents was 1:1:1) together with 0.00078 parts by weight of a compound (D-9) of the invention into 100 parts by weight of a mixed solvent of monochlorobenzene and 1,1,2-trichloroethane (the ratio of mixture was 1:1 by volume). The obtained solution was sprayed on and dried over a photosensitive member similar to Example 39 except lacking compound (D-9) in a CGL (i.e. a photosensitive member identical with Comparative example 13) in order to form a 1 μm thick protective layer. Thus, a photosensitive member of the invention was obtained.

EXAMPLE 42

On a photosensitive member similar to Example 39 except lacking compound (D-9) in a CGL was applied by means of spray coating and dried a primer PH91 (manufactured by Toshiba Silicon) for silicon hard coating to form a 0.1 μm thick layer, whereby a solution dissolving silicon hard coat, Tossguard 510, (manufactured by Toshiba Silicon) and 10 parts by weight (per 100 parts by weight of resin component) of compound (D-9) was sprayed and dried so as to form a 1 μm thick protective layer. Thus, a photosensitive member of the invention was obtained.

EXAMPLE 43

A photosensitive member of the invention was prepared in a manner identical with Example 5 except that compound (a-21) was replaced with compound (D-9).

COMPARATIVE EXAMPLE 14

A comparative photosensitive member was prepared similarly to Example 43 except the compound (D-9) in CLG was omitted.

EXAMPLE 44

A photosensitive member of the invention was prepared in a manner identical with Example 43 except that compound (D-9) was replaced with compound (D-2).

EXAMPLE 45

A protective layer identical with that of Example 41, wherein compound (D-9) used in Example 41 being retained, was disposed on a photosensitive member identical with Example 43 except lacking compound (D-9) in a CGL, (i.e. a photosensitive member of Comparative example 14) in order to provide a photosensitive member of the invention.

EXAMPLE 46

A protective layer identical with that of Example 42, wherein compound (D-9) used in Example 42 being retained, was disposed on a photosensitive member identical with Example 43 except lacking compound (D-9) in a CGL in order to provide a photosensitive member of the invention.

EXAMPLE 47

A photosensitive member of the invention was prepared in a manner identical with Example 9 except that compound (A-21) was replaced with compound (D-9).

COMPARATIVE EXAMPLE 15

A comparative photosensitive member was prepared similarly to Example 47 except that compound (D-9) in CTL was omitted.

EXAMPLE 48

A photosensitive member of the invention was prepared in a manner identical with Example 10 except that compound (A-21) was replaced with compound (D-9).

COMPARATIVE EXAMPLE 16

Comparative photosensitive members were prepared similarly to Example 48 except that compound (D-9) in CTL was omitted.

Fourteen types of photosensitive members thus obtained were evaluated for their ozone-resistance in a manner identical with that of Example 1.

The results obtained are listed in Table 4.

TABLE 4

| Example Comparative | Compound added | CGM | CTM | $V_1/V_o \times 100$ (%) |
|---|---|---|---|---|
| Example 39 | D-9 | VI-3 | IX-75 | 94 |
| Comparative 13 | — | " | " | 70 |
| Example 40 | D-2 | " | " | 90 |
| Example 41 | D-9 | " | " | 93 |
| Example 42 | " | " | " | 94 |
| Example 43 | " | IV-7 | " | 83 |
| Comparative 14 | — | " | " | 60 |
| Example 44 | D-2 | " | " | 83 |
| Example 45 | D-9 | " | " | 84 |
| Example 46 | " | " | " | 86 |
| Example 47 | " | VI-3 | IX-61 | 95 |
| Comparative 15 | — | " | " | 70 |
| Example 48 | D-9 | IV-7 | IX-43 | 85 |
| Comparative 16 | — | " | " | 75 |

As is apparent from Table 4, addition of a compound according to the invention remarkably improves the potential loss, during corona electrification, induced by the presence of ozone.

We claim:

1. An electrophotographic photosensitive member having improved anti-oxidation properties by ozone, comprising a conductive substrate and, disposed thereon, a photosensitive layer which includes, as principal constituents, a charge generating material and a charge transporting material, wherein the photosensitive layer contains at least one type of compound selected from a group of those represented by any of the following [A] through [D]:

[A] Compounds represented by the following general formula [I];

General formula

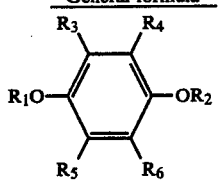

[I]

[wherein $R_1$ and $R_2$ independently represent an alkyl group, alkenyl group, cycloalkyl group, aryl group or heterocyclic group; $R_3$ $R_4$, $R_5$ and $R_6$ independently represent a hydrogen atom, halogen atom, alkyl group, alkenyl group, cycloalkyl group, aryl group, alkoxy group, alkythio group, acyl group, acylamino group, alkylamine group, alkoxycarbonyl group, or sulfonamide group];

[B] Bisspirsindene compounds represented by the following general formula [II];

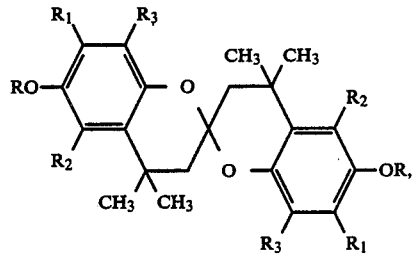

[II]

[wherein $R_1$ represents an alkyl group, alkenyl group, cycloalkyl group, aryl group, alkoxy group, alkenoxy group, or aryloxy group; $R_2$ and $R_3$ independently represent a hydrogen atom, halogen atom, alkyl group, alkenyl group, or alkoxy group;

R represents an alkyl group, alkenyl group, cycloalkyl group, aryl group, heterocyclic group, $R_4CO$— group, $R_5SO_2$— group, or $R_6NHCO$— group; R represents a hydrogen atom, or an alkyl group, alkenyl group, $R_4CO$— group, $R_5SO_2$— group, or $R_6NHCO$— group; $R_4$, $R_5$ and $R_6$ independently represent an alkyl group, alkenyl group, cycloalkyl group, aryl group, or heterocyclic group;

when R is $R_4CO$— group, $R_5SO_2$ group or $R_6NHCO$— group, R and R' may be either a same type of groups, or may be different groups];

[C] Bisspiroindene compounds represented by the following general formula [III];

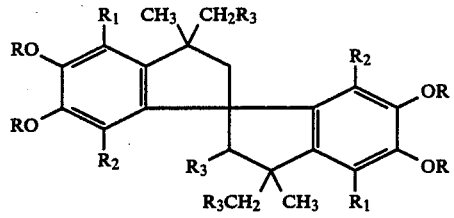

[III]

[wherein R represents an alkyl group, alkenyl group, aryl group, heterocyclic group, $R_4CO$— group, $R_5SO_2$— group, or $R_6NHCO$— group; $R_1$ and $R_2$ independently represent a hydrogen atom, halogen atom, alkyl group, alkenyl group, alkoxy group, or alkenoxy group; $R_3$ represents a hydrogen atom, alkyl group, alkenyl group, or aryl group; $R_4$, $R_5$ and $R_6$ independently represent an alkyl group, alkenyl group, aryl group, or heterocyclic group; and

[D] Compounds having in the molecular structure thereof at least one structure selected from the following groups;

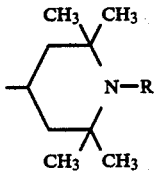

Structural formula (a)

-continued

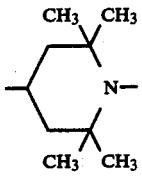

Structural formula (b)

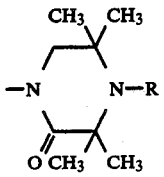

Structural formula (c)

[wherein R represents an organic substituent group.]

* * * * *